US007029169B2

(12) United States Patent
Takahashi et al.

(10) Patent No.: US 7,029,169 B2
(45) Date of Patent: Apr. 18, 2006

(54) CHRONOGRAPH TIMEPIECE HAVING ZEROING STRUCTURE

(75) Inventors: Takashi Takahashi, Chiba (JP); Mamoru Watanabe, Chiba (JP); Katsuyoshi Takizawa, Chiba (JP); Shigeo Suzuki, Chiba (JP); Takeshi Tokoro, Chiba (JP)

(73) Assignee: Seiko Instruments Inc., Chiba (JP)

( * ) Notice: Subject to any disclaimer, the term of this patent is extended or adjusted under 35 U.S.C. 154(b) by 104 days.

(21) Appl. No.: 10/809,577

(22) Filed: Mar. 25, 2004

(65) Prior Publication Data

US 2004/0218473 A1 Nov. 4, 2004

(30) Foreign Application Priority Data

Mar. 27, 2003 (JP) ..... 2003-087285

(51) Int. Cl.
*G04F 8/00* (2006.01)

(52) U.S. Cl. ..... 368/106; 368/110; 368/220

(58) Field of Classification Search ..... 368/101–106, 368/110–113, 220, 223
See application file for complete search history.

(56) References Cited

U.S. PATENT DOCUMENTS 5,220,541 A * 6/1993 Vuilleumier ..... 368/88
5,793,708 A * 8/1998 Schmidt et al. ..... 368/106
6,406,176 B1 * 6/2002 Takahashi et al. ..... 368/101
6,428,201 B1 * 8/2002 Shibuya et al. ..... 368/106

FOREIGN PATENT DOCUMENTS

| | | |
|---|---|---|
| JP | 9178868 | 7/1997 |
| JP | 11023741 | 1/1999 |
| JP | 3336041 | 8/2002 |

* cited by examiner

*Primary Examiner*—Kamand Cuneo
*Assistant Examiner*—Jeanne-Marguerite Goodwin

(74) *Attorney, Agent, or Firm*—Adams & Wilks

(57) ABSTRACT

To realize a chronograph timepiece capable of firmly and simultaneously zeroing an hour heart cam, a second heart cam and a minute heart cam. A chronograph timepiece of the invention includes a hammer operated by operating a reset button for controlling to operate to zero an hour chronograph wheel & pinion, a minute chronograph wheel & pinion and a second chronograph wheel & pinion. When the hammer is brought into contact with an hour heart cam, a second heart cam and a minute heart cam, a position of the hammer is determined only by the hour heart cam, the second heart cam and the minute heart cam. When the hammer is brought into contact with the hour heart cam, the second heart cam and the minute heart cam, a direction of a press force exerted to the hammer is constituted to pass a rotational center of the second chronograph wheel.

6 Claims, 37 Drawing Sheets

CHRONOGRAPH TIMEPIECE HAVING ZEROING STRUCTURE

BACKGROUND OF THE INVENTION

1. Field of the Invention

The present invention relates to a chronograph timepiece having a zeroing structure. Particularly, the invention relates to a chronograph timepiece constituted to be able to firmly and simultaneously zero a chronograph hour hand, a chronograph minute hand and a chronograph second hand by a hammer.

2. Description of the Prior Art (1) A Chronograph Timepiece of a First Type of a Prior Art According to a chronograph timepiece of a first type of a prior art, when a reset button is depressed, a hammer transmission lever is rotated. By rotating the hammer transmission lever, a hammer is brought into contact with a second heart cam to zero a chronograph second hand. Further, when the reset button is depressed, an hour hammer transmission lever (A) is rotated. By rotating the hour hammer transmission lever (A), an hour hammer transmission lever (B) is rotated. By rotating the hour hammer operating lever (B), an hour hammer is brought into contact with a minute heart cam to zero a chronograph minute hand, simultaneously, brought into contact with an hour heart cam to zero a chronograph hour hand (refer to, for example, JP-A-11-23741).

(2) A Chronograph Timepiece of a Second Type of a Prior Art

According to a chronograph timepiece of a second type of a prior art, in resetting operation, when a button on a 4 o'clock side is depressed, a zeroing lever is rotated. By rotating the zeroing lever, a chronograph hammer is rotated. The chronograph hammer is brought into contact with three heart-like members to zero three hands (refer to, for example, Japanese Patent Publication No. 3336041).

(3) A Chronograph Timepiece of a Third Type of a Prior Art

According to a chronograph timepiece of a third type of a prior art, when a chronograph depressing member is depressed, a lever for hammer is operated. By operating the lever for hammer, three hammers of zeroing control members are respectively brought into contact with three cams to zero three hands (refer to, for example, JP-A-9-178868).

However, according to the chronograph timepieces of the prior arts, there are problems shown below.

(1) A Problem of the Chronograph Timepiece of the First Type of the Prior Art

According to the chronograph timepiece of the first type of the prior art, the chronograph second hand is zeroed by the hammer transmission lever and the hammer, the chronograph minute hand and the chronograph hour hand are zeroed by the hour hammer transmission lever (A), the hour hammer transmission lever (B) and the hour hammer and therefore, a number of parts constituting zeroing operation is large. Further, parts for zeroing the chronograph second hand and parts for zeroing the chronograph minute hand and the chronograph hour hand are separated from each other and therefore, much time is needed in assembling and adjusting the parts.

Further, according to the chronograph timepiece of the first type of the prior art, a clutch mechanism is provided at a surface train wheel. Further, a number of parts constituting a chronograph mechanism is large and the chronograph mechanism is complicated. Therefore, according to the chronograph timepiece of the first type of the prior art, there poses a problem of increasing a thickness of a movement.

(2) A Problem of the Chronograph Timepiece of the Second Type of the Prior Art

According to the chronograph timepiece of the second type of the prior art, a tolerance of a part of a portion at which the chronograph hammer is brought into contact with the heart-like member is severe and there is a necessity of individually adjusting the part in contact with the heart-like member in fabricating the chronograph hammer. That is, the chronograph hammer is rotated to be brought into contact with the three heart-like members simultaneously and therefore, it is very difficult to accurately control dimensions and shapes of the three parts of the chronograph hammer in contact with the heart-like members.

(3) A Problem of the Chronograph Timepiece of the Third Type of the Prior Art

According to the chronograph timepiece of the third type of the prior art, tolerances of parts of portions at which the three hammers of the zeroing members are brought into contact with the three cams are severe and there is a necessity of individually adjusting the portions in contact with the cams in fabricating the chronograph hammer. That is, the zeroing members are rotated to be brought into contact with the cams simultaneously and therefore, it is very difficult to accurately control dimensions and shapes of the three portions of the three hammers of the zeroing member in contact with the cams.

SUMMARY OF THE INVENTION

It is an object of the invention to realize a chronograph timepiece having a small number of parts and facilitating fabrication and assembly of a hammer mechanism.

Further, it is another object of the invention to realize a chronograph timepiece capable of firmly and simultaneously zeroing an hour heart cam, a second heart cam and a minute heart cam.

Further, it is another object of the invention to realize a chronograph timepiece constituted to make a force of bringing a hammer into contact with an hour heart cam, a force of bringing the hammer into contact with the second heart cam, and a force of bringing the hammer into contact with a minute heart cam substantially uniform.

The invention is constituted to comprise a main plate constituting a base plate of a movement (100), a surface train wheel rotated based on rotation of a barrel complete, an escapement/speed control apparatus for controlling rotation of the surface train wheel, at least one of an automatic winding apparatus and a hand winding apparatus, a second chronograph train wheel, a minute chronograph train wheel and an hour chronograph train wheel in a chronograph timepiece constituting a power source by a mainspring provided in the barrel complete. According to the chronograph timepiece of the invention, the hour chronograph train wheel includes an hour chronograph wheel & pinion, the minute chronograph train wheel includes a minute chronograph wheel & pinion and the second chronograph train wheel includes a second chronograph wheel & pinion. An angle made by a straight line connecting a rotational center of the second chronograph wheel and pinion and a rotational center of the hour chronograph wheel & pinion and a straight line connecting the rotational center of the second chronograph wheel & pinion and a rotational center of a minute chronograph wheel & pinion is constituted to be 90 degrees. The hour chronograph wheel & pinion includes an hour heart cam, the minute chronograph wheel & pinion includes a minute heart cam and the second chronograph wheel & pinion includes a second heart cam. The chronograph timepiece of the invention further comprises a reset button for controlling to operate to zero the hour chronograph wheel & pinion, the minute chronograph wheel & pinion and the second chronograph wheel & pinion and a hammer operated by operating the reset button for controlling to operate to zero the hour chronograph wheel & pinion, operate to zero the minute chronograph wheel & pinion and operate to zero the second chronograph wheel & pinion.

The chronograph timepiece of the invention is constituted such that when the hammer is brought into contact with the hour heart cam, the second heart cam and the minute heart cam, a position of the hammer is determined only by the hour heart cam, the second heart cam and the minute heart cam and when the hammer is brought into contact with the hour heart cam, the second heart cam and the minute heart cam, a direction of a press force applied to the hammer passes the rotational center of the second chronograph wheel.

Further, the chronograph timepiece of the invention is constituted such that "hour" of a result of measuring chronograph is indicated by a chronograph hour hand attached to the hour chronograph wheel & pinion, "minute" of the result of measuring the chronograph is indicated by a chronograph minute hand attached to the minute chronograph wheel & pinion and "second" of the result of measuring the chronograph is indicated by a chronograph second hand attached to the second chronograph wheel & pinion. By the constitution, there can be realized a chronograph timepiece having a small number of parts, facilitating to fabricate and assemble a hammer mechanism and capable of firmly and simultaneously zeroing the hour heart cam, the second heart cam and the minute heart cam.

According to the chronograph timepiece of the invention, it is preferable to provide the hammer movably by being guided by a hammer lever guide pin. Further, it is preferable to constitute the chronograph timepiece of the invention such that a clearance is provided between a guide portion for guiding to move the hammer and the hammer lever guide pin and the clearance when the hammer is brought into contact with the hour heart cam, the second heart cam and the minute heart cam is larger than the clearance when the hammer is guided by the hammer lever guide pin. By the constitution, the hammer can be subjected to self alignment by the hour heart cam, the second heart cam and the minute heart cam in zeroing and a degree of freedom can be provided to design of the hammer.

Further, it is preferable to constitute the chronograph timepiece of the invention such that an angle made by an hour heart cam contact portion at which the hammer is brought into contact with the hour heart cam and a second heart cam contact portion at which the hammer is brought into contact with the second heart cam becomes equal to or smaller than 10 degrees and an angle made by the hour heart cam contact portion at which the hammer is brought into contact with the hour heart cam and a minute heart cam contact portion at which the hammer is brought into contact with the minute heart cam falls in a range of 80 degrees through 100 degrees.

Further, it is preferable to constitute the chronograph timepiece of the invention such that a hammer operating pin is provided at the hammer and an angle made by a direction of a force exerted to the hammer operating pin when the hammer is brought into contact with the hour heart cam, the minute heart cam and the second heart cam relative to the second heart cam contact portion of the hammer falls in a range of 57 degrees through 84 degrees. By the constitution, a force of bringing the hammer lever into contact with the hour heart cam, a force of bringing the hammer into contact with the second heart cam and a force of bringing the hammer into contact with the minute heart cam can be made to be substantially uniform.

BRIEF DESCRIPTION OF THE SEVERAL VIEWS OF THE DRAWINGS

A preferred form of the present invention is illustrated in the accompanying drawings in which.

DETAILED DESCRIPTION OF THE PREFERRED EMBODIMENTS

Figure 1:
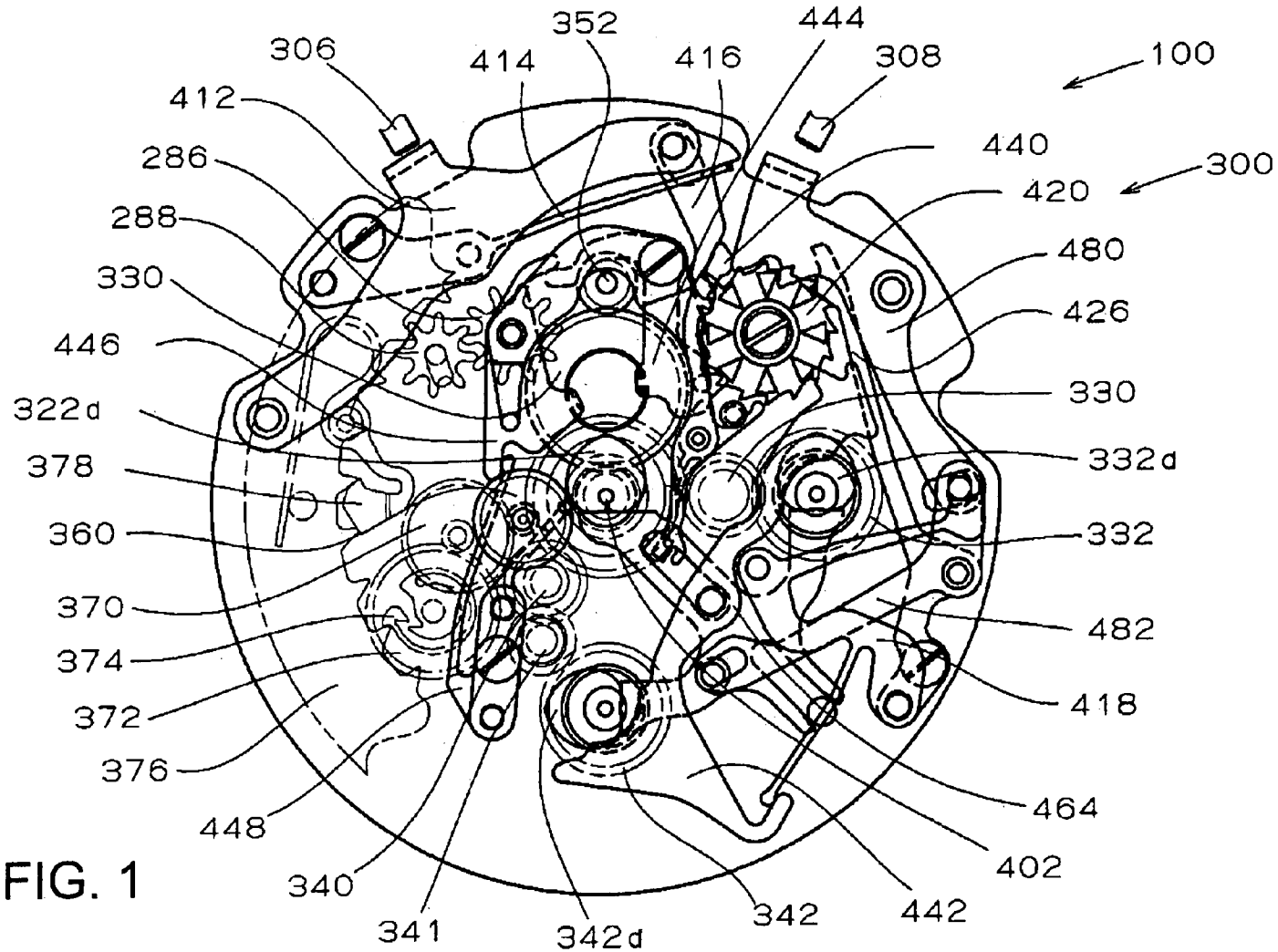
FIG. 1 is a plane view showing a state of viewing a chronograph mechanism and a calendar mechanism, from a dial side according to an embodiment of a chronograph timepiece of the invention.

Embodiments of the invention will be explained in reference to the drawings as follows.

Further, to make clear the explanation, in the respective drawings, a description of a structure of a portion which is less related to the constitution of the invention is omitted. Therefore, a detailed explanation with regard to a structure of a switching apparatus, a hand setting apparatus, an automatic winding apparatus, a hand winding apparatus, a calendar apparatus, a calendar correcting apparatus or the like which can utilize a structure similar to that of a chronograph timepiece of a prior art is omitted.

(1) A Total Constitution of a Movement and Definition of Terminology

In reference to FIG. 1 through FIG. 8, a movement (machine body including drive portion) 100 of a chronograph timepiece of the invention comprises a base unit 101 including a surface train wheel, a back train wheel, a switching apparatus, a hand setting apparatus, an automatic winding apparatus, a hand winding apparatus or the like, and a chronograph unit 300 including a chronograph mechanism, a calendar mechanism (calendar feeding mechanism, calendar correcting mechanism), an indicator driving train wheel or the like. The base unit 101 is constituted to include at least one of the automatic winding apparatus and the hand winding apparatus.

In both sides of a main plate 102, a side having a dial 104 is referred to as "back side" of the movement 100 and a side thereof opposed to the side having the dial 104 is referred to as "surface side" of the movement 100. A train wheel assembled to "surface side" of movement 100 is referred to as "surface train wheel" and a train wheel assembled to "back side" of the movement 100 is referred to as "back train wheel". An outer peripheral portion of a surface of the dial 104 is normally provided with numerals from 1 to 12, or abbreviated characters in correspondence therewith. Therefore, respective directions along an outer peripheral portion of the timepiece can be represented by using the numerals.

The movement 100 includes the base unit 101 (refer to FIG. 5, FIG. 6) including the surface train wheel, the back train wheel, the switching apparatus, the hand setting apparatus, the automatic apparatus and/or the hand winding-apparatus and the like and the chronograph unit 300 (refer to FIG. 1 through FIG. 4) including the chronograph mechanism, the calendar mechanism and the like. The base unit 101 includes the main plate 102 and one piece or more of bridges. The chronograph unit 300 includes a chronograph main plate 302 and the chronograph bridge 312.

For example, in the case of a wrist watch, an upper direction and an upper side of the wrist watch are respectively referred to as "12 o'clock direction" and "12 o'clock side", a right direction and a right side of the wrist watch are respectively referred to as "3 o'clock direction", "3 o'clock side", a lower direction and a lower side of the wrist watch are respectively referred to as "6 o'clock direction" and "6 o'clock side" and a left direction and a left side of the wrist watch are respectively referred to as "9 o'clock direction" and "9 o'clock side". Similarly, an upper direction and an upper side of the movement 100 is respectively referred to as "12 o'clock direction" and "12 o'clock side", a right direction and a right side of the movement 100 are respectively referred to as "3 o'clock direction" and "3 o'clock side", a lower direction and a lower side of the movement 100 are respectively referred to as "6 o'clock direction" and "6 o'clock side" and a left direction and a left side of the movement 100 are respectively referred to as "9 o'clock direction" "9 o'clock side".

In the movement 100, a position thereof in correspondence with 12 o'clock graduation of the dial 104 is referred to as "12 o'clock position", a position thereof in correspondence with 1 o'clock graduation of the dial 104 is referred to as "1 o'clock position", a position thereof in correspondence with 3 o'clock graduation of the dial 104 is referred to as "3 o'clock position", "4 o'clock position" to "10 o'clock position" are similarly defined, finally, a position thereof in correspondence with 11 o'clock graduation of the dial 104 is referred to as "11 o'clock position".

In the movement 100, a direction directed from a center 402 of the movement 100 to "12 o'clock position" is referred to as "12 o'clock direction", a direction directed from the center 402 of the movement 100 to "1 o'clock position" is referred to as "1 o'clock direction", a direction directed from the center 402 of the movement 100 to "2 o'clock position" is referred to as "2 o'clock direction", a direction directed from the center 402 of the movement 100 to "3 o'clock position" is referred to as "3 o'clock direction", "4 o'clock direction" to "10 o'clock direction" are similarly defined, finally, a direction directed from the center 402 of the movement 100 to "11 o'clock position" is referred to as "11 o'clock direction".

Figure 6:
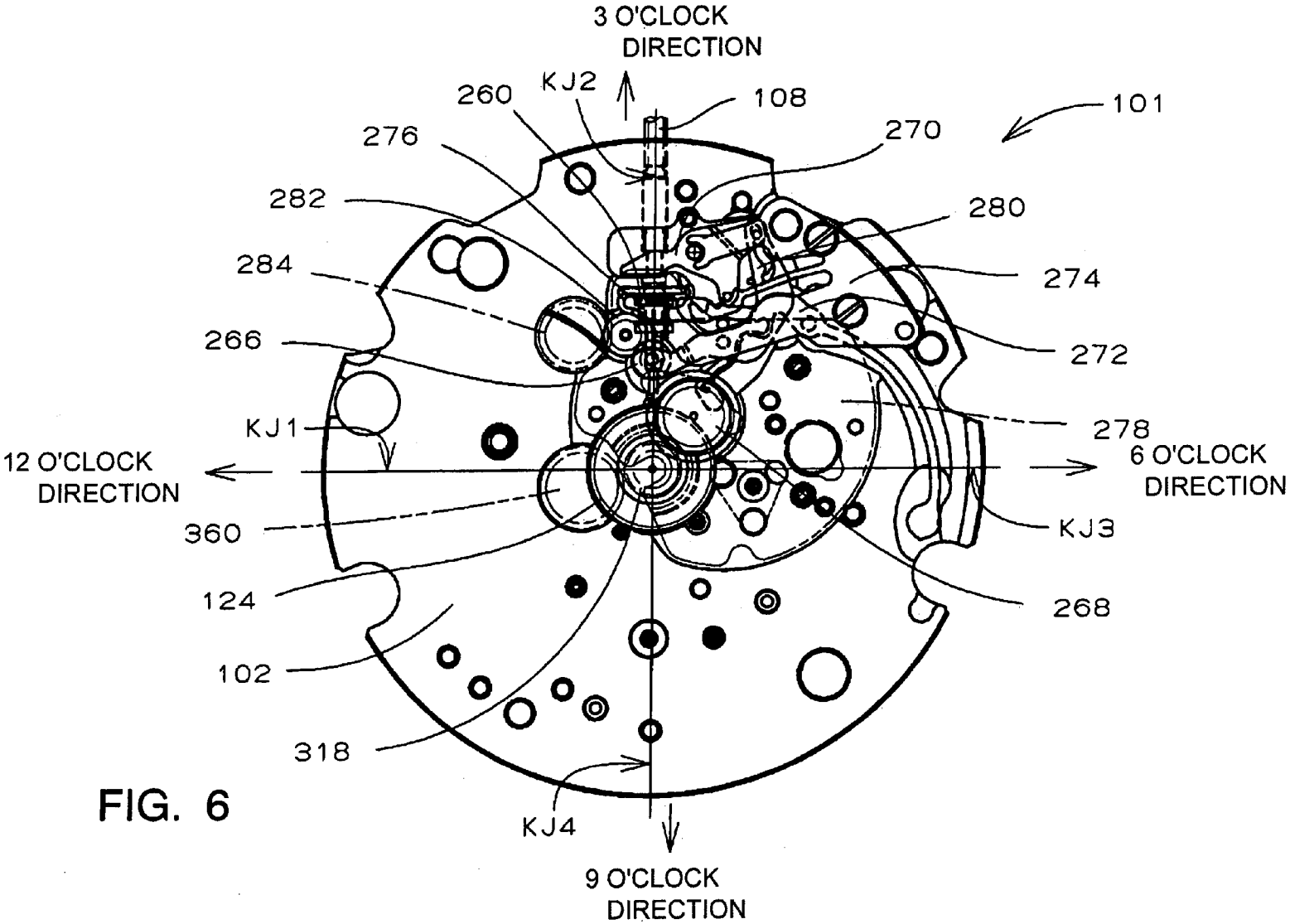
FIG. 6 is a plane view showing a state of viewing the base unit from the dial side according to the embodiment of the chronograph timepiece of the invention.
Figure 7:
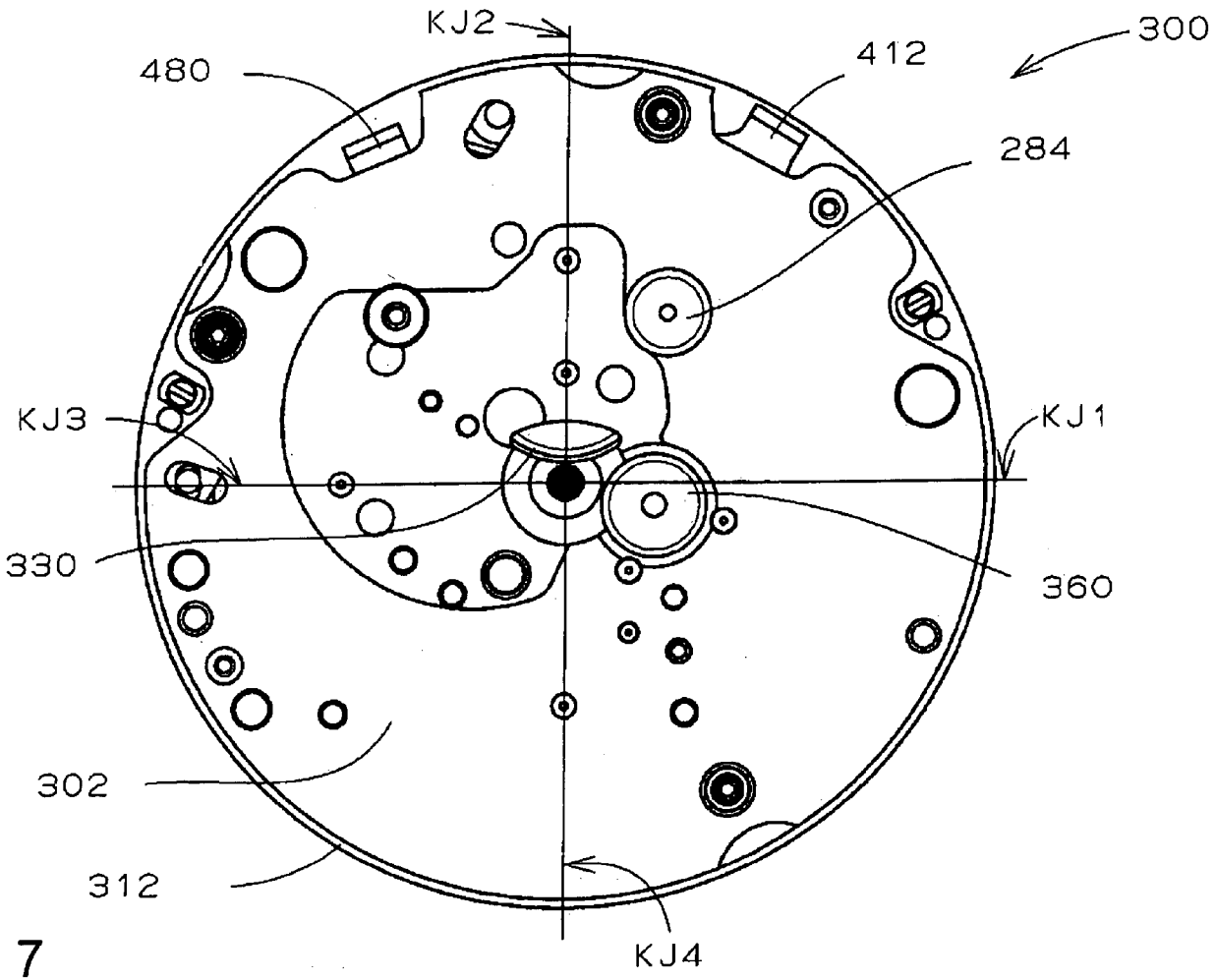
FIG. 7 is a plane view showing a state of viewing a chronograph unit from the side opposed to the dial according to the embodiment of the chronograph timepiece of the invention.

For example, in FIG. 6, "12 o'clock direction", "3 o'clock direction", "6 o'clock direction" and "9 o'clock direction" of the movement 100 are shown.

Figure 15:
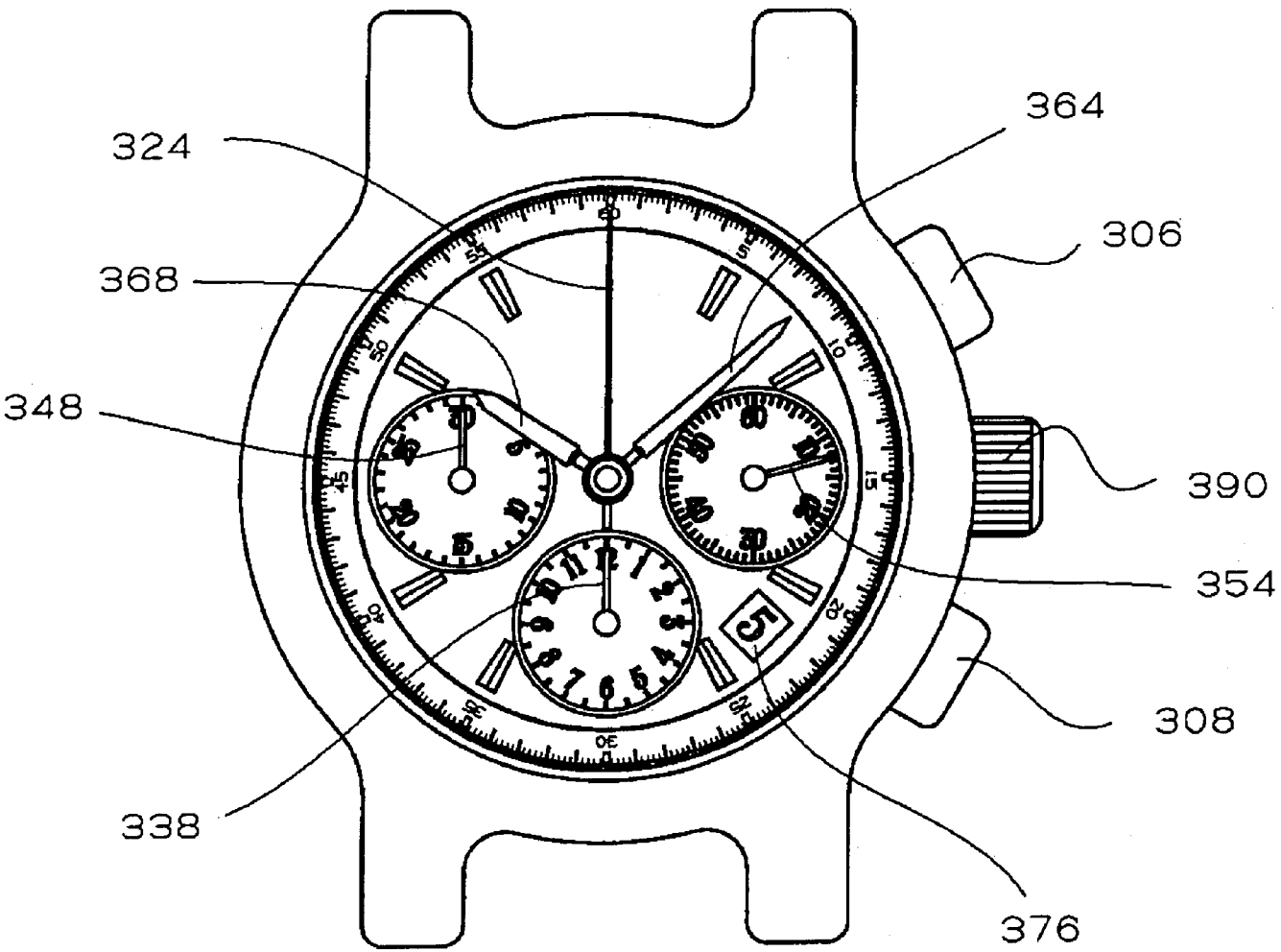
FIG. 15 is an outline plane view showing an outlook of a complete of a chronograph timepiece in a state of stopping a chronograph mechanism according to the embodiment of the chronograph timepiece of the invention.

In reference to FIG. 5 through FIG. 8, in the movement 100 (base unit 101, chronograph unit 300), at the center 402 of the movement 100, a rotational center of an hour hand 368, a rotational center of a minute hand 364 and a rotational center of a chronograph second hand 324 are disposed (refer to FIG. 15). In the movement 100 (base unit 101, chronograph unit 300), a fan shape region having an opening angle of 90 degrees disposed between a 12 o'clock direction reference line KJ1 directed from the center 402 of the movement 100 (base unit 101, chronograph unit 300) in "12 o'clock direction" and a 3 o'clock direction reference line KJ2 drived from the center 402 of the movement 100 (base unit 101, chronograph unit 300) to "3 o'clock direction" is referred to as "12 o'clock, 3 o'clock region", a fan shape region having an opening angle of 90 degrees disposed between the 3 o'clock direction reference line KJ2 and a 6 o'clock direction reference line KJ3 directed from the center 402 of the movement 100 (base unit 101, chronograph unit 300) to "6 o'clock direction" is referred to as "3 o'clock 6 o'clock region", a fan shape region having an opening angle of 90 degrees disposed between the 6 o'clock direction reference line KJ3 and a 9 o'clock direction reference line KJ4 directed from the center 402 of the movement 100 (base unit 101, chronograph unit 300) to "9 o'clock direction" is referred to as "6 o'clock 9 o'clock region" and a fan shape region having an opening angle of 90 degrees disposed between the 9 o'clock direction reference line KJ4 and the 12 o'clock direction reference line KJ1 is referred to as "9 o'clock 12 o'clock region". Therefore, in the movement 100 (base unit 101, chronograph unit 300), four pieces of regions of "12 o'clock 3 o'clock region", "3 o'clock 6 o'clock region", "6 o'clock 9 o'clock region" and "9 o'clock 12 o'clock region" are defined. A center axis line of a winding stem 108 is arranged on the 3 o'clock direction reference line KJ2 of the movement 100 (base unit 101).

(2) A Constitution of a Base Unit

Figure 5:
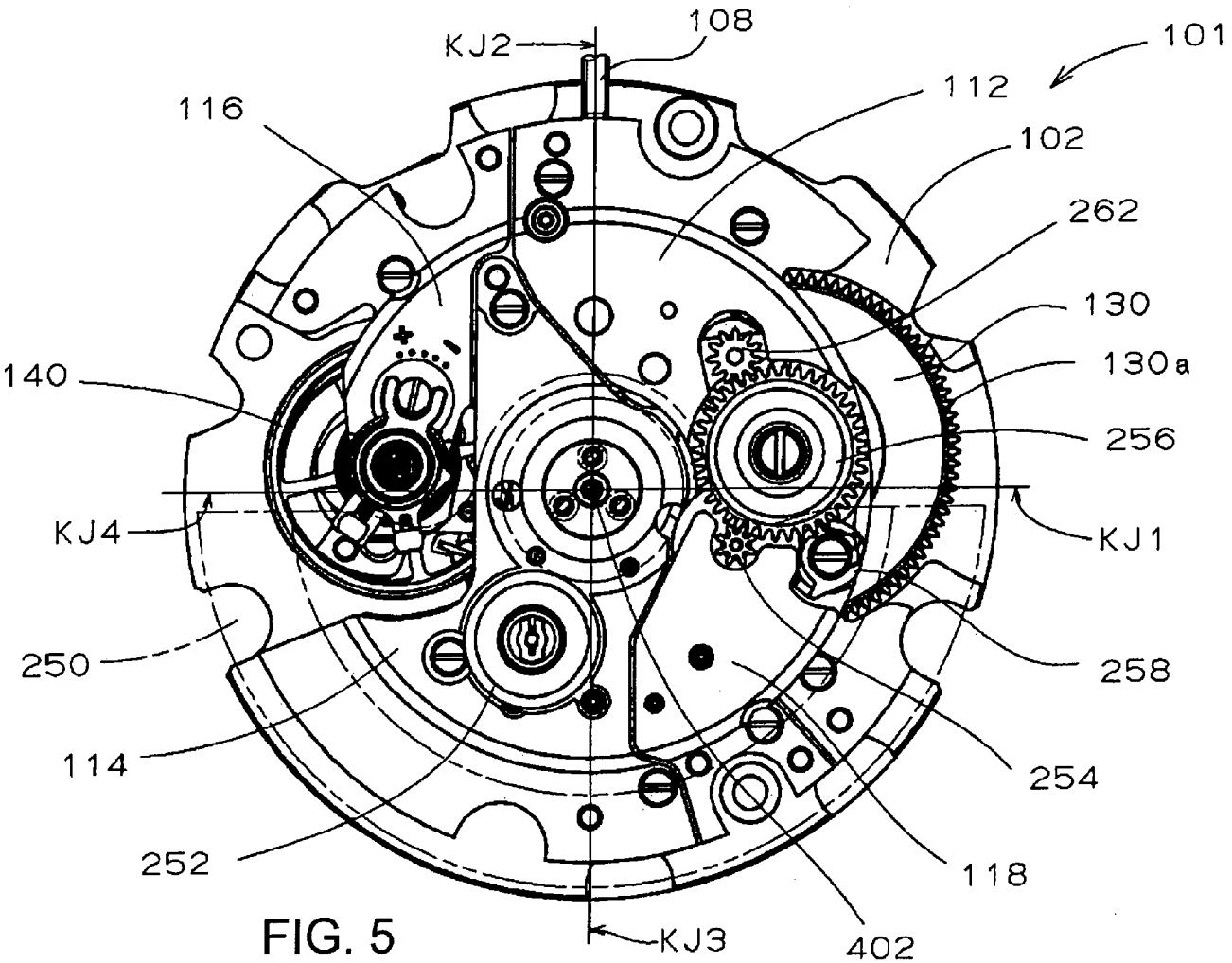
FIG. 5 is a plane view showing a state of viewing base unit from a side opposed to a dial according to the embodiment of the chronograph timepiece of the invention.

In reference to FIG. 5 and FIG. 6, the base unit 101 includes the main plate 102 constituting a base plate of the movement 100, the surface train wheel, the back train wheel, a barrel bridge 112, a train wheel bridge 114, a balance bridge 116, an automatic wiring train wheel bridge 118, an escapement/speed control apparatus, the automatic winding apparatus, the hand winding apparatus, the switching apparatus, a minute wheel bridge 278 and the like.

The winding stem 108 is rotatably integrated to a winding stem guide hole of the main plate 102. The dial 104 (shown in FIG. 10 through FIG. 14 by imaginary lines) is attached to the movement 100. The escapement/speed control apparatus including a balance with hairspring 140, an escape wheel & pinion (not illustrated), a pallet fork (not illustrated) and the surface train wheel including a second wheel & pinion 138 (refer to FIG. 10), a third wheel & pinion 136 (refer to FIG. 10), a center wheel & pinion (not illustrated) and a barrel complete 130 are arranged on "surface side" of the base unit 101. Further, the barrel complete bridge 112 rotatably supporting an upper shaft of the barrel complete 130 and an upper shaft portion the center wheel & pinion, the train wheel bridge 114 rotatably supporting an upper shaft portion of the third wheel & pinion 136, an upper shaft portion of the second wheel & pinion 138 and an upper shaft portion of the escape wheel & pinion, a pallet fork bridge (not illustrated) rotatably supporting an upper shaft portion of the pallet fork and the balance bridge 116 rotatably supporting the upper shaft of the balance with hairspring 140 are arranged on "surface side" of the base unit 101.

A position of the winding stem 108 in the axis line direction is determined by the switching apparatus including a setting lever, a yoke, a yoke spring, a yoke holder and the like. When the winding stem 108 is rotated in the state of being disposed at a first winding stem position (0 stage) most proximate to an inner side of the movement 100 along the rotational axis line direction, a winding pinion 260 is rotated via rotation of a clutch wheel 276. A crown wheel (not illustrated) is constituted to rotate by rotation of the winding pinion. A crown transmission wheel (not illustrated) is constituted to rotate by rotation of the crown wheel. A pivoting crown wheel 262 is constituted to rotate by rotation of the crown transmission wheel. A ratchet wheel 256 is rotated by rotation of the pivoting crown wheel 262. The barrel complete 130 includes a barrel wheel 130*a*, a barrel stem (not illustrated) and a mainspring (not illustrated). By rotating the ratchet wheel 256, the mainspring contained in the barrel complete 130 is constituted to wind up.

The center wheel & pinion is constituted to rotate by rotation of the barrel complete 130. The center wheel & pinion includes a center wheel (not illustrated) and a center pinion (not illustrated). A barrel complete wheel 130*a* is constituted to be brought in mesh with the center pinion. The third wheel & pinion 136 is constituted to rotate by rotation of the center wheel & pinion. The third wheel & pinion 136 includes a third wheel (not illustrated) and a third pinion (not illustrated) The second wheel & pinion 138 is constituted to rotate by rotation of the third wheel & pinion 136. The second wheel & pinion 138 includes a second wheel (not illustrated) and a second pinion (not illustrated). The third wheel is constituted to be brought in mesh with the second pinion. By rotation of the second wheel & pinion 138, the escape wheel & pinion is constituted to rotate while being controlled by the pallet fork. The escape wheel & pinion includes an escape wheel (not illustrated) and an escape pinion (not illustrated). The second wheel & pinion is constituted to be brought in mesh with the escape pinion. The barrel complete 130, the center wheel & pinion, the third wheel & pinion 136 and the second wheel & pinion 138 constitute the surface train wheel.

The escapement/speed control apparatus for controlling rotation of the surface train wheel includes a balance with hairspring 140, the escape wheel & pinion and the pallet fork. The balance with hairspring 140 includes a balance stem, a balance ring and a hairspring. The hairspring is a thin plate spring in a mode of a helical shape (spiral shape) having plural turn numbers. The balance with hairspring 140 is rotatably supported by the main plate 102 and the balance bridge 116.

Figure 10:
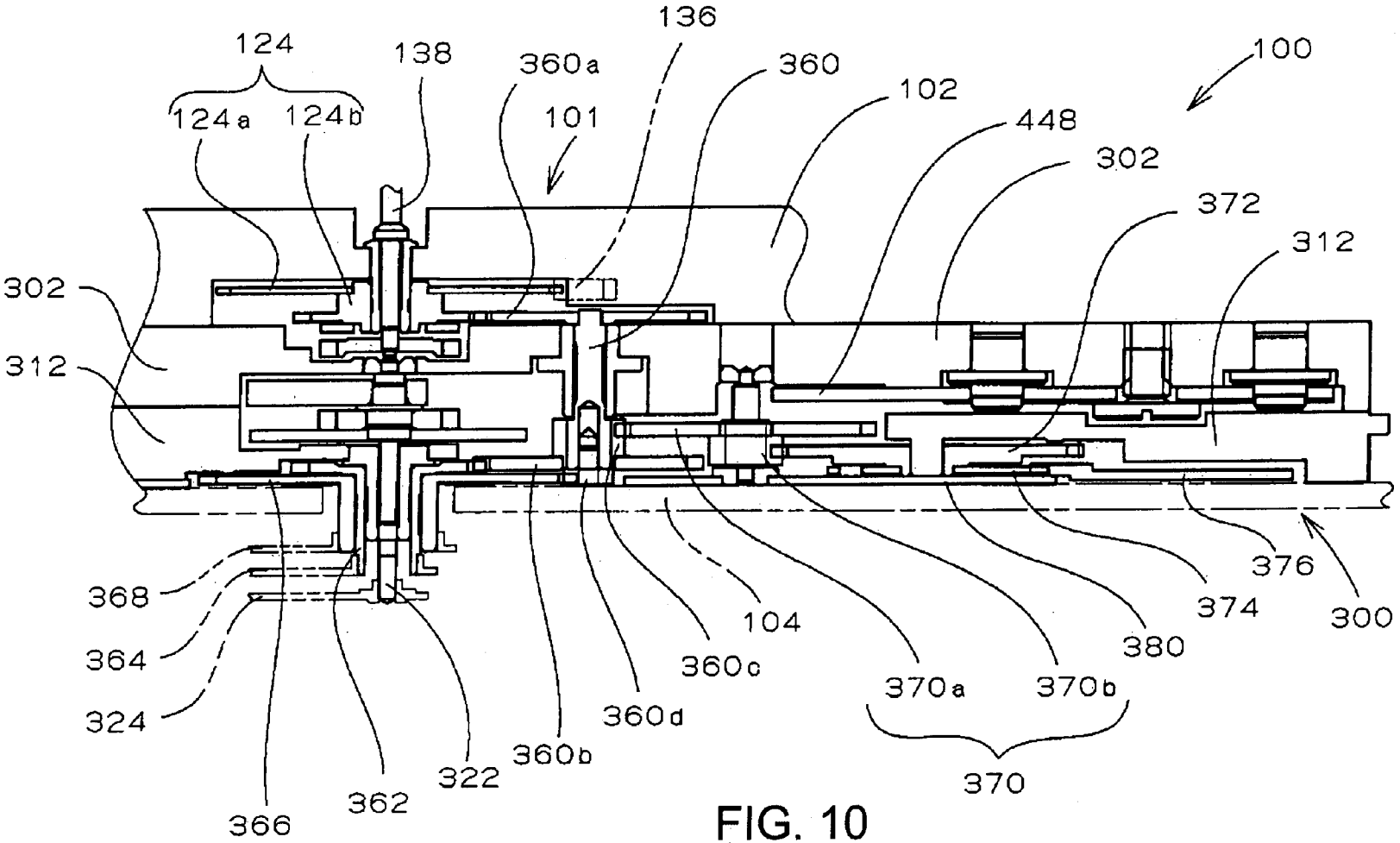
FIG. 10 is a partial sectional view showing a transmission path of a date feeding train wheel according to the embodiment of the chronograph timepiece of the invention.
Figure 11:
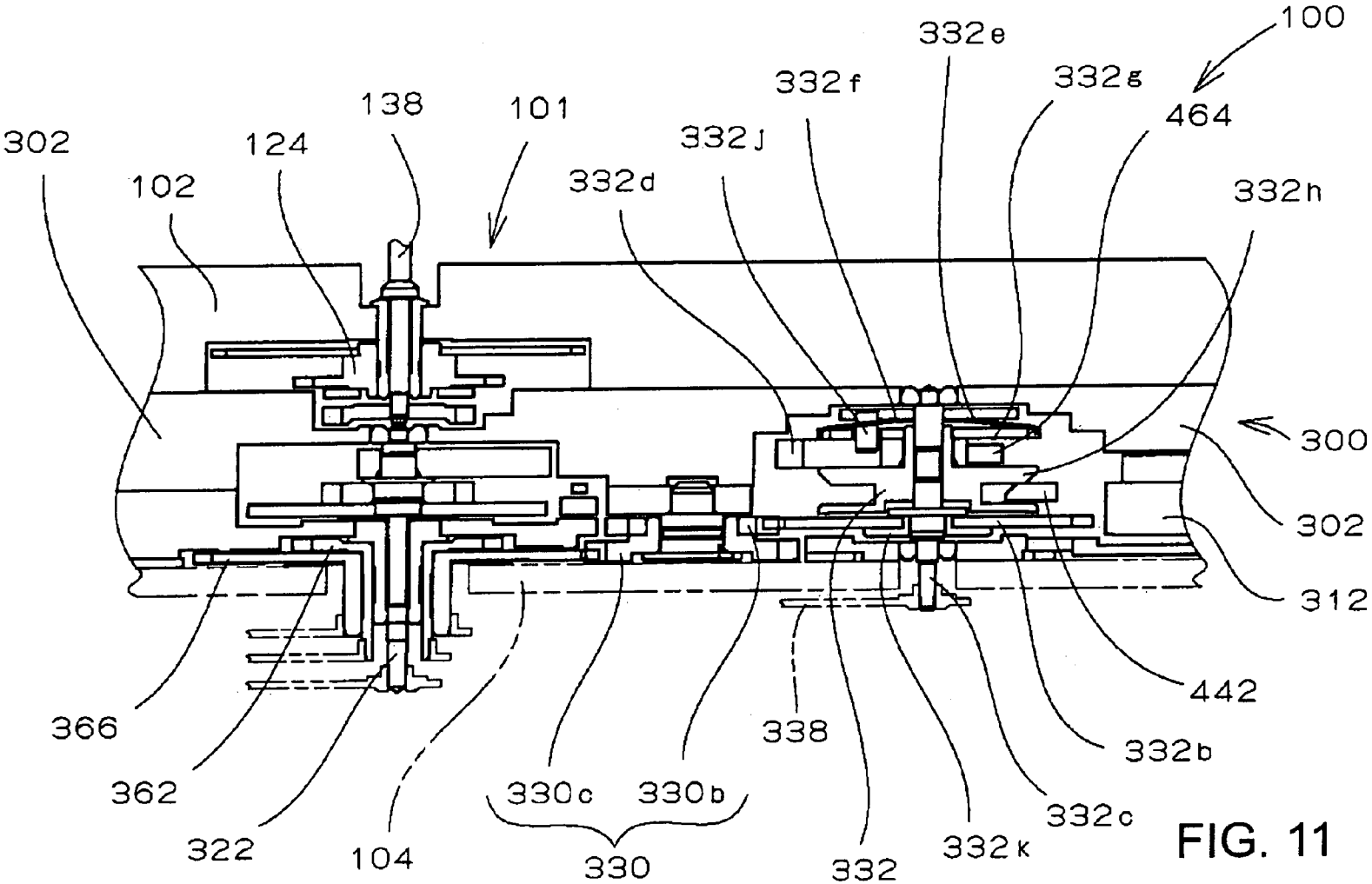
FIG. 11 is a partial sectional view showing a transmission path of an hour chronograph train wheel according to the embodiment of the chronograph timepiece of the invention.
Figure 12:
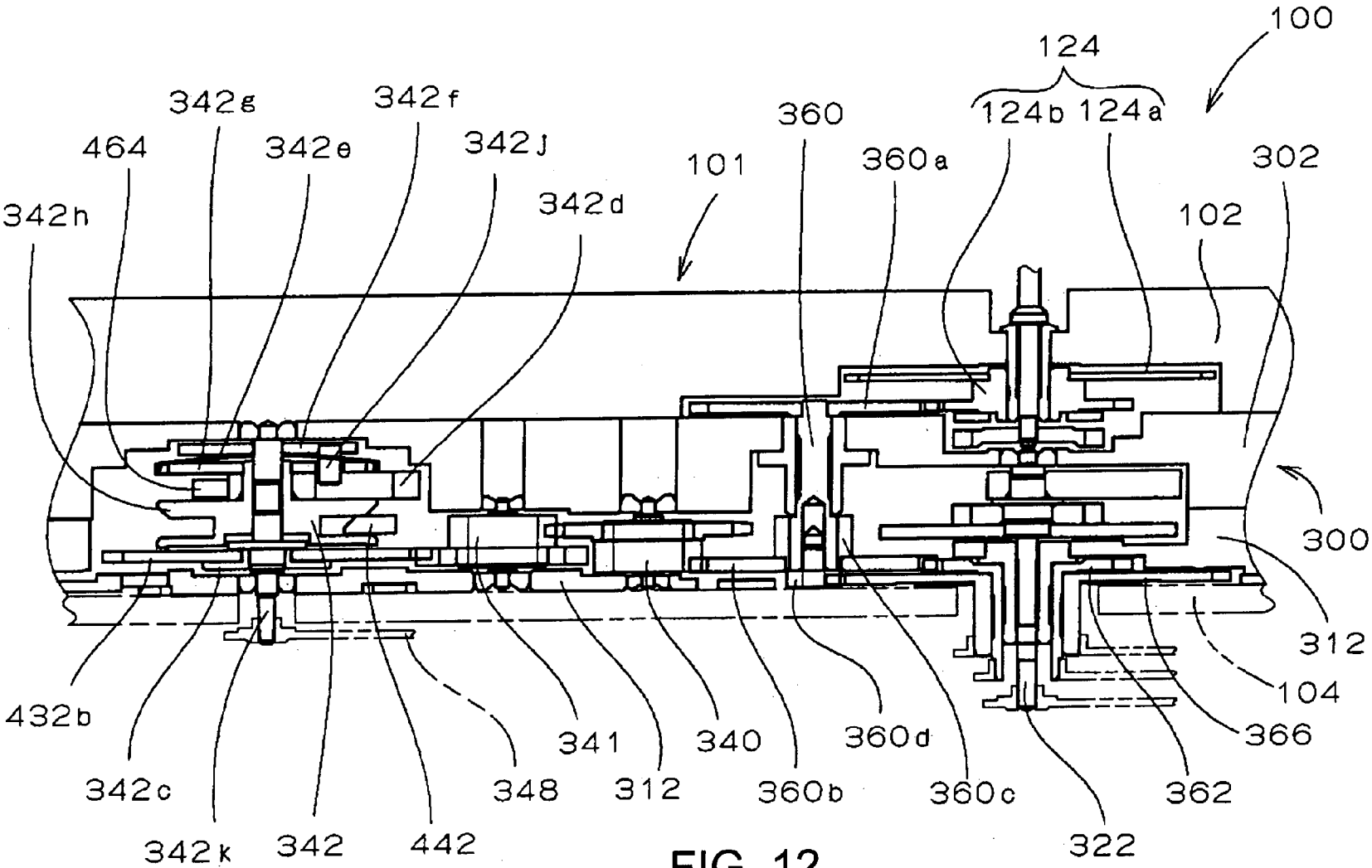
FIG. 12 is a partial sectional view showing a transmission path of a minute chronograph train wheel according to the embodiment of the chronograph timepiece of the invention.

In reference to FIG. 6 and FIG. 10, a minute driving wheel & pinion 124 includes a minute driving wheel 124*a* and a cannon pinion 124*b*. The minute driving wheel 124*a* is constituted to be brought in mesh with the third pinion of the third wheel & pinion 136. The minute driving wheel 124*a* is constituted to rotate integrally with the cannon pinion 124*b*. The cannon pinion 124*b* and the minute driving wheel 124*a* are provided with a slip mechanism constituted such that the cannon pinion 124*b* can be slipped relative to the minute driving wheel 124*a*. A minute holder 278 supports the minute driving wheel & pinion 124 rotatably to the main plate 102.

Figure 13:
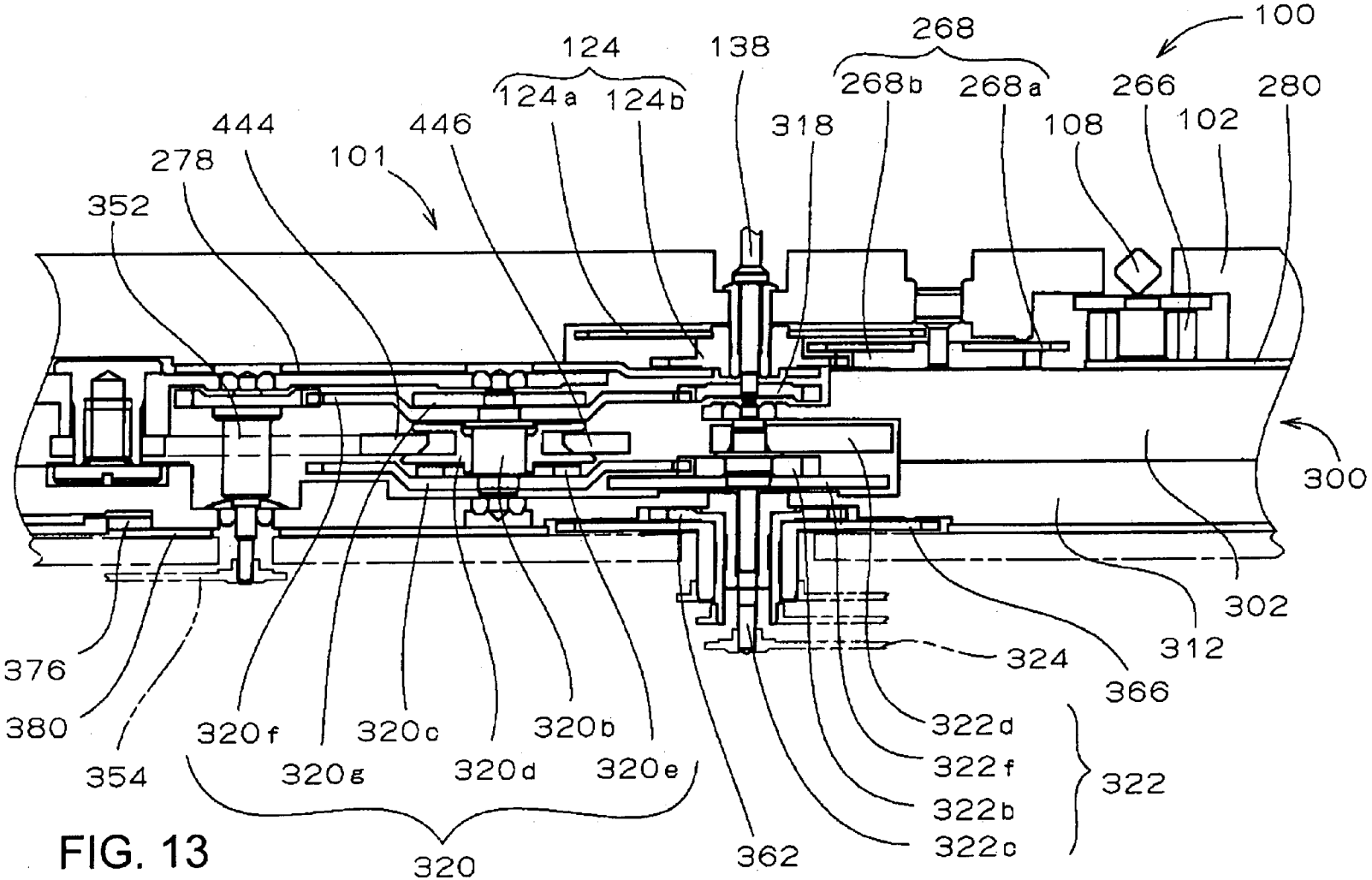
FIG. 13 is a partial sectional view showing a transmission path of a second chronograph train wheel according to the embodiment of the chronograph timepiece of the invention.

In reference to FIG. 6 and FIG. 13, a minute wheel & pinion 268 includes a minute wheel 268*a* and a minute pinion 268*b*. The cannon pinion 124*b* is constituted to be brought in mesh with the minute pinion 268*b*. When the winding stem 108 is pulled out to a state of being disposed at a third winding stem position (2 stage) along the rotational axis line direction, a setting lever 280 is rotated. When the winding stem 108 is rotated under the state, the setting wheel 266 is rotated via rotation of the clutch wheel 276. By rotation of the setting wheel 266, the cannon pinion 124*b* is constituted to rotate via rotation of the minute wheel 268. Therefore, by pulling out the winding stem hands are constituted to be able to set.

In reference to FIG. 5 and FIG. 6, the automatic winding apparatus includes an oscillating weight 250, an intermediate first wheel & pinion 252 rotated based on rotation of the oscillating weight 250, an intermediate first wheel & pinion 252 rotated based on rotation of the oscillating weight 250, an intermediate second wheel & pinion (not illustrated) rotated based on rotation of the intermediate first wheel & pinion 252, a switching reduction wheel & pinion (not illustrated) rotated in one direction based on rotation of the intermediate first wheel & pinion 252 and the intermediate second wheel & pinion, a first reduction wheel (not illustrated) rotated based on rotation of the switching reduction wheel & pinion, a second reduction wheel (not illustrated) rotated based on rotation of the first reduction wheel and a third reduction wheel & pinion 254 rotated based on rotation of the second reduction wheel. A third reduction pinion of the third reduction wheel & pinion 254 is constituted to be brought in mesh with the ratchet wheel 256.

The hand winding apparatus includes the winding wheel 260 rotated by rotation of the winding stem 108, the crown wheel (not illustrated) rotated by rotation of the winding wheel 260, a crown reduction wheel (not illustrated) rotated by rotation of the crown wheel, the pivoting crown wheel 262 rotated by rotation of the crown reduction wheel, the ratchet wheel 256 in one direction based on rotation of the pivoting crown wheel 262 and a click 258 for preventing reverse rotation of the ratchet wheel 256. The position of the winding stem 108 in the axis line direction is determined by the switching apparatus including the setting lever 270, the yoke 272, the yoke holder 274 and the like. When the winding stem 108 is rotated in a state in which the winding stem 108 is disposed at a first winding stem position (0 stage) most proximate to the inner side of the movement 100 along the rotational axis line direction, the winding wheel 260 is rotated via rotation of the clutch wheel 276. By rotation of the winding wheel 260, the crown reduction wheel is rotated via rotation of the crown wheel. By rotation of the crown reduction wheel, the pivoting crown wheel 262 is rotated. The ratchet wheel 256 can wind up the mainspring by being rotated in one direction based on rotation of the pivoting crown wheel 262.

Figure 14:
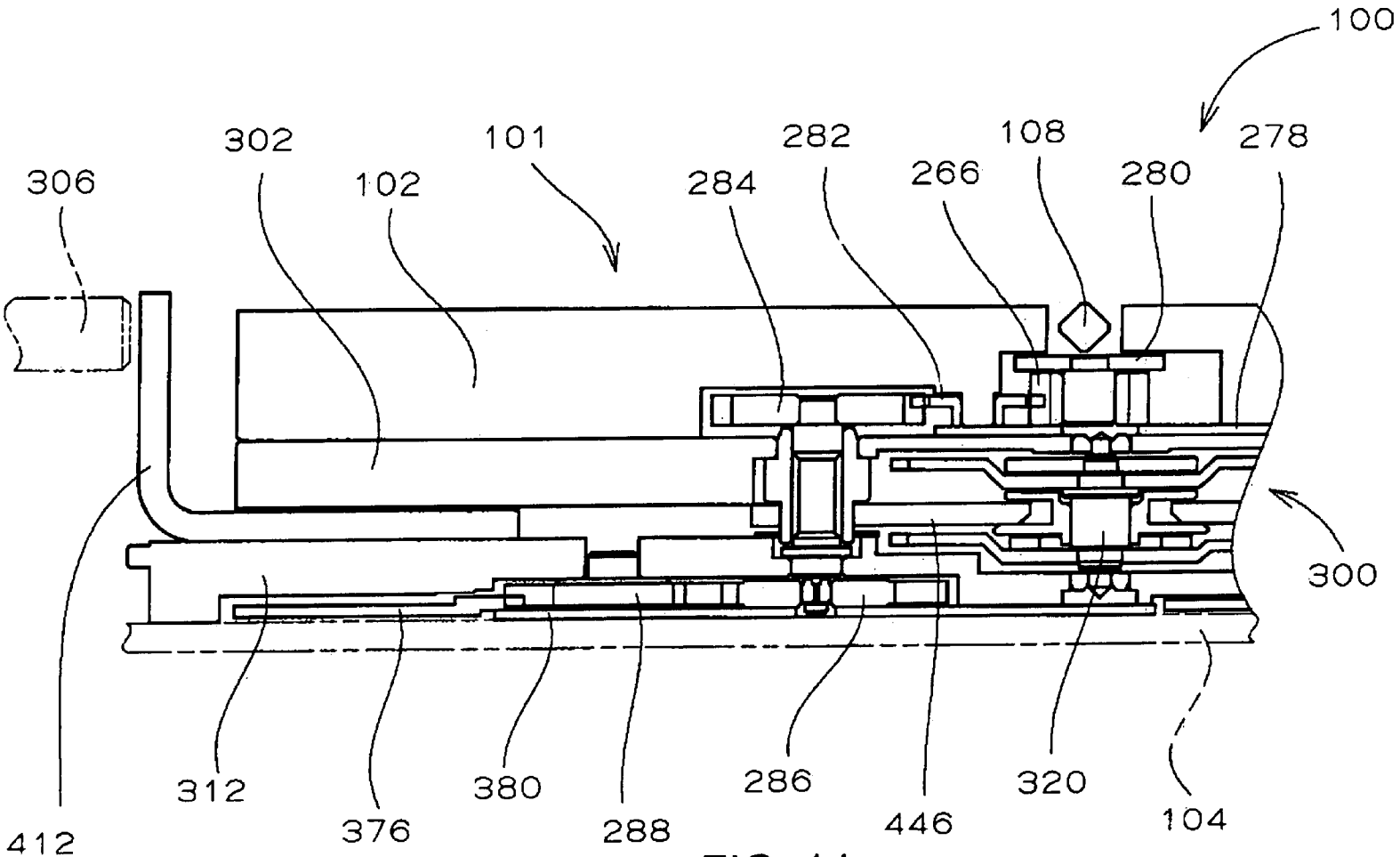
FIG. 14 is a partial sectional view showing a transmission path of a calendar correcting train wheel according to the embodiment of the chronograph timepiece of the invention.

In reference to FIG. 6 and FIG. 14, the back train wheel includes the setting wheel 266 and the minute wheel 268. The calendar correcting apparatus includes a setting lever 280, the date corrector setting transmission wheel A282, a date corrector setting transmission wheel B284, a date corrector setting transmission wheel C286, a date corrector setting wheel 288 and the like. The rotational center of the minute wheel 268 is arranged in the "3 o'clock 6 o'clock region".

(3) A Constitution of an Hour/minute Indicating Mechanism

Figure 8:
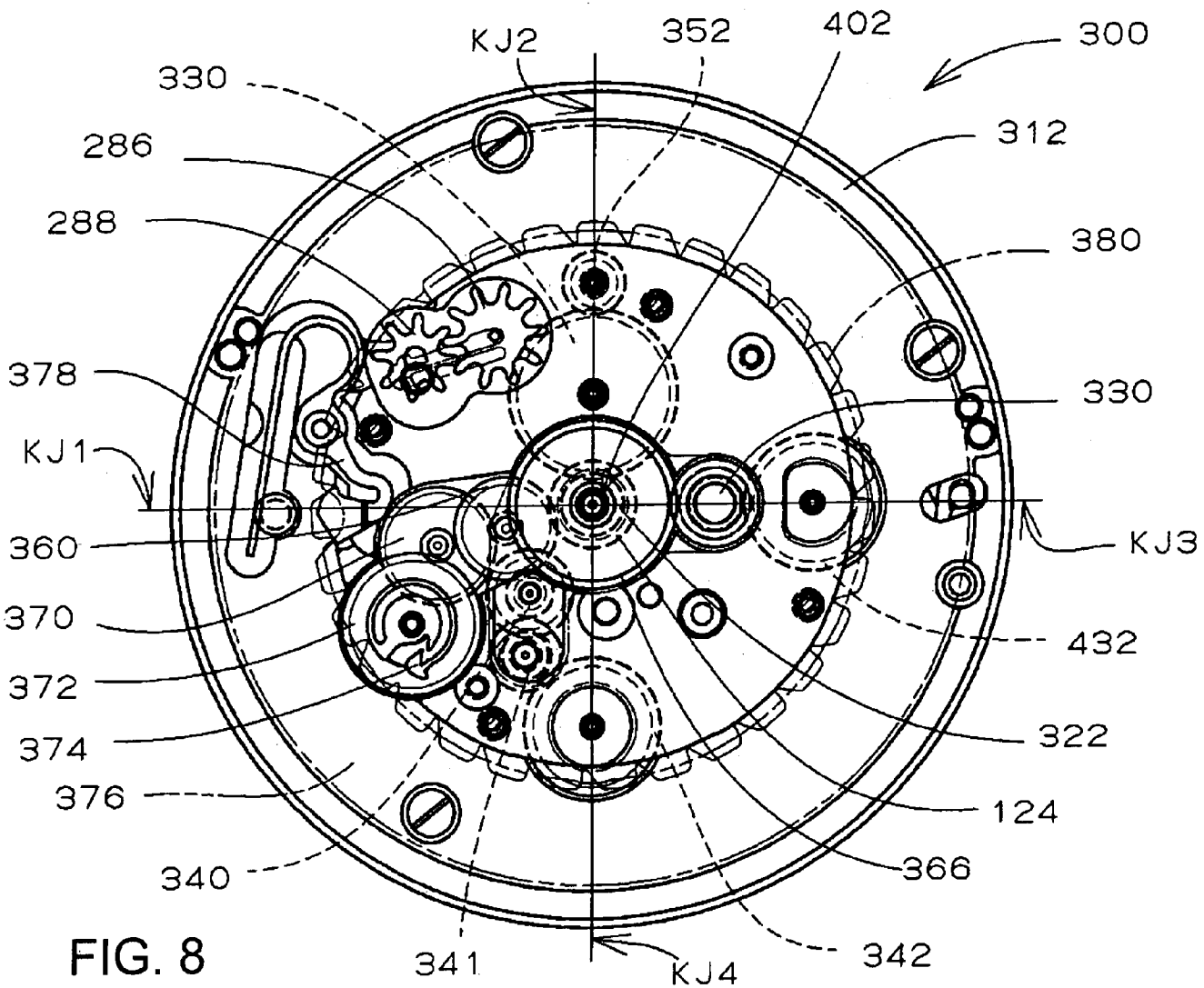
FIG. 8 is a plane view showing a state of viewing the chronograph unit from the dial side according to the embodiment of the chronograph timepiece of the invention.
Figure 9:
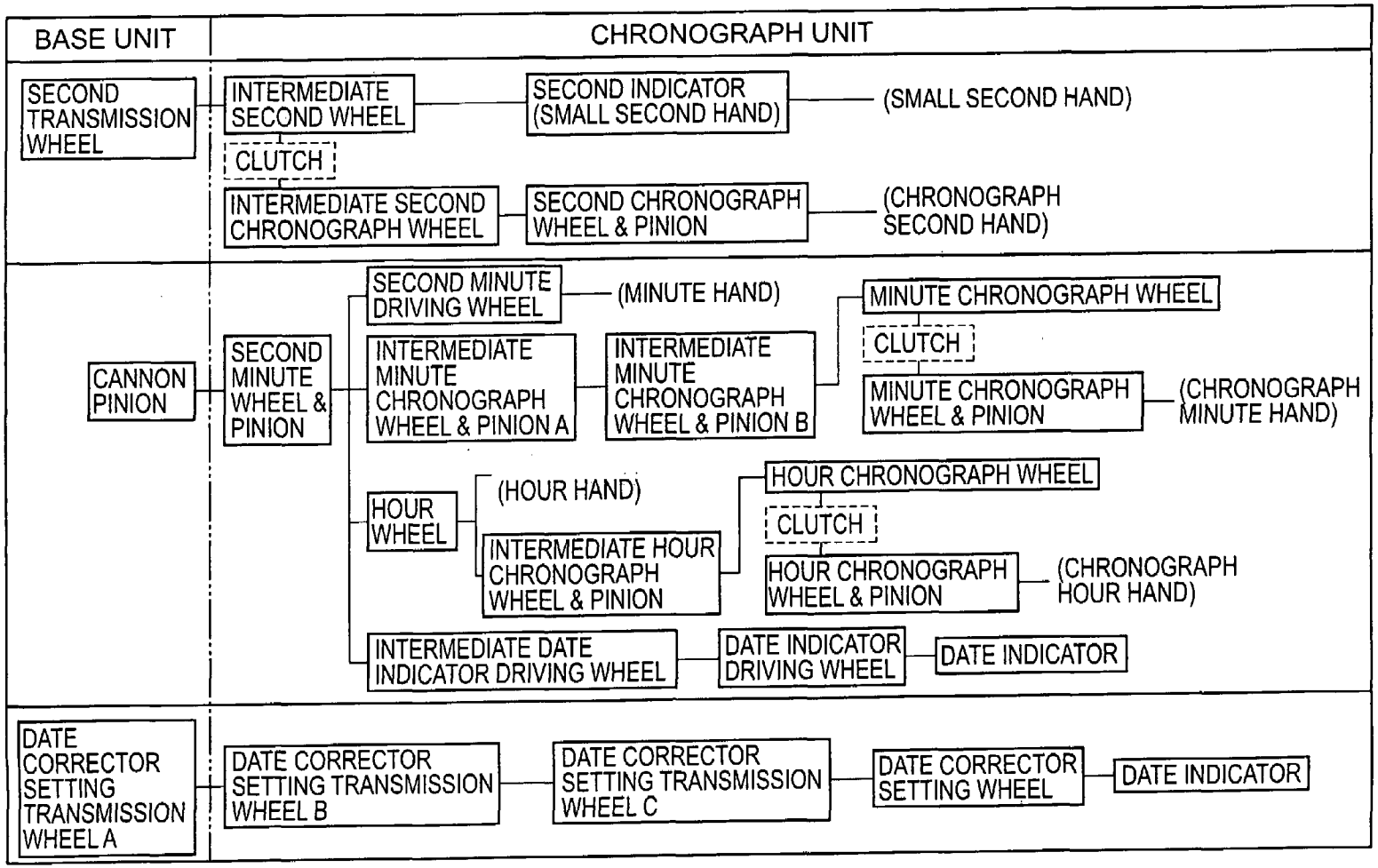
FIG. 9 is an outline block diagram showing a transmission path of the train wheel according to the embodiment of the chronograph timepiece of the invention.

In reference to FIG. 8 through 10, a second minute wheel & pinion 360 is arranged rotatably relative to a chronograph main plate 302. The second minute wheel & pinion 360 includes a second minute wheel A360*a*, a second minute wheel B360*b*, a second minute pinion A360*c* and a second minute pinion B360*d*. The second minute wheel A360*a* is brought in mesh with the cannon pin 124*b*. A rotational center of the second minute wheel 360 is arranged in the "9 o'clock 12 o'clock region". The second minute wheel & pinion 360 is rotated by rotation of the minute driving wheel 124. The second minute driving wheel 362 is rotated by rotation of the second minute wheel B360*b*. The second minute driving wheel 362 is arranged to be rotatable relative to a second minute wheel pipe fixed to the chronograph bridge 312. "Minute" of current time is indicated by the minute hand 364 attached to the second minute driving wheel 362. The hour wheel 366 is rotated by rotation of the second minute pinion B360*d*. "Hour" of current time is indicated by the hour hand 368 attached to the hour wheel 366.

When the winding stem 108 is pulled out to the second stage and the winding stem 108 is rotated, the setting wheel 266 is rotated via rotation of the clutch wheel 276. The cannon pinion 124*b* is rotated by rotation of the setting wheel 266 via rotation of the minute wheel 268. The second minute wheel 360 is rotated by rotation of the cannon pinion 124*b*. The second minute driving wheel 362 and the hour wheel 366 are rotated by rotation of the second minute wheel 360. Therefore, the hands can be set by pulling out the winding stem 108 to the second stage and rotating the winding stem 108.

(4) A Constitution of a Calendar Mechanism

In reference to FIG. 8 through FIG. 10, an intermediate date indicator driving wheel & pinion 370 is rotated by rotation of the second minute wheel 360. The intermediate date indicator driving wheel & pinion 370 includes an intermediate date indicator driving wheel 370*a* and an intermediate date indicator driving pinion 370*b*. The intermediate data indicator driving wheel 370*a* is brought in mesh with the second minute pinion A360*c*. A date indicator driving wheel 372 is rotated by rotation of the intermediate date indicator driving wheel & pinion 370. A date feeding finger 374 is rotated integrally with the date indicator driving wheel & pinion 372. A rotational center of the date indicator driving wheel 372 and the rotational center of the intermediate date indicator driving wheel & pinion 370 are arranged at the "9 o'clock 12 o'clock region". That is, the date feeding mechanism is arranged at the "9 o'clock 12 o'clock region". The date indicator driving wheel 372 is arranged not to overlap the train wheel constituting the chronograph mechanism. The intermediate date indicator driving wheel & pinion 370 is arranged not to overlap the train wheel constituting the chronograph mechanism.

A date indicator 376 having 31 pieces of inner teeth is arranged rotatably to the chronograph bridge 312. A date feeding finger 374 can rotate the date indicator 376 by one tooth per day. A date jumper 378 is provided for restricting a position of the date indicator 376 in the rotational direction. A rotational center of the date jumper 378 is arranged at the "12 o'clock 3 o'clock region". The date jumper 378 is arranged not to overlap the train wheel constituting the chronograph mechanism. It is preferable to arrange the date jumper 378 to overlap the 12 o'clock direction reference line KJ1 of the movement 100 (chronograph unit 300).

A position of the date jumper 378 for restricting the date indicator 376 is arranged in "12 o'clock direction". That is, it is preferable to constitute such that the 12 o'clock direction reference line KJ1 of the movement 100 (chronograph unit 300) is disposed between two teeth of the date indicator 376 restricted by the date jumper 378. By the constitution, there can be realized a thin type chronograph timepiece having a thin type chronograph mechanism capable of firmly restricting two teeth of the date indicator 376.

A date indicator holder 380 is arranged to the chronograph bridge 312 in order to rotatably support the teeth portion of the date indicator 376. Current (date) can be displayed in a date window (not illustrated) of the dial 104 by numerals of "1" through "31" (not illustrated) provided at the date indicator 376.

(5) A Constitution of an Hour Chronograph Train Wheel

In reference to FIG. 1 through FIG. 4, FIG. 8, FIG. 9 and FIG. 11, an intermediate hour chronograph wheel & pinion 330 is arranged rotatably to the chronograph bridge 312. It is preferable that a rotational center of the intermediate hour chronograph wheel & pinion 330 is arranged on the 6 o'clock direction reference line KJ3 of the movement 100. The rotational center of the intermediate hour chronograph wheel & pinion 330 may be arranged to dispose at the "3 o'clock 6 o'clock region" of the movement 100 or arranged to dispose at the "6 o'clock 9 o'clock region" of the movement 100. It is particularly preferable to arrange the intermediate hour chronograph wheel & pinion 330 to overlap the 6 o'clock direction reference line KJ3 of the movement 100. A small-sized thin type chronograph timepiece can be realized by the constitution.

The intermediate hour chronograph wheel & pinion 330 is arranged to rotate by rotation of the hour wheel 366. The intermediate hour chronograph wheel & pinion 330 includes an intermediate hour chronograph wheel 330*b* and an intermediate hour chronograph pinion 330*c*. The intermediate hour chronograph wheel 330*b* is brought in mesh with the hour wheel 366. An hour chronograph wheel & pinion 332 is arranged to be rotatable to the chronograph main plate 302 and the chronograph bridge 312. The hour chronograph wheel & pinion 332 is arranged to rotate by rotation of the intermediate hour chronograph wheel & pinion 330.

The hour chronograph wheel & pinion 332 includes an hour chronograph wheel 332*b*, an hour chronograph wheel shaft 332*c*, an hour heart cam 332*d*, an hour chronograph wheel clutch spring 332*e*, an hour chronograph wheel clutch holding seat 332*f*, an hour chronograph wheel clutch spring receiving seat 332*g*, an hour chronograph wheel clutch ring 332*h*, an hour chronograph wheel clutch holding seat pin 332*j* and an hour chronograph wheel receiving seat 332*k*. The hour chronograph wheel clutch spring holding seat 332*f* and the hour chronograph wheel receiving seat 332*k* are fixed to the hour chronograph wheel shaft 332*c*. The hour chronograph wheel clutch spring holding seat pin 332*j* is fixed to the hour chronograph wheel clutch spring holding seat 332*f*.

The hour heart cam 332*d* and the hour chronograph wheel spring receiving seat 332*g* are fixed to the hour chronograph wheel clutch ring 332*h*. The hour heart cam 332*d*, the hour chronograph wheel spring receiving seat 332*g* and the hour chronograph wheel clutch ring 332*h* are integrated to the hour chronograph wheel shaft 332*c* to be movable in an axis line direction of the hour chronograph wheel shaft 332*c*. By the hour chronograph wheel clutch spring holding seat pin 332*j*, the hour heart cam 332*d*, the hour chronograph wheel spring receiving seat 332*g* and the hour chronograph wheel clutch ring 332*h* are constituted not to rotate relative to the hour chronograph wheel clutch spring holding seat 332*f* and the hour chronograph wheel shaft 332*c*. By the hour chronograph wheel clutch spring 332*e*, the hour chronograph wheel clutch ring 332*h* is constituted to be pressed to the hour chronograph wheel 332*b*. The hour chronograph wheel 332*b* is constituted to be rotatable relative to the hour chronograph wheel receiving seat 332*k* and the hour chronograph wheel shaft 332*c*.

The hour chronograph wheel 332*b* is brought in mesh with the intermediate hour chronograph wheel 330*b*. A rotational center of the hour chronograph wheel & pinion 332 is arranged at a middle position on the 6 o'clock direction reference line KJ3 of the movement 100 (chronograph unit 300). For example, it is preferable that the rotational center of the hour chronograph wheel & pinion 332 is arranged on the 6 o'clock direction reference line KJ3 at a position in a range of 40 through 70% of a radius of the main plate 102.

When an hour/minute coupling lever 442 is operated by operating a start/stop button 306, by the spring force of the hour chronograph wheel clutch spring 332*e*, a lower face of the hour chronograph wheel clutch ring 332*h* is brought into contact with the upper face of the hour chronograph wheel 332*b*. Therefore, under the state, the hour chronograph wheel shaft 332*c* is rotated in cooperation with the hour chronograph wheel 332*b*. Therefore, under the state, the hour chronograph wheel shaft 332*c* is rotated by rotation of the intermediate hour chronograph wheel & pinion 330. That is, the hour chronograph wheel clutch ring 332*h* and the hour chronograph wheel clutch spring 332*e* constitute a "clutch". In chronograph measuring operation, by a chronograph hour hand 338 attached to the hour chronograph wheel shaft 332*c*, a result of measuring an elapse time period of "hour" such as elapse of one hour is indicated. After stopping to measure chronograph, when a hammer 464 is operated by operating a reset button 308, the hammer 464 rotates the hour heart cam 332*d* and the chronograph hour hand 338 can be zeroed.

(6) A Constitution of a Minute Chronograph Train Wheel

In reference to FIG. 1 through FIG. 4, FIG. 8, FIG. 9 and FIG. 12, an intermediate minute chronograph wheel & pinion A340 is arranged to be rotatable to the chronograph main plate 302 and the chronograph bridge 312. The intermediate minute chronograph wheel & pinion A340 is arranged to rotate by rotation of the second minute wheel & pinion 360. A pinion portion of the intermediate minute chronograph wheel & pinion A340 is brought in mesh with the second minute wheel B360*b*. An intermediate minute chronograph wheel & pinion B341 is arranged to be rotatable to the chronograph main plate 302 and the chronograph bridge 312. The intermediate minute chronograph wheel & pinion B341 is arranged to rotate by rotation of the intermediate minute chronograph wheel & pinion A340. A pinion portion of the intermediate minute chronograph wheel & pinion B341 is brought in mesh with a wheel portion of the intermediate minute chronograph wheel & pinion A340. A minute chronograph wheel & pinion 342 is arranged to be rotatable to the chronograph main plate 302 and the chronograph bridge 312. The minute chronograph wheel & pinion 342 is arranged to rotate by rotation of the intermediate minute chronograph wheel & pinion B341.

The minute chronograph wheel & pinion 342 includes a minute chronograph wheel 342*b*, a minute chronograph wheel shaft 342*c*, a minute heart cam 342*d*, a minute chronograph wheel clutch spring 342*e*, a minute chronograph wheel clutch spring holding seat 342*f*, a minute chronograph wheel clutch spring receiving seat 342*g*, a minute chronograph clutch ring 342*h*, a minute chronograph wheel clutch spring holding seat pin 342*j* and a minute chronograph wheel receiving seat 342*k*. The minute chronograph wheel clutch spring holding seat 342*f* and the minute chronograph wheel receiving seat 342*k* are fixed to the minute chronograph wheel shaft 342*c*. The minute chronograph clutch spring holding seat pin 342*j* is fixed to the minute chronograph wheel clutch spring holding seat 342*f*.

The heart cam 342*d* and the minute chronograph wheel spring receiving seat 342*g* are fixed to the minute chronograph wheel clutch ring 342*h*. The minute heart cam 342*d*, the minute chronograph wheel spring receiving seat 342*g* and the minute chronograph wheel clutch ring 342*h* are integrated to the minute chronograph wheel shaft 342*c* to be movable in an axis line direction of the minute chronograph wheel shaft 342*c*. By the minute chronograph wheel clutch spring holding seat pin 342*j*, the minute heart cam 342*d*, the minute chronograph wheel spring receiving seat 342*g* and the minute chronograph clutch ring 342*h* are constituted not to rotate relative to the minute chronograph wheel clutch spring holding seat 342*f* and the minute chronograph wheel shaft 342*c*. By the minute chronograph wheel clutch spring 342*e*, the minute chronograph wheel clutch ring 342*h* is constituted to be pressed to the minute chronograph wheel 342*b*. The minute chronograph wheel 342*b* is constituted to be rotatable relative to the minute chronograph wheel receiving seat 342*k* and the minute chronograph wheel shaft 342*c*. The minute chronograph wheel 342*b* is brought in mesh with a wheel portion of the intermediate minute chronograph wheel & pinion B341.

A rotational center of the minute chronograph wheel & pinion 342 is arranged at a middle position on the 9 o'clock direction reference line KJ4 of the movement 100 (chronograph unit 300). For example, it is preferable that the rotational center of the minute chronograph wheel & pinion 342 is arranged on the 9 o'clock direction reference line KJ4 at a position in a range of 40 through 70% of the radius of the main plate 102. It is preferable that a distance from the center of the movement 100 (chronograph unit 300) to the rotational center of the minute chronograph wheel & pinion 342 is constituted to be equal to a distance from the center of the movement 100 (chronograph unit 300) to the rotational center of the hour chronograph wheel & pinion 332. By the constitution, there can be realized a chronograph timepiece capable of displaying hour chronograph and displaying minute chronograph which are easy to see.

When an hour/minute coupling lever 442 is operated by operating the start/stop button 306, by spring force of the minute chronograph wheel clutch spring 342*e*, a lower face of the minute chronograph wheel clutch ring 342*h* is brought in contact with an upper face of the minute chronograph wheel 342*b*. Therefore, under the state, the minute chronograph wheel shaft 342*c* is rotated in cooperation with the minute chronograph wheel 342*b*. Under the state, by rotation of the second minute wheel & pinion 360, the minute chronograph wheel shaft 332*c* is rotated via rotation of the intermediate minute chronograph wheel & pinion A340 and the intermediate minute chronograph wheel & pinion B341. That is, the minute chronograph clutch ring 340*h* and the minute chronograph wheel clutch spring 342*e* constitute a "clutch". In the chronograph measuring operation, by the chronograph minute hand 348 attached to the minute chronograph wheel shaft 342*c*, a result of measuring an elapse time period of "minute" such as elapse of one minute is displayed. After stopping to measure chronograph, when the hammer 464 is operated by operating the reset button 308, the hammer 464 rotates the minute heart cam 342*d* and the chronograph minute hand 348 can be zeroed.

A rotational center of the second minute wheel & pinion 360, a rotational center of the intermediate minute chronograph wheel & pinion A340 and a rotational center of the intermediate minute chronograph wheel & pinion B341 are arranged at the "9 o'clock 12 o'clock region". The intermediate minute chronograph wheel & pinion A340 and the intermediate minute chronograph wheel & pinion B341 are arranged not to overlap a train wheel constituting a date feeding mechanism. The intermediate minute chronograph wheel & pinion A340 and the intermediate minute chronograph wheel & pinion B341 are arranged not to overlap a part constituting a date correcting mechanism. By the constitution, a small-sized thin type chronograph timepiece can be realized.

(7) Constitutions of a Second Indicating Mechanism and a Second Chronograph Train Wheel In reference to FIG. 1 through FIG. 4, FIG. 8, FIG. 9 and FIG. 13, an intermediate second chronograph wheel & pinion 320 is arranged to be rotatable to the chronograph main plate 302 and the chronograph bridge 312. The intermediate second chronograph wheel & pinion 320 includes an intermediate second chronograph wheel shaft 320*b*, an intermediate second chronograph wheel 320*c*, an intermediate second chronograph clutch ring 320*d*, an intermediate second chronograph clutch spring 320*e*, an intermediate second wheel 320*f* and an intermediate second wheel holding seat 320*g*.

The intermediate second chronograph wheel 320*c* is fixed to the intermediate second chronograph wheel shaft 320*b*. The intermediate second wheel holding seat 320*g* is fixed to the intermediate second chronograph wheel shaft 320*b*. The intermediate second wheel 320*f* is rotatably provided to the intermediate second chronograph wheel shaft 320*b*. The intermediate second chronograph clutch ring 320*d* and the intermediate second chronograph clutch spring 320*e* are integrally formed. The intermediate second chronograph clutch ring 320*d* and the intermediate second chronograph clutch spring 320*e* are integrated to the intermediate second chronograph wheel shaft 320*b* to be movable in an axial direction of the intermediate second chronograph wheel shaft 320*b*. By the intermediate second chronograph clutch spring 320*e*, the intermediate second chronograph clutch ring 320*d* is constituted to be pressed to the intermediate second wheel 320*f*.

The second reduction wheel & pinion 318 is fixed to the second wheel & pinion 138. The second reduction wheel & pinion 318 is arranged between a minute holder 278 and the chronograph main plate 302. The intermediate second wheel 320*f* is rotated by rotation of the second reduction wheel & pinion 318. The second indicator 352 is rotated by rotation of the intermediate second wheel 320*f*. By a second hand (small second hand) 354 attached to the second indicator 352, "second" of current time is indicated. That is, the second indicator 352 constitutes a second indicating mechanism. A rotational center of the second indicator 352 is arranged at a middle position on the 3 o'clock direction reference line KJ2 of the movement 100 (chronograph unit 300). For example, it is preferable to arrange the rotational center of the second indicator 352 on the 3 o'clock direction reference line KJ2 at a position disposed in a range of 40 through 70% of the radius of the main plate 102.

It is preferable to arrange the second indicator 352 not to overlap the date feeding mechanism and arrange not to overlap the date correcting mechanism. By the constitution, a small-sized thin type chronograph timepiece can be realized.

It is preferable to constitute a distance from the center 402 of the movement 100 (chronograph unit 300) to the rotational center of the second indicator 352 to be equal to a distance from the center of the movement 100 (chronograph unit 300) to the rotational center of the minute chronograph wheel & pinion 342 and the distance from the center 402 of the movement 100 (chronograph unit 300) to the rotational center of the hour chronograph wheel & pinion 332. By the constitution, there can be realized a chronograph timepiece capable of displaying second, displaying hour chronograph and displaying minute chronograph which are easy to see.

When a coupling lever A444 and a coupling lever B446 are operated by operating the start/stop button 306, by the spring force of the intermediate second chronograph wheel clutch spring 320*e*, the intermediate second chronograph wheel clutch ring 320*d* is pressed to the intermediate second wheel 320*f*. Under the state, the intermediate second chronograph wheel 320*c* and the intermediate second chronograph wheel shaft 320*b* are rotated in cooperation with the intermediate second wheel 320*f*. That is, under the state, the intermediate second chronograph wheel 320*c* is rotated by rotation of the second reduction wheel & pinion 318. The intermediate second chronograph wheel clutch ring 320*d* and the intermediate second chronograph wheel clutch spring 320*e* constitute a "clutch".

The second chronograph wheel & pinion 322 is rotated by rotation of the intermediate second chronograph wheel 320*c*. The second chronograph wheel & pinion 322 includes a second chronograph wheel 322*b*, a second chronograph wheel shaft 322*c*, a second heart cam 322*d* and a stop lever plate 322*f*. The rotational center 402 of the second-chronograph wheel & pinion 322 is the same as the rotational center of the second wheel & pinion 138, the same as the rotational center of the minute driving wheel 124, the same as the rotational center of the second minute driving wheel & pinion 362 and the same as the rotational center of the hour wheel 366. The rotational center of the minute driving wheel 124 and the rotational center of the hour wheel 366 are arranged at the center 402 of the movement 100 (chronograph unit 300).

It is preferable to arrange the rotational center of the intermediate second chronograph wheel & pinion 320 to dispose on the 3 o'clock direction reference line KJ2 of the movement 100. The rotational center of the intermediate second chronograph wheel & pinion 320 may be arranged to dispose in the "12 o'clock 3 o'clock region" of the movement 100 or arranged to dispose in the "3 o'clock 6 o'clock region" of the movement 100. It is particularly preferable to arrange the intermediate second chronograph wheel & pinion 320 to overlap the 3 o'clock direction reference line KJ2 of the movement 100. By the constitution, the small-sized thin type chronograph timepiece can be realized.

In the chronograph measuring operation, by the chronograph second hand 324 attached to the second chronograph wheel shaft 322*c*, a result of measuring an elapse time period of "second" such as elapse of one second is displayed. After stopping to measure chronograph, when the hammer 464 is operated by operating the reset button 308, the hammer 464 rotates the second heart cam 322*d* and the chronograph second hand 324 can be zeroed.

(8) A Constitution of a Calendar Correcting Mechanism

In reference to FIG. 1, FIG. 6 through FIG. 9 and FIG. 14, when the winding stem 108 is pulled to a state of being disposed at the second winding stem position (1 stage) along the rotational axis line direction, the setting lever 280 is rotated. Under the state, when the winding stem 108 is rotated, the setting wheel 266 is rotated via rotation of the clutch wheel 276. The date corrector setting transmission wheel B284 is constituted to rotate by rotation of the setting wheel 266 via rotation of the date corrector setting transmission wheel A282. The date corrector setting transmission wheel C286 is constituted at one end of the date corrector setting transmission wheel B284 to rotate along with the date corrector setting transmission wheel B284. Therefore, the date corrector setting wheel 288 is constituted to rotate by rotation of the date corrector setting transmission wheel B284 via the rotation of the date corrector setting transmission wheel C286. A rotational center of the date corrector setting wheel 288 and a rotational center of the date corrector setting transmission wheel C286 are arranged at the "12 o'clock 3 o'clock region". The date corrector setting wheel 288 is arranged not to overlap the train wheel constituting the chronograph mechanism. That is, the date correction mechanism is arranged at the "12 o'clock 3 o'clock region". The date correcting mechanism is arranged not to overlap the date feeding mechanism. By the constitution, a small size and a thin type chronograph timepiece can be realized.

The date corrector setting wheel 288 is constituted to be able to rotate the date indicator 376 when rotated in one direction. According to the constitution, by pulling out the winding stem 108 to the second winding stem position (1 stage) and rotating the winding stem 108 in one direction, the date indicator 376 can be rotated and date correction can be carried out.

(9) A Chronograph Operating Mechanism

Next, a constitution of a chronograph operating mechanism will be explained.

(9-1) A state of not operating to measure chronograph

Figure 16:
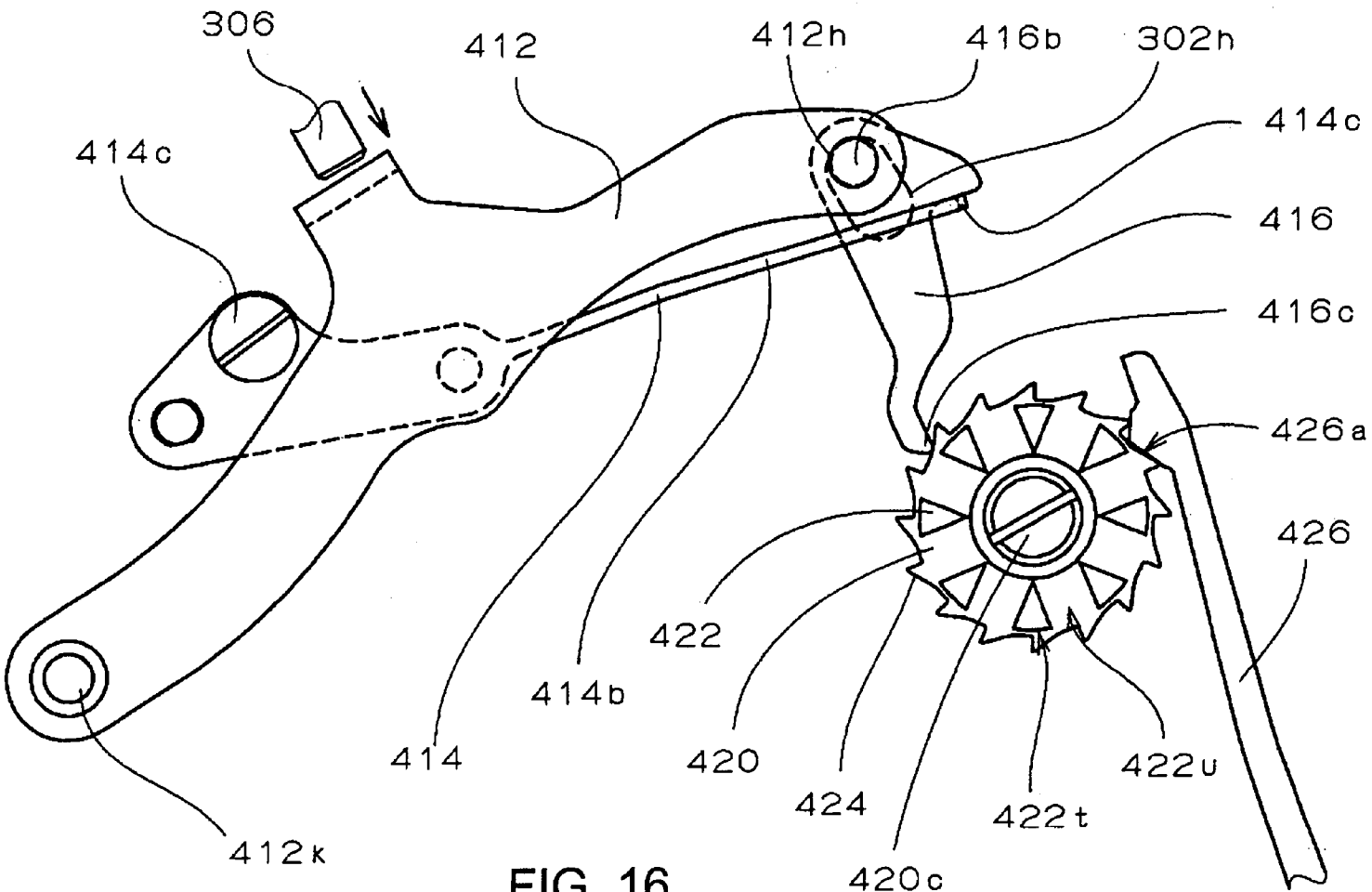
FIG. 16 is a partial plane view of an operating lever and an operating cam in a state of not driving the chronograph mechanism according to the embodiment of the chronograph timepiece of the invention.
Figure 17:
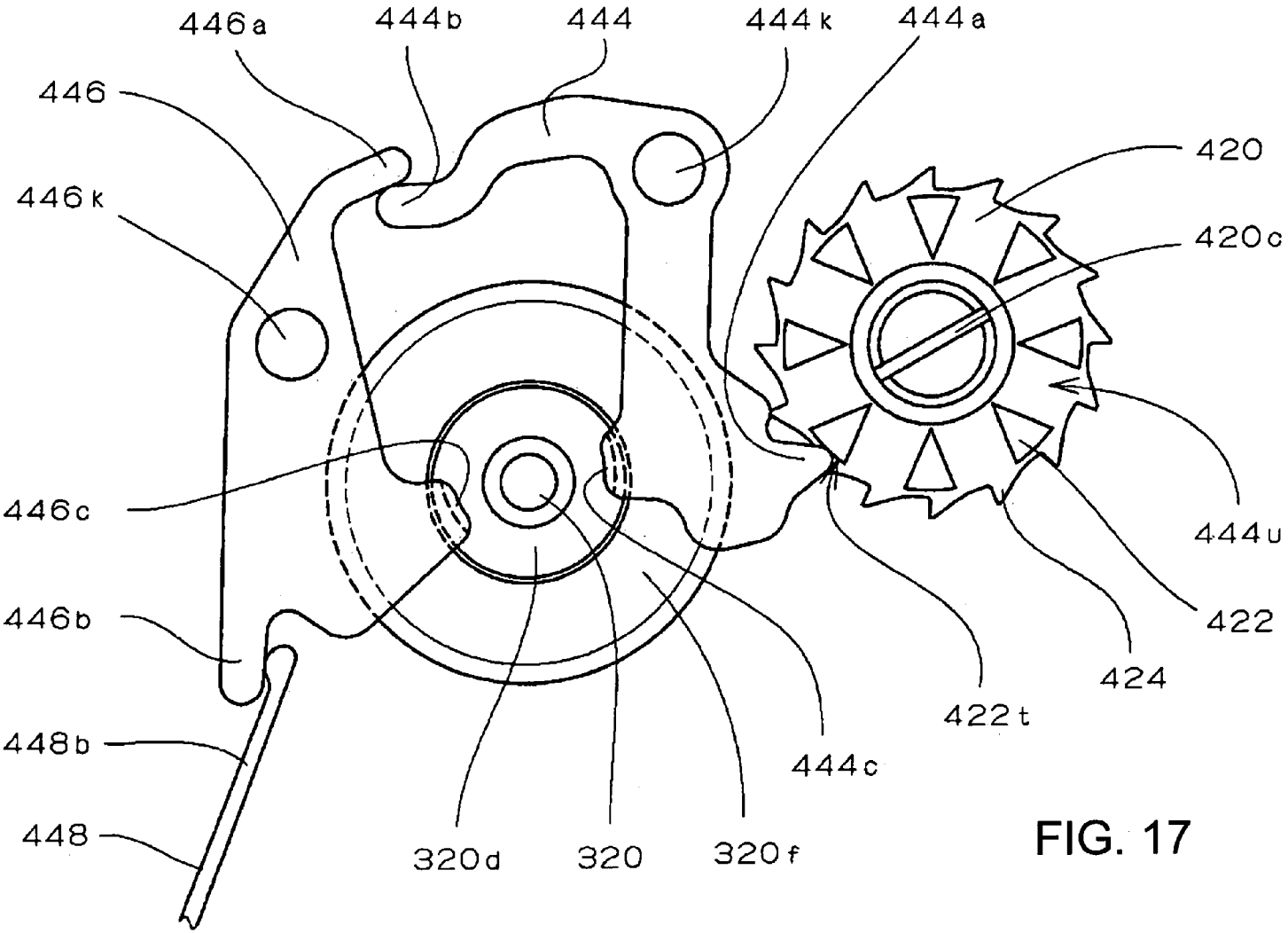
FIG. 17 is a partial plane view showing a coupling lever and the operating cam in a state of making the clutch OFF according to the embodiment of the chronograph timepiece of the invention.
Figure 18:
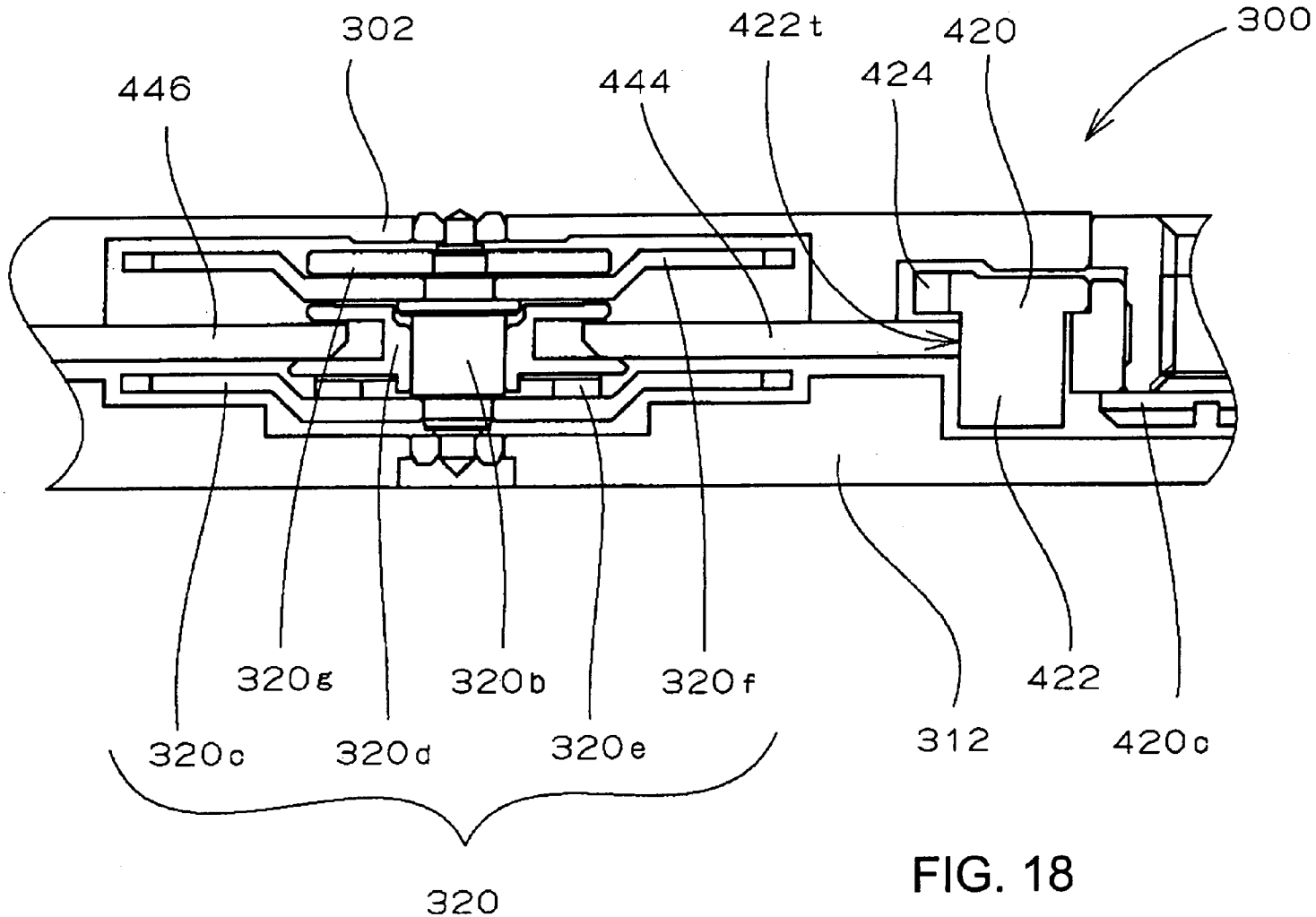
FIG. 18 is a partial sectional view showing-the coupling lever and the operating cam in a state of making the clutch OFF according to the embodiment of the chronograph timepiece of the invention.
Figure 19:
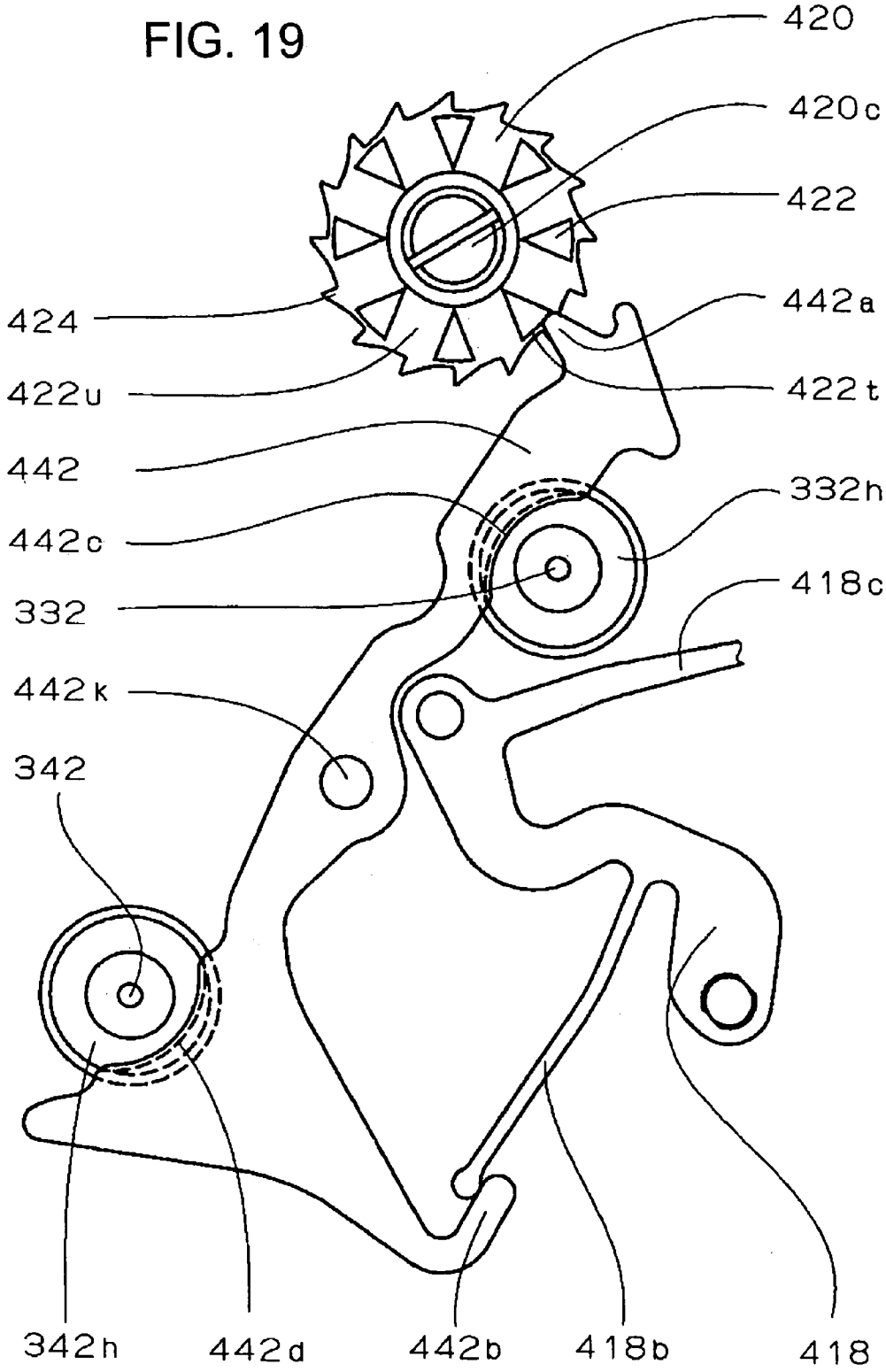
FIG. 19 is a partial plane view showing an hour/minute coupling lever and the operating cam in a state of making the clutch OFF according to the embodiment of the chronograph timepiece of the invention.
Figure 20:
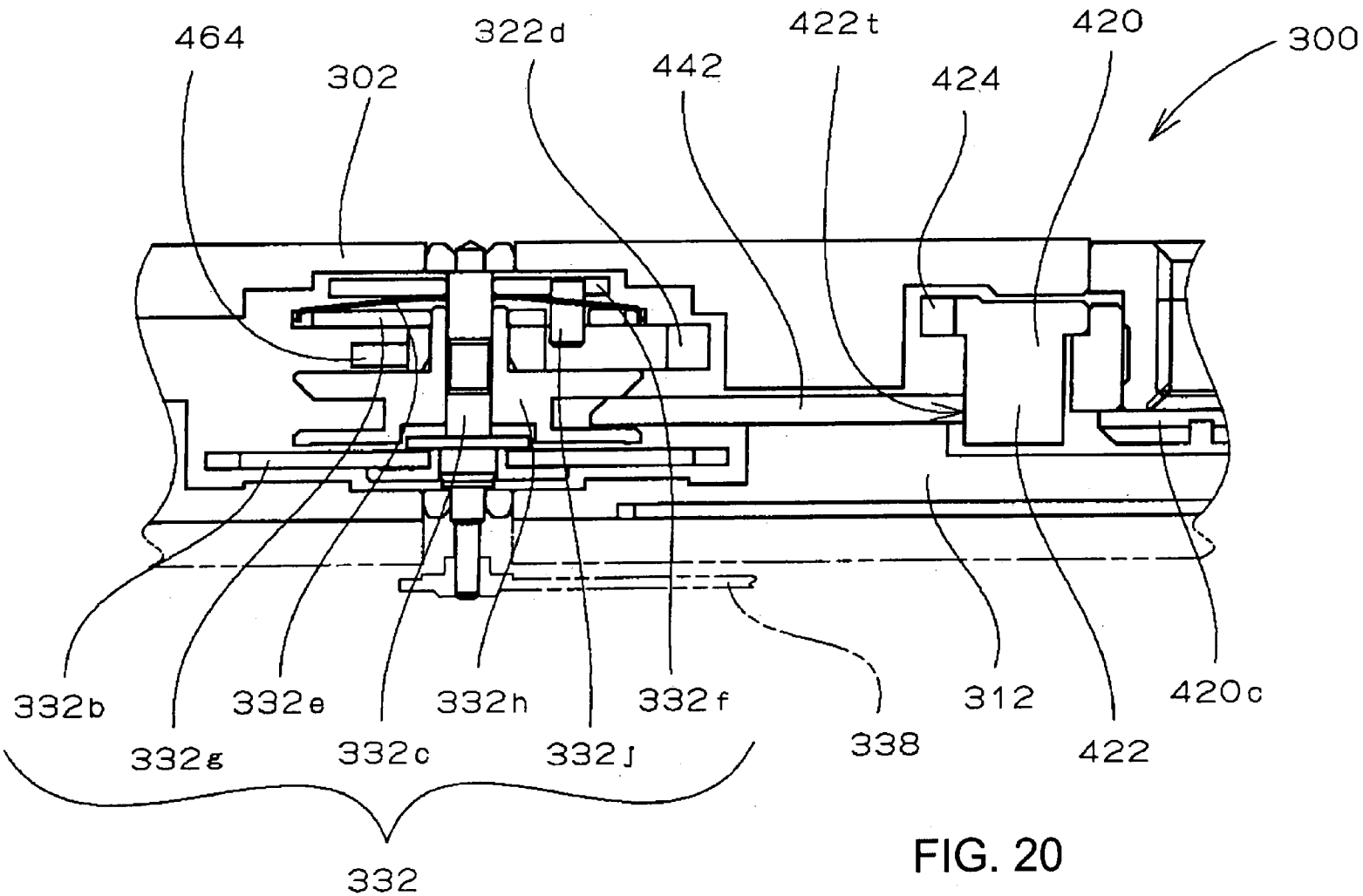
FIG. 20 is a partial sectional view showing the hour/minute coupling lever and the operating cam in a state of making the clutch OFF according to the embodiment of the chronograph timepiece of the invention.

In reference to FIG. 1, FIG. 16 and FIG. 26, a constitution of a chronograph operating mechanism in a state of not operating to measure chronograph will be explained. The start/stop button 306 is provided in the 2 o'clock direction of the movement 100. Although it is preferable to arrange a center axis line of the start/stop button 306 in the 2 o'clock direction of the movement 100, the center axis line may be arranged at a position other than the 2 o'clock direction between the 1 o'clock direction and the 3 o'clock direction of the movement 100. The start/stop button 306 is arranged to operate to a part disposed in the "12 o'clock 3 o'clock region" of the movement 100.

By depressing the start/stop button 306 in a direction designated by an arrow mark, an operating lever A412 is constituted to be able to rotate. A position at which the operating lever A412 is brought into contact with the start/stop button 306 is disposed in the "12 o'clock 3 o'clock region" of the movement 100. The operating lever A412 is arranged to be rotatable by constituting a rotational center by an operating lever A rotating shaft 412*k*. An operating lever spring 414 includes a spring portion 414*b*. A front end portion 414*c* of the spring portion 414*b* of the operating lever spring 414 presses the operating lever A412 to the start/stop button 306 to rotate in the counterclockwise direction. The operating lever spring 414 is attached to the chronograph main plate 302 by an operating lever spring stop screw 414*c*. An operating lever B416 is fixed with an operating lever B pin 416*b*. A portion of the operating lever B pin 416*b* is arranged at a round hole 412*h* provided at the operating lever A412 and other portion thereof is arranged to be guided by a guide, hole 302*h* in the shape of a long hole provided at the chronograph main plate 302.

After depressing the start/stop button 306, when the finger is separated from the start/stop button 306, by the spring force of the operating lever spring 414, the operating lever 412 is constituted to rotate in the counterclockwise direction. The start/stop button 306 is constituted to return to the original position by spring force of a return spring integrated to an outer case.

The reset button 308 is provided in the 4 o'clock direction of the movement 100 and by depressing the reset button 308 in a direction designated by an arrow mark, the hammer transmission lever A480 is constituted to be able to rotate. After depressing the reset button 308, when the finger is separated from the reset button 308, by the spring force of the click spring 418, the hammer transmission lever A480 is constituted to rotate in the clockwise direction. By the spring force of a return spring integrated to the outer case, the reset button 308 is constituted to return to an original position. Although it is preferable that a center axis line of the reset button 308 is arranged in the 4 o'clock direction of the movement 100, the center axis line may be arranged at a position other than the 4 o'clock direction between the 3 o'clock direction and the 6 o'clock direction of the movement 100. The reset button 308 is arranged to operate a part disposed in the "3 o'clock 6 o'clock region" of the movement 100. A position at which the hammer transmission lever A480 is brought into contact with the reset button 308 is constituted to dispose in the "3 o'clock 6 o'clock region" of the movement 100.

An operating cam 420 includes drive teeth 422 and the ratchet teeth 424 and is provided rotatably. A rotational center of the operating cam 420 is arranged in the "3 o'clock 6 o'clock region" of the movement 100. A number of teeth of the ratchet teeth 424 is 16. A number of teeth of the drive teeth 422 is 8 which is ½ of the number of teeth of the ratchet teeth 424. Therefore, when the ratchet teeth 424 are fed by 1 pitch, the drive teeth 422 are fed by ½ pitch. The operating cam 420 is attached to the chronograph main plate 302 rotatably by an operating cam stop screw 420*c*. The front end portion 414*c* of the spring portion 414*b* of the operating lever spring 414 presses a front end portion 416*c* of the operating lever B416 to the ratchet teeth 424 of the operating cam 420 such that the operating lever B416 is rotated in the counterclockwise direction by constituting a rotational center by the operating lever B pin 416*b*.

When one location in correspondence with an outer periphery of the drive teeth 422 is viewed, at each time of feeding the ratchet teeth 424 by 1 pitch, ridge portions 422*t* and valley portions 422*u* of the drive teeth 422 are constituted to dispose at the location alternately. So far as the number of teeth of the ratchet teeth 424 is twice as much as the number of teeth of the drive teeth 422, the number of teeth of the ratchet teeth 424 may not be 16. However, the number of teeth of the ratchet teeth 424 is an even number.

An operating cam jumper 426 having a spring portion is provided. A restricting portion 426*a* of the operating cam jumper 426 restricts the ratchet teeth 424 to determine a position of the operating cam 420 in the rotational direction. Therefore, by the ratchet teeth 424 and the operating cam jumper 426, the operating cam 420 is rotated by 360/16 degrees and is firmly positioned at the position. The front end portion 416*c* of the operating lever B416 is arranged to be brought into contact with the ratchet teeth 424.

In reference to FIG. 1, FIG. 17, FIG. 18 and FIG. 26, the coupling lever A444 is rotatably provided centering on a coupling lever A rotating shaft 444*k*. The coupling lever A444 includes a coupling lever front end portion 444*a*, a coupling lever B contact portion 444*b* and a clutch ring contact portion 444*c*. The coupling lever front end portion 444*a* is brought into contact with an outer peripheral portion of the ridge portion 422*t* of the drive teeth 422.

The coupling lever B446 is rotatably provided centering on a coupling lever B rotating shaft 446*k*. The coupling lever B446 includes a coupling lever A contact portion 446*a*, a coupling lever spring contact portion 446*b* and a clutch ring contact portion 446*c*. The coupling lever spring 448 includes a spring portion 448*b*. The spring portion 448*b* of the coupling lever spring 448 presses the coupling lever spring contact portion 446*b* of the coupling lever B446 such that the coupling lever B446 is rotated in the clockwise direction by constituting a rotational center by the coupling lever B rotating shaft 446*k*. The coupling lever B446 presses the coupling lever front end portion 444*a* of the coupling lever A444 to the outer peripheral portion of the ridge portion 422*t* of the drive teeth 422 such that the coupling lever A444 is rotated in the counterclockwise direction by constituting a rotational center by the coupling lever A rotating shaft 444*k*.

The clutch ring contact portion 444*c* of the coupling lever A444 and the clutch ring contact portion 446*c* of the coupling lever B446 are brought into contact with the intermediate second chronograph wheel clutch ring 320*d* of the intermediate second chronograph wheel & pinion 320 to make clutch OFF. Therefore, under the state, even when the intermediate second wheel 320*f* is rotated, the intermediate second chronograph wheel 320*c* is not rotated and the chronograph second hand 324 is not rotated.

In reference to FIG. 1, FIG. 19, FIG. 20 and FIG. 26, the hour/minute coupling lever 442 is rotatably provided centering on an hour/minute coupling lever rotating shaft 442*k*. The hour/minute coupling lever 442 includes an hour/minute coupling lever front end portion 442*a*, a click spring contact portion 442*b*, an hour clutch ring contact portion 442*c* and a minute clutch ring contact portion 442*d*. The hour/minute coupling lever front end portion 442*a* is brought into contact with the outer peripheral portion of the ridge portion 422*t* of the drive teeth 422.

The click spring 418 includes an hour/minute coupling lever spring portion 418*b* and a hammer transmission lever spring portion 418*c*. The hour/minute coupling lever spring portion 418*b* of the click spring 418 presses the click spring contact portion 442*b* of the hour/minute coupling lever 442 such that the hour/minute coupling lever 442 is rotated in the counterclockwise direction by constituting a rotational center by the hour/minute coupling lever rotating shaft 442*k*. The hour/minute coupling lever 442 presses the hour/minute coupling lever front end portion 442*a* of the hour/minute coupling lever 442 to the outer peripheral portion of the ridge portion 422*t* of the drive teeth 422 such that the hour/minute coupling lever 442 is rotated in the clockwise direction by constituting a rotational center by the hour/minute coupling lever rotating shaft 442*k*.

The hour clutch ring contact portion 442*c* of the hour/minute coupling lever 442 is brought into contact with the hour chronograph wheel clutch ring 332*h* of the hour chronograph wheel 332 to make clutch OFF. Therefore, under the state, even when the hour chronograph wheel 332*b* is rotated, the hour 5chronograph wheel shaft 332*c* is not rotated and the chronograph hour hand 338 is not rotated. Further, the minute clutch ring contact portion 442*d* of the hour/minute coupling lever 442 is brought into contact with the minute chronograph wheel clutch ring 342*h* of the minute chronograph wheel 342 to make clutch OFF. Therefore, under the state, even when the minute chronograph wheel 342*b* is rotated, the minute chronograph wheel shaft 342*c* is not rotated and the chronograph minute hand 348 is not rotated.

(9-2) A State of Operating to Measure Chronograph

Figure 21:
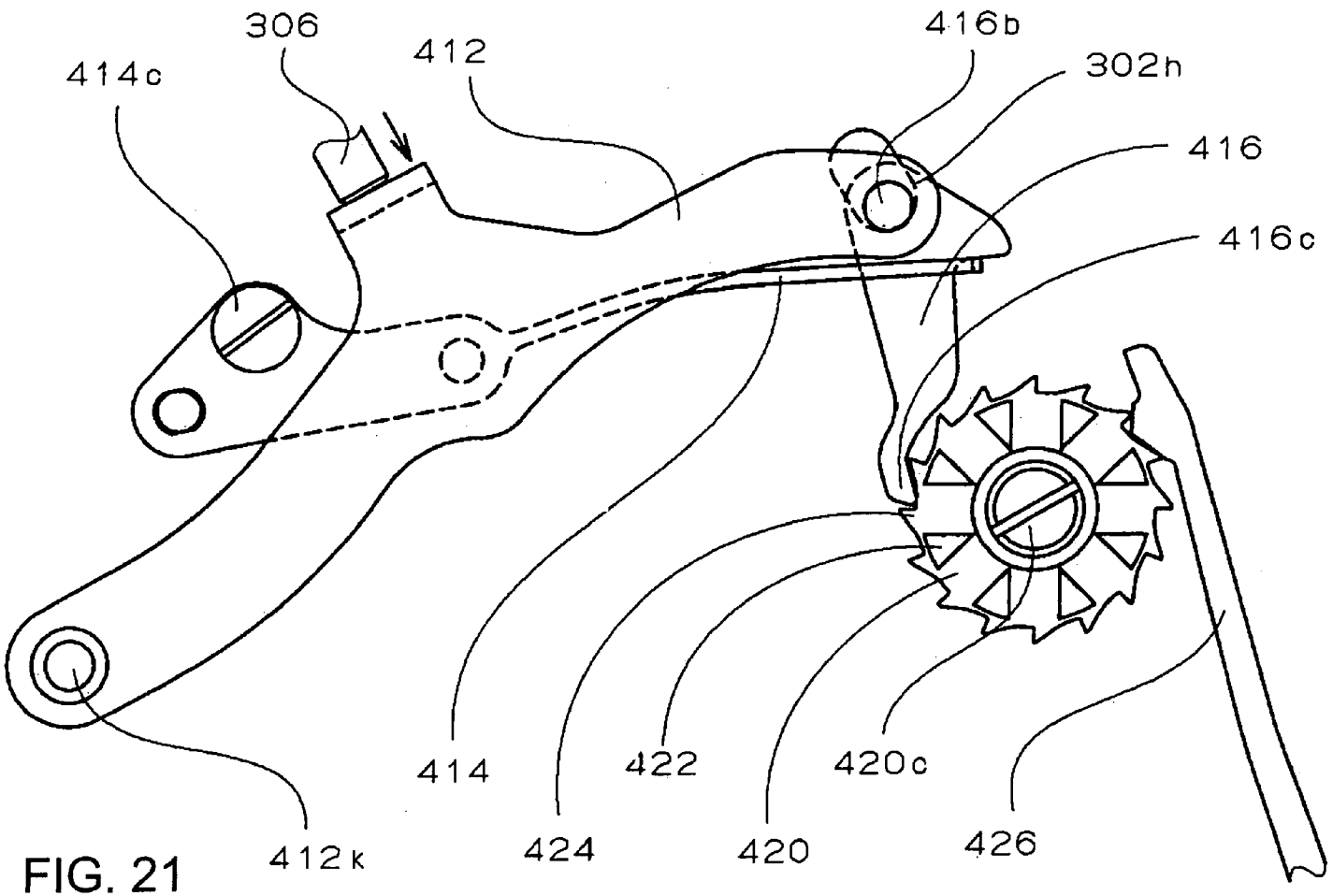
FIG. 21 is a partial plane view showing the operating lever and the operating cam in a state of driving the chronograph mechanism according to the embodiment of the chronograph timepiece of the invention.

In reference to FIG. 2 and FIG. 21, an explanation will be given of a constitution of a chronograph operating mechanism in a state of operating to measure chronograph. When the start/stop button 306 is depressed in the direction designated by the arrow mark, the operating lever A412 is rotated in the clockwise direction by constituting the rotational center by the operating lever A rotating shaft 412*k*. The operating lever B pin 416*b* of the operating lever B416 is guided by the guide hole 302*h* of the chronograph main plate 302 to move the operating lever B416.

When the start/stop button 306 is pressed and the operating lever B416 is moved, the front end portion 416*c* of the operating lever B416 rotates the ratchet teeth 424 of the operating cam 420 by 1 pitch in the counterclockwise direction. The restricting portion 426*a* of the operating cam jumper 426 restricts the ratchet teeth 424 to determine the position of the operating cam 420 in the rotational direction. Therefore, when the start/stop button 306 is depressed to move the operating lever B416, the operating cam 420 is rotated by 360/16 degrees.

Figure 2:
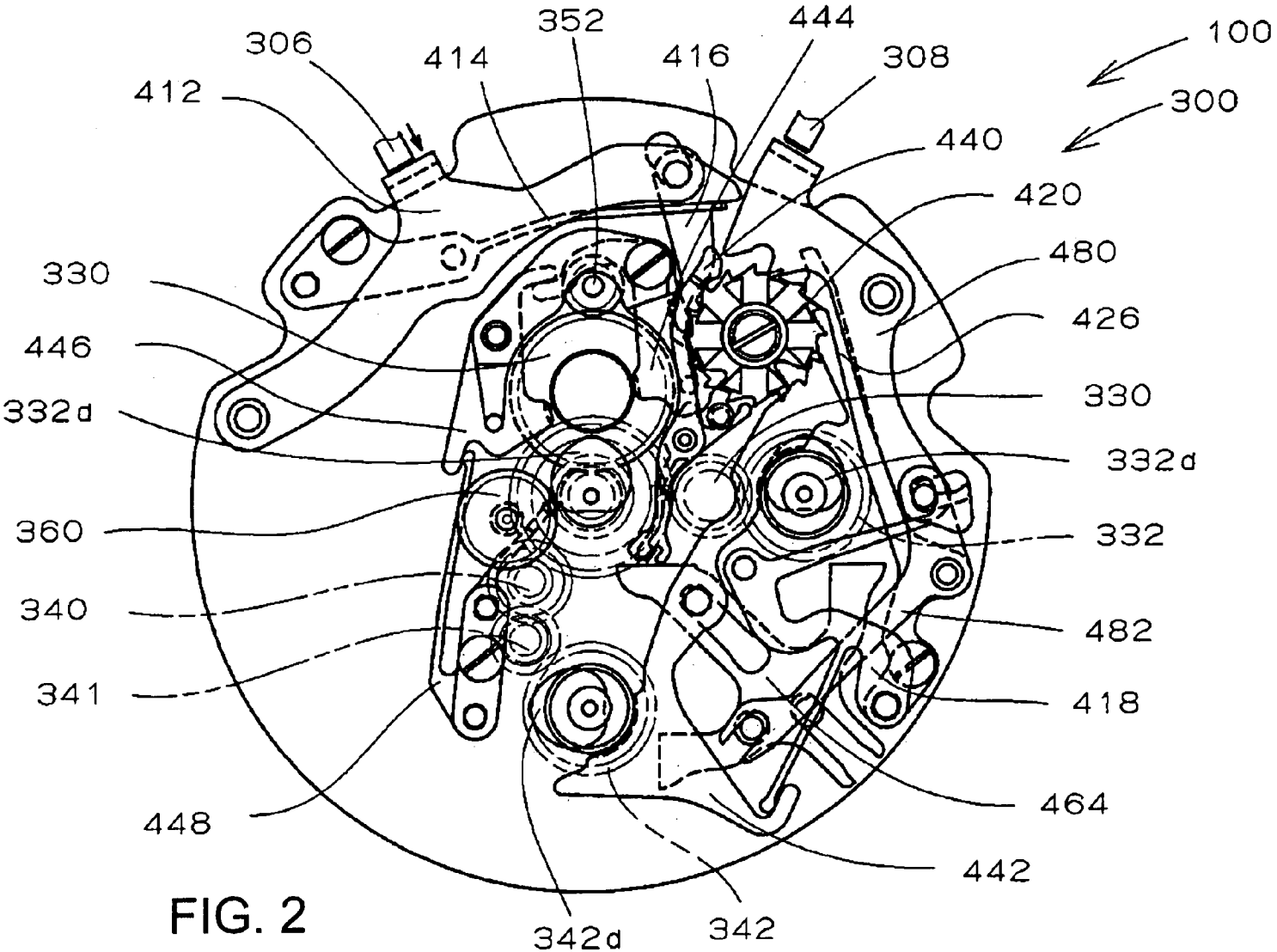
FIG. 2 is a partial plane view showing a state of viewing the chronograph mechanism on the dial side in a start state according to the embodiment of the chronograph timepiece of the invention.
Figure 22:
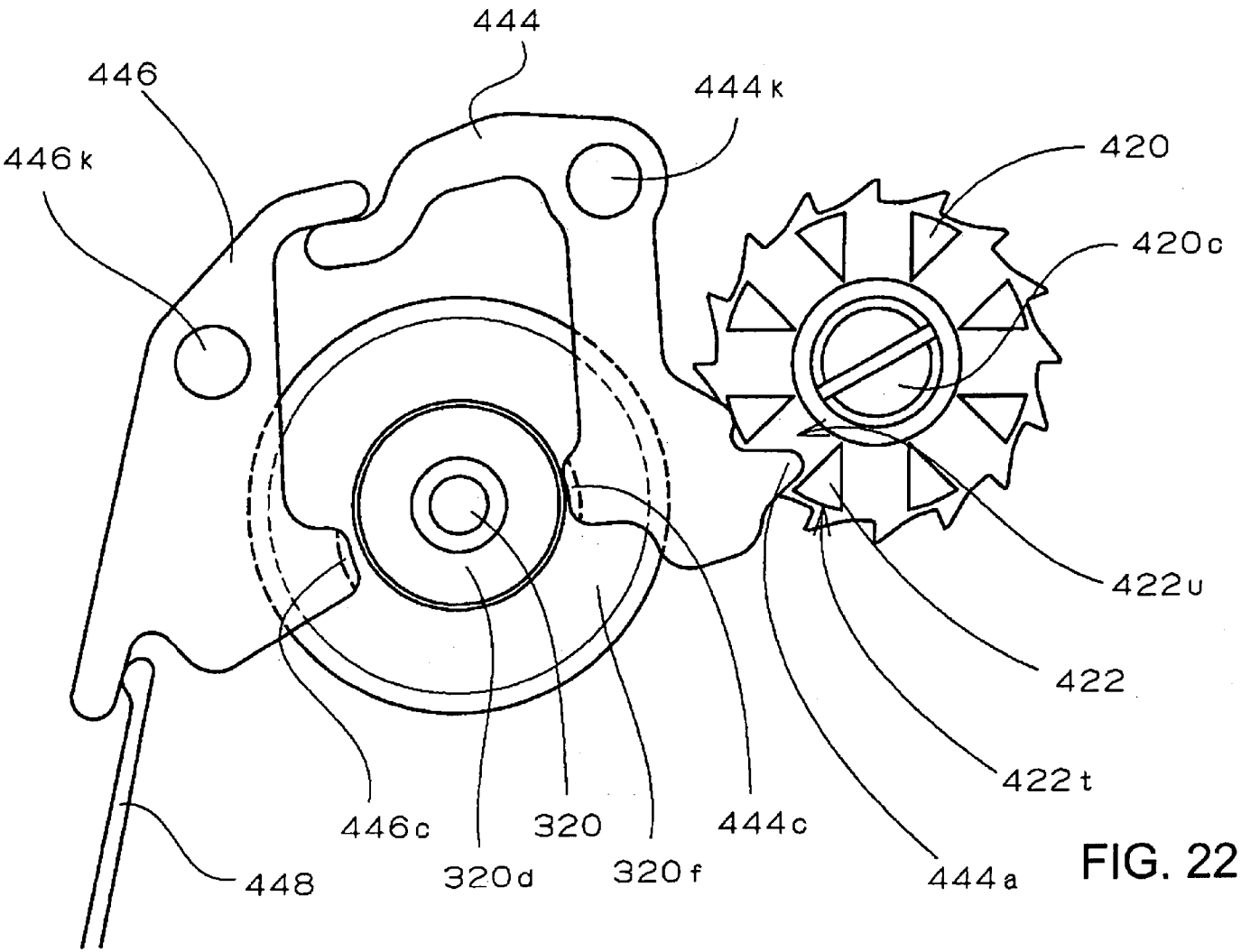
FIG. 22 is a partial plane view showing the coupling lever and the operating cam in a state of making the clutch ON according to the embodiment of the chronograph timepiece of the invention.
Figure 23:
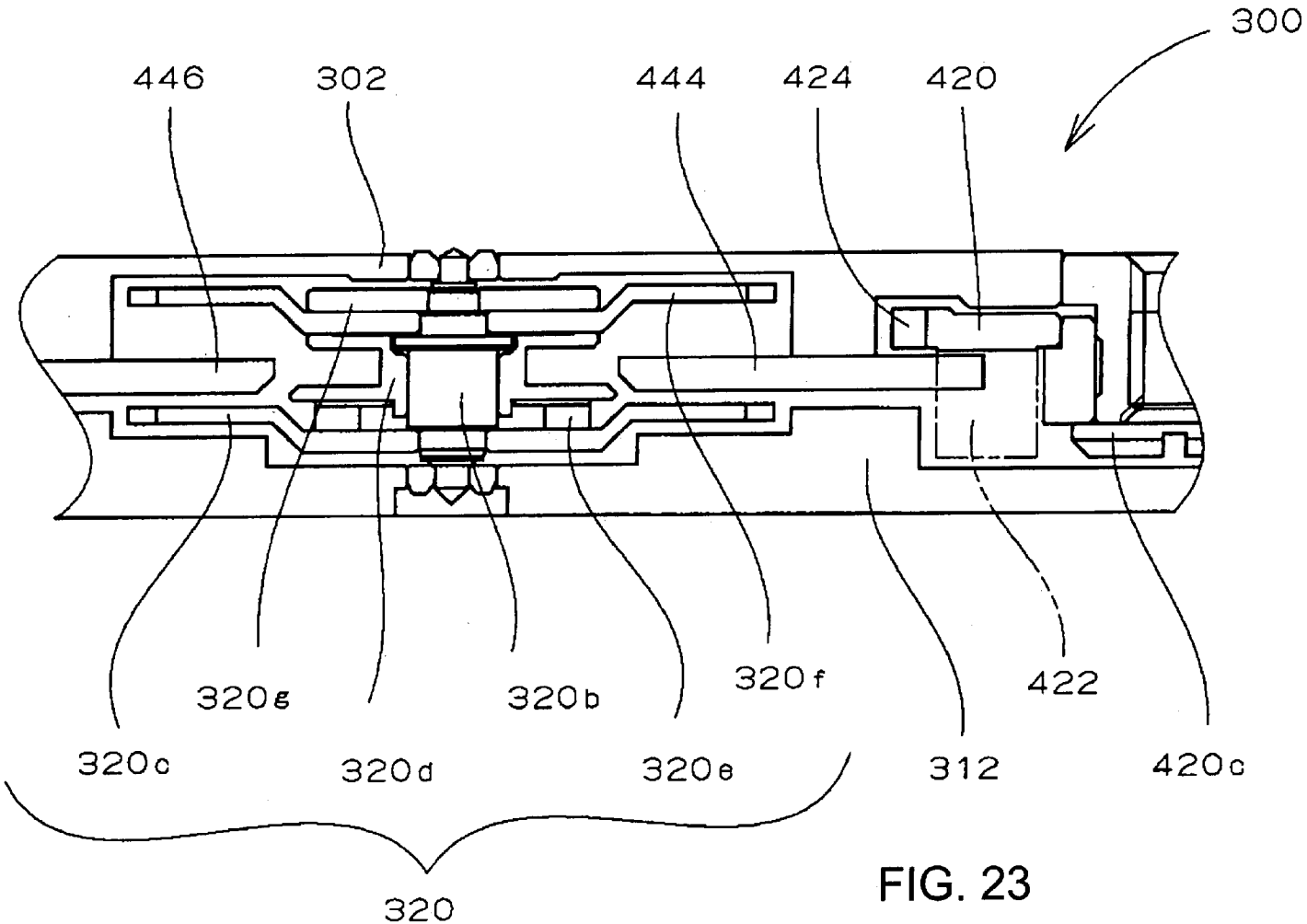
FIG. 23 is a partial sectional view showing the coupling lever and the operating cam in a state of making the clutch ON according to the embodiment of the chronograph timepiece of the invention.

In reference to FIG. 2, FIG. 22 and FIG. 23, when the operating cam 420 is rotated by 360/16 degrees, the coupling lever A444 is rotated centering on the coupling lever A rotating shaft 444*k* and the coupling lever front end portion 444*a* is disposed at the valley portion 422*u* of the drive teeth 422. Further, when the coupling lever A444 is rotated, the coupling lever B446 is also rotated centering on the coupling lever B rotating shaft 446*k*.

When the coupling lever A444 is rotated, the clutch ring contact portion 444*c* of the coupling lever A444 is separated from the intermediate second chronograph wheel clutch ring 320*d* of the intermediate second chronograph wheel & pinion 320 to make clutch ON. When the coupling lever B446 is rotated, the clutch-ring contact portion 446*c* of the coupling lever B446 is separated from the intermediate second chronograph wheel clutch ring 320*d* of the intermediate second chronograph wheel & pinion 320 to make clutch ON. Therefore, under the state, when the intermediate second chronograph wheel shaft 320*b* is rotated, the intermediate second chronograph wheel 320*c* is rotated and the chronograph second hand 324 is also rotated.

Figure 24:
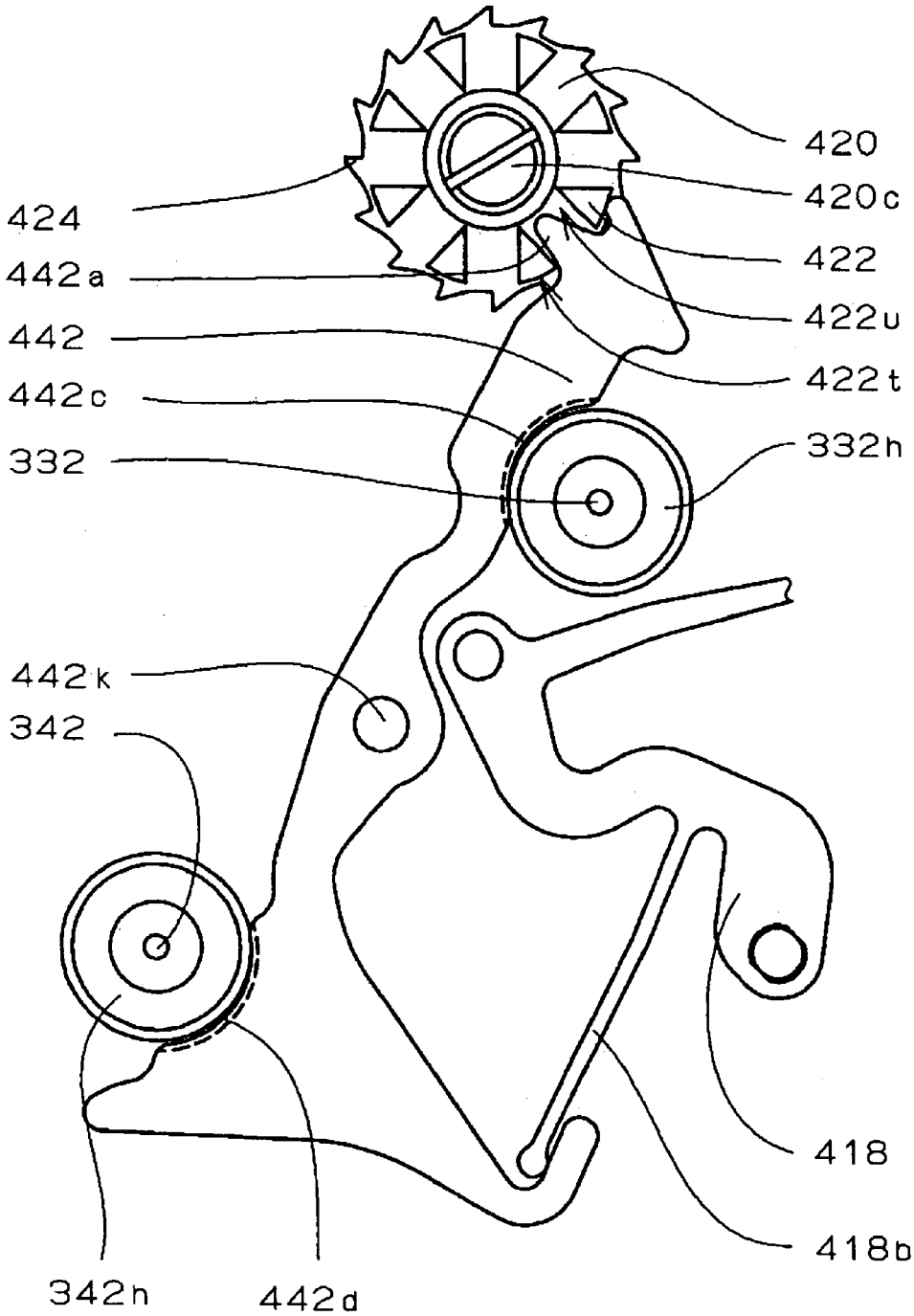
FIG. 24 is a partial plane view showing the hour/minute coupling lever and the operating cam in a state of making the clutch ON according to the embodiment of the chronograph timepiece of the invention.
Figure 25:
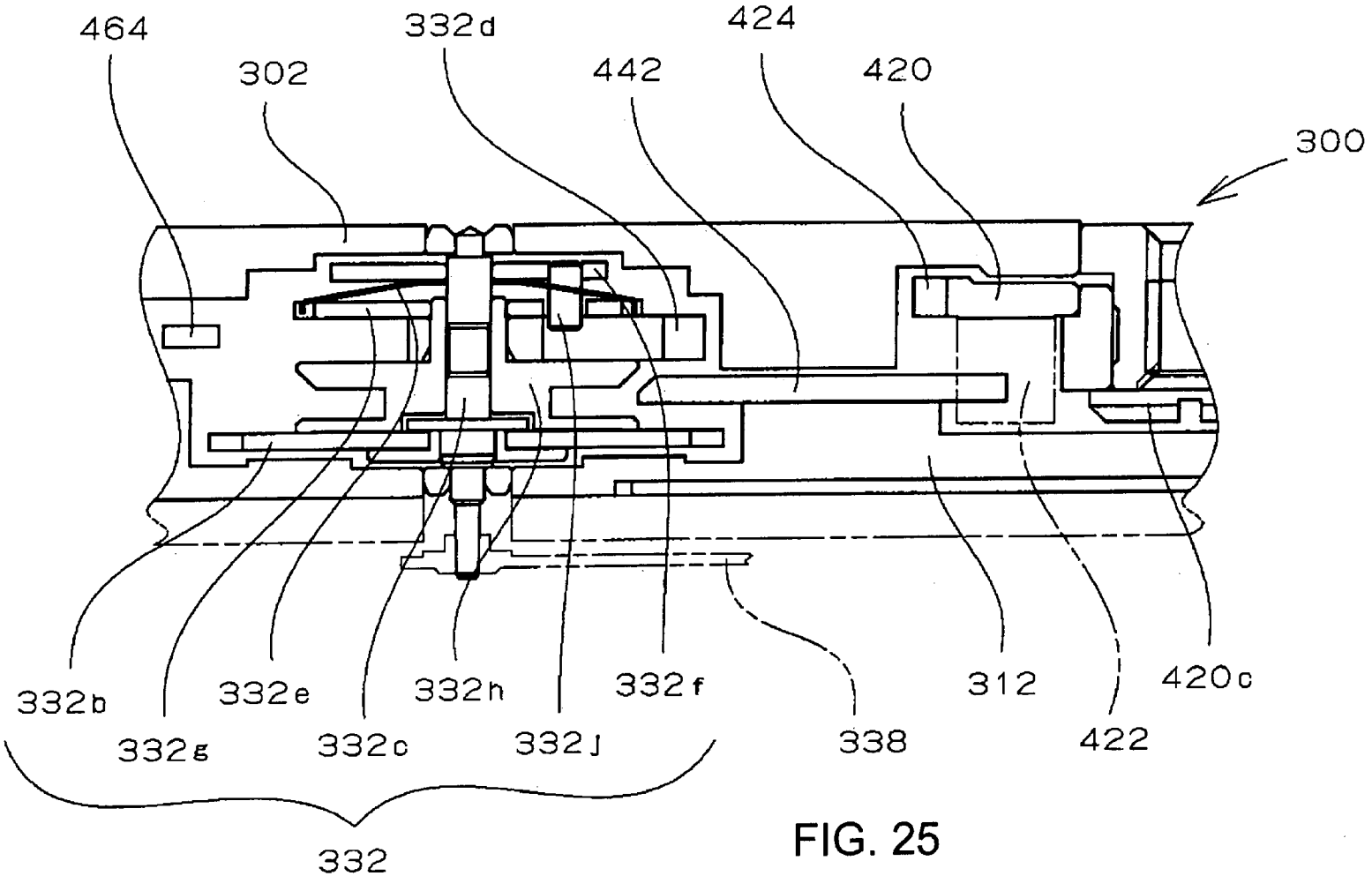
FIG. 25 is a partial sectional view showing the hour/minute coupling lever and the operating cam in the state of making the clutch ON according to the embodiment of the chronograph timepiece of the invention.

In reference to FIG. 2, FIG. 24 and FIG. 25, when the operating cam 420 is rotated by 360/16 degrees, the hour/minute coupling lever 442 is rotated centering on the hour/minute coupling lever rotating shaft 442*k* and the hour/minute coupling lever front end portion 442*a* is disposed at the valley portion 422*t* of the drive teeth 422. When the hour/minute coupling lever 442 is rotated, the hour clutch ring contact portion 442*c* of the hour/minute coupling lever 442 is separated from the hour chronograph wheel clutch ring 332*h* of the hour chronograph wheel 332 to make clutch ON. Therefore, under the state, when the hour chronograph wheel 332*b* is rotated, the hour chronograph wheel shaft 332*c* is rotated and the chronograph hour hand 338 is also rotated. Further, when the hour/minute coupling lever 442 is rotated, the minute clutch ring contact portion 442*d* of the hour/minute coupling lever 442 is separated from the minute chronograph wheel clutch ring 342*h* of the minute chronograph wheel 342 to make clutch ON. Therefore, under the state, when the minute chronograph wheel 342*b* is rotated, the minute chronograph wheel shaft 342*c* is rotated and the chronograph minute hand 348 is also rotated.

(9-3) A Constitution and Operation of a Stop Lever

Figure 27:
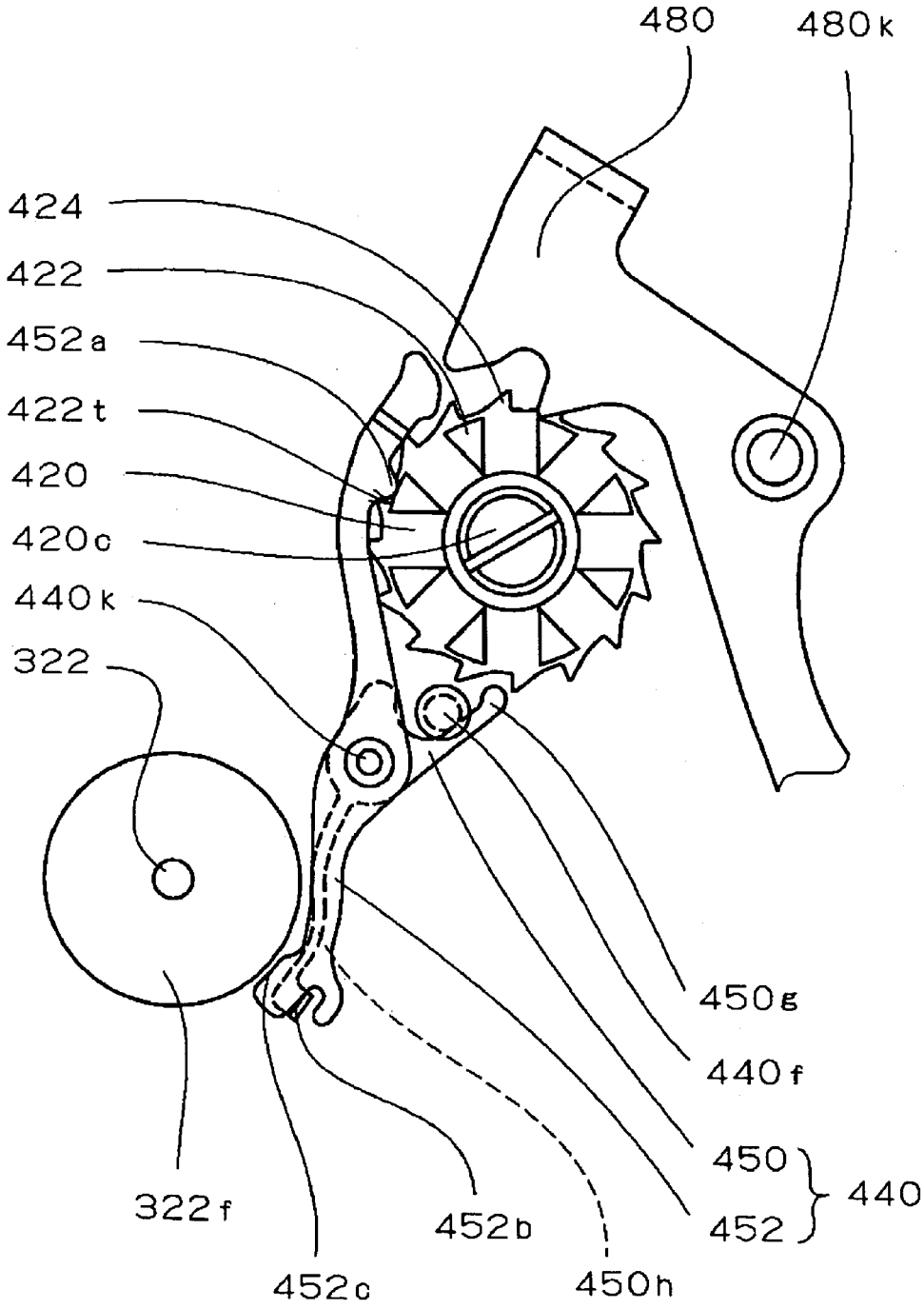
FIG. 27 is a partial plane view showing a stop lever and the operating cam in a run state in a state of making restriction OFF according to the embodiment of the chronograph timepiece of the invention.
Figure 28:
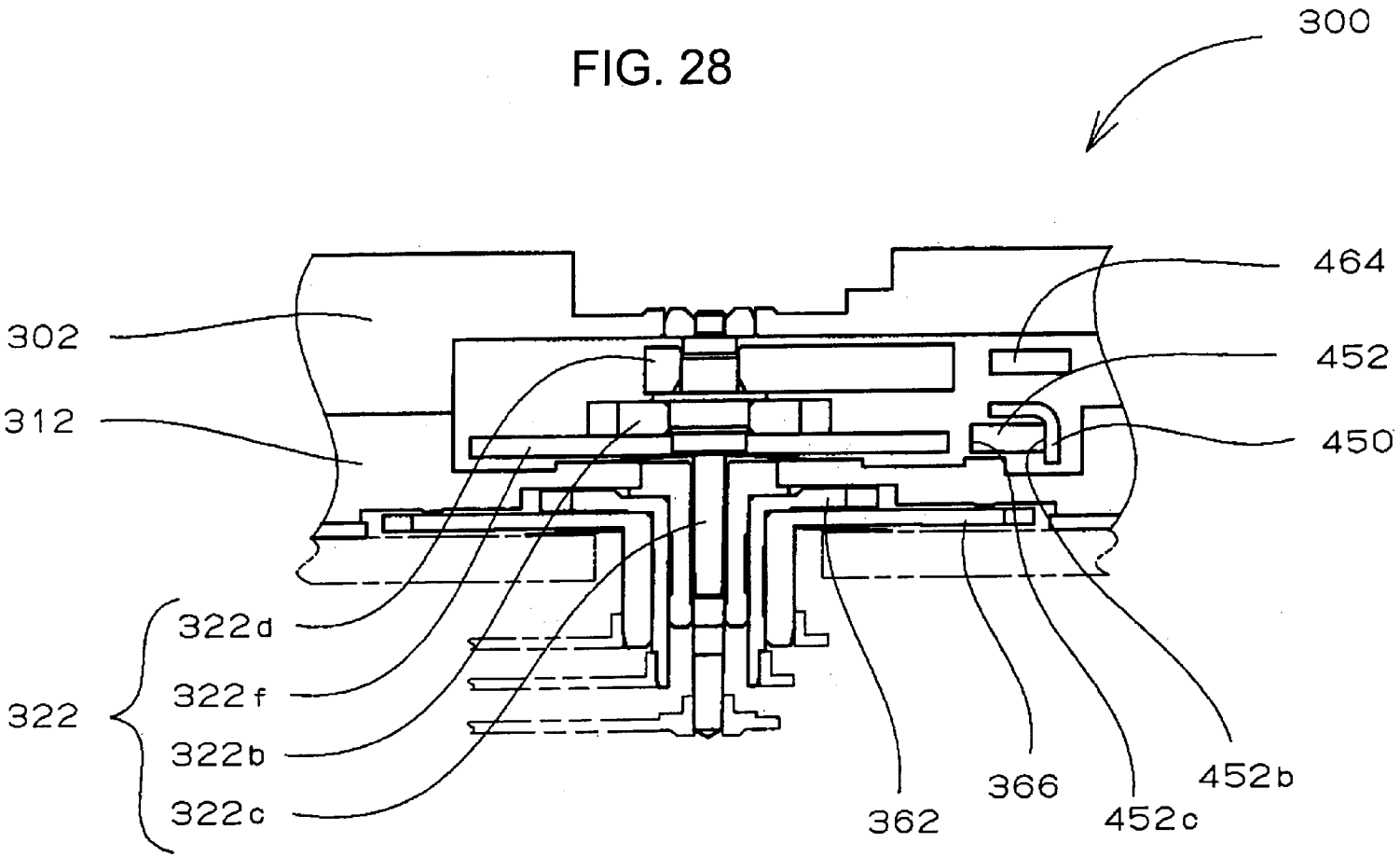
FIG. 28 is a partial sectional view showing the stop lever and the operating cam in the run state in the state of making restriction OFF according to the embodiment of the chronograph timepiece of the invention.

In reference to FIG. 2, FIG. 27 and FIG. 28, a stop lever 440 includes a stop lever spring 450 and a stop lever body 452. The stop lever body 452 is rotatably provided centering on a stop lever rotating shaft 440*k*. A stop lever spring holding pin 440*f* is provided at the chronograph main plate 302. The stop lever spring 450 includes a positioning portion 450*g* and a spring portion 450*h*. The stop lever body 452 includes an operating cam contact portion 452*a*, a stop lever spring contact portion 452*b* and a restricting portion 452*c*. The front end portion of the spring portion 450*h* of the stop lever spring 450 presses the stop lever spring contact portion 452*b* to rotate the stop lever body 452 in the clockwise direction.

In the state of operating to measure chronograph, the operating cam contact portion 452*a* of the stop lever body 452 is brought into contact with the outer peripheral portion of the ridge portion 422*t* of the drive teeth 422. Therefore, under the state, the restricting portion 452*c* of the stop lever body 452 is separated from the stop lever plate 322*f*. Therefore, under the state, the second chronograph shaft 322*c* is not restricted.

Figure 3:
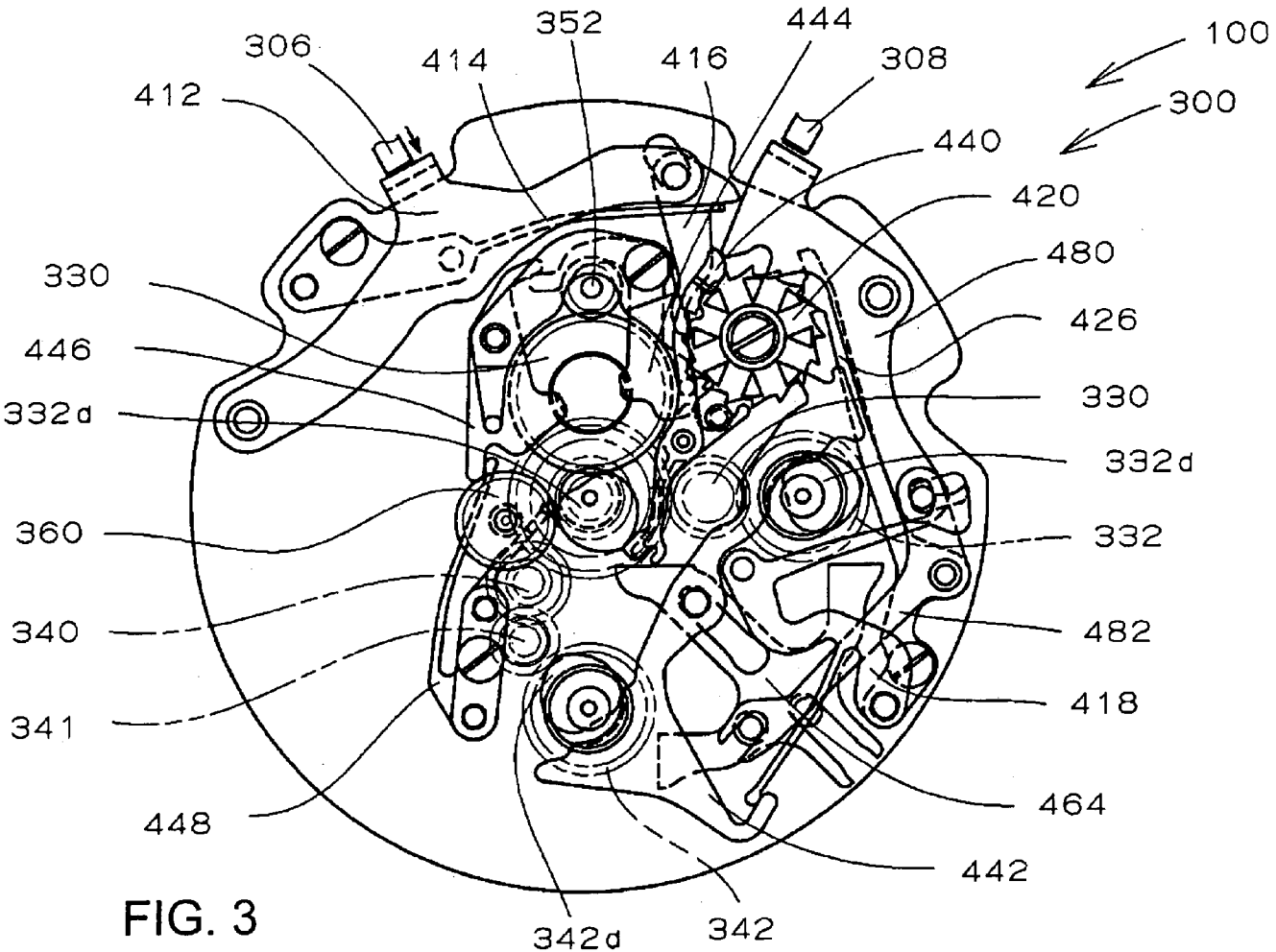
FIG. 3 is a partial plane view showing a state of viewing the chronograph mechanism from the dial side in a stop state according to the embodiment of the chronograph timepiece of the invention.
Figure 29:
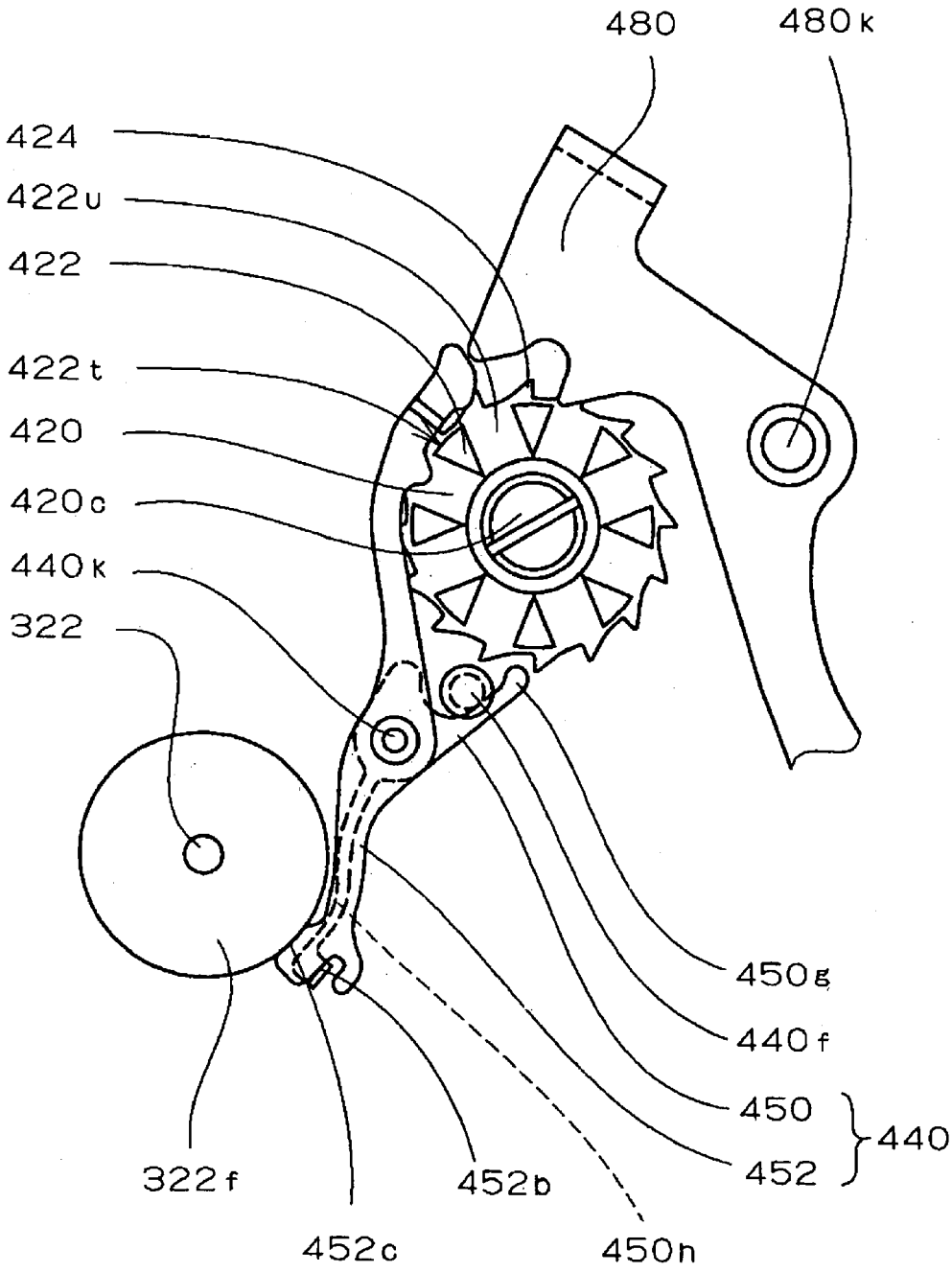
FIG. 29 is a partial plane view showing the stop lever and the operating cam in a stop state in a state of making restriction ON according to the embodiment of the chronograph timepiece of the invention.
Figure 30:
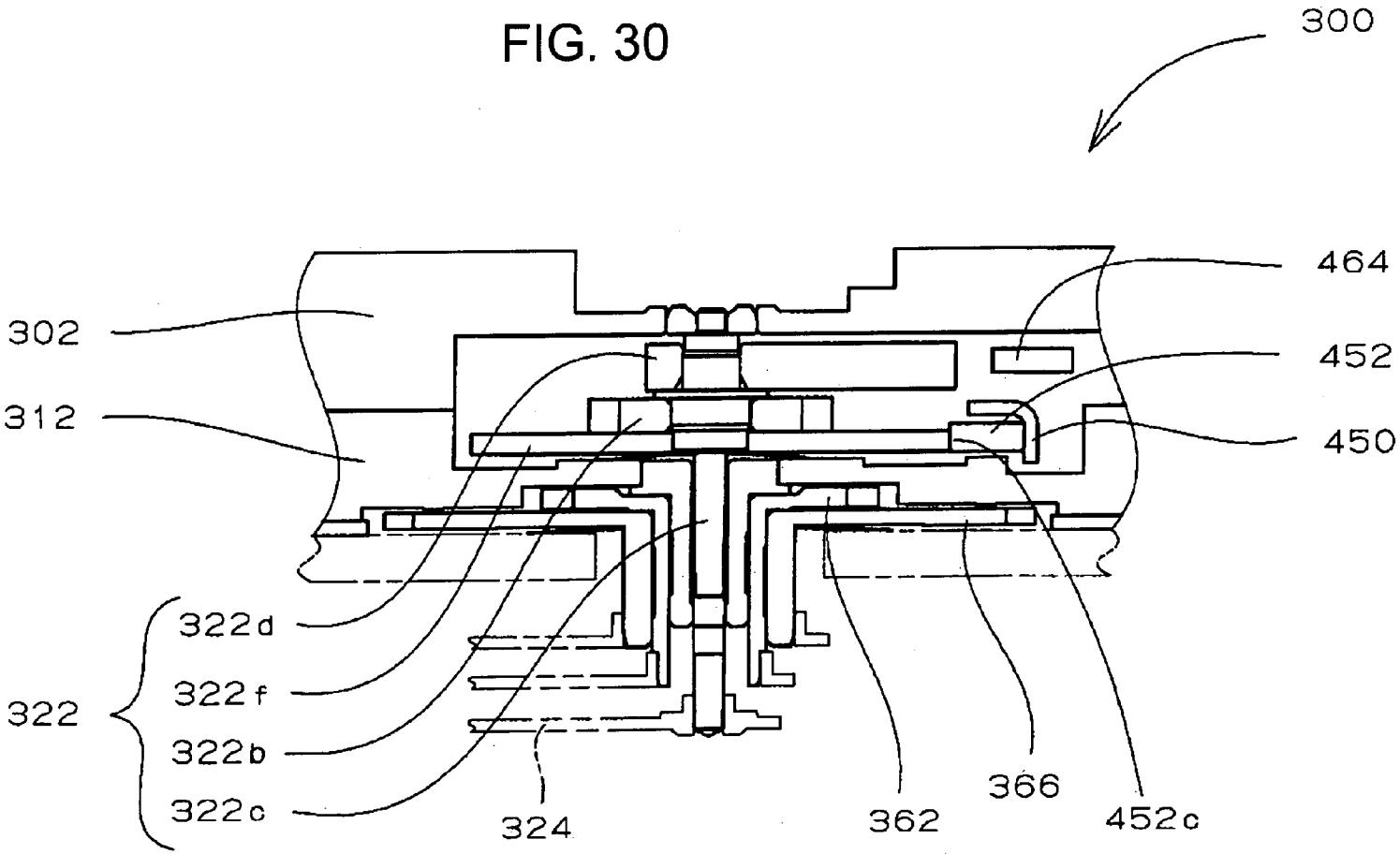
FIG. 30 is a partial sectional view showing the stop lever and the operating cam in the stop state in the state of making restriction ON according to the embodiment of the chronograph timepiece of the invention.

In reference to FIG. 3, FIG. 29 and FIG. 30, in a state of stopping to measure chronograph, when the operating cam 420 is rotated by 360/16 degrees, the operating cam contact portion 452*a* of the stop lever body 452 is disposed in the valley portion 422*u* of the drive teeth 422. Therefore, under the state, by the spring force of the spring portion 450*h* of the stop lever spring 450, the restricting portion 452*c* of the stop lever body 452 is brought into contact with the stop lever plate 322*f*. Therefore, under the state, the second chronograph shaft 322*c* is restricted and the chronograph second hand 324 cannot be rotated.

Figure 4:
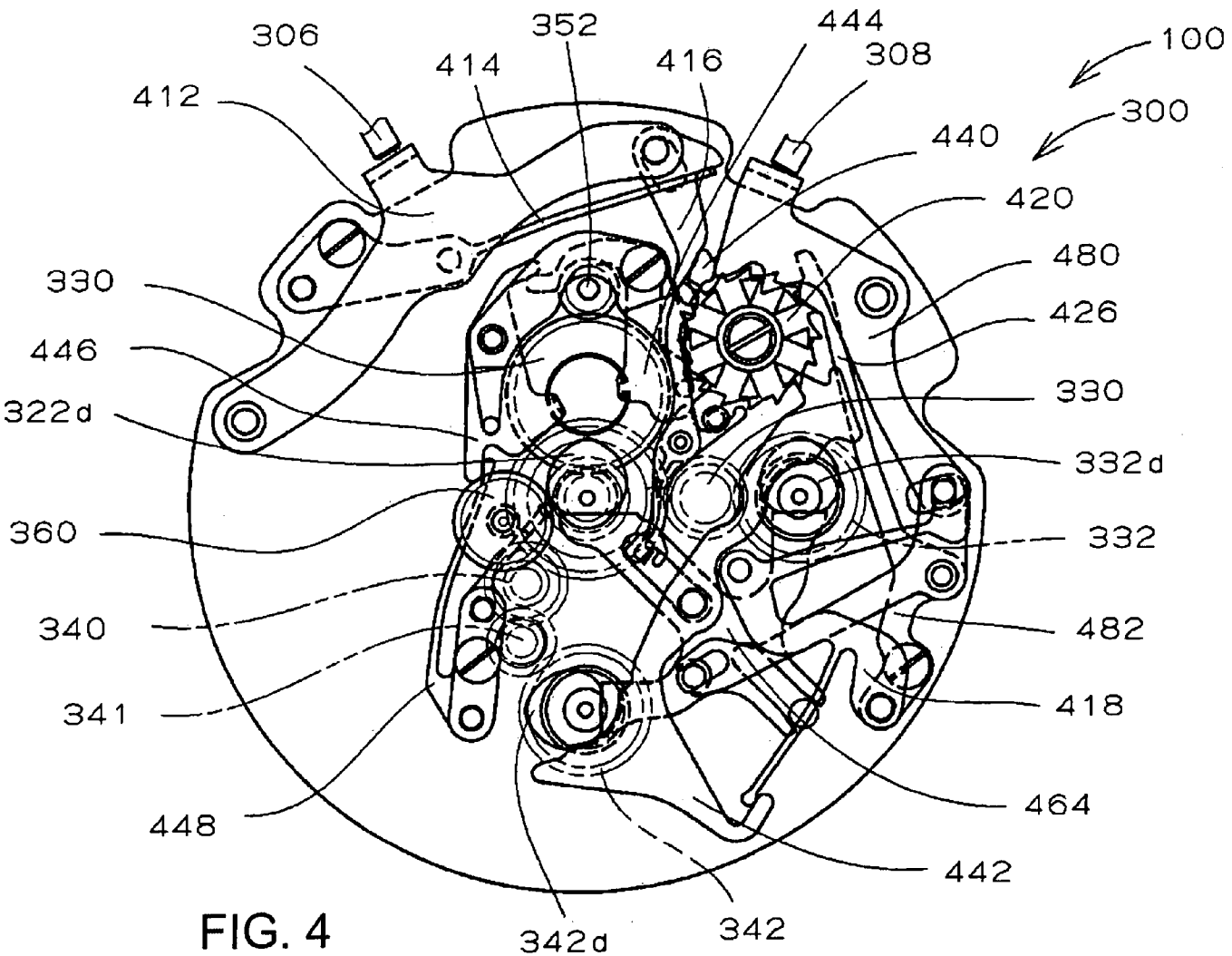
FIG. 4 is a partial plane view showing a state of viewing the chronograph mechanism from the dial side in resetting according to the embodiment of the chronograph timepiece of the invention.
Figure 31:
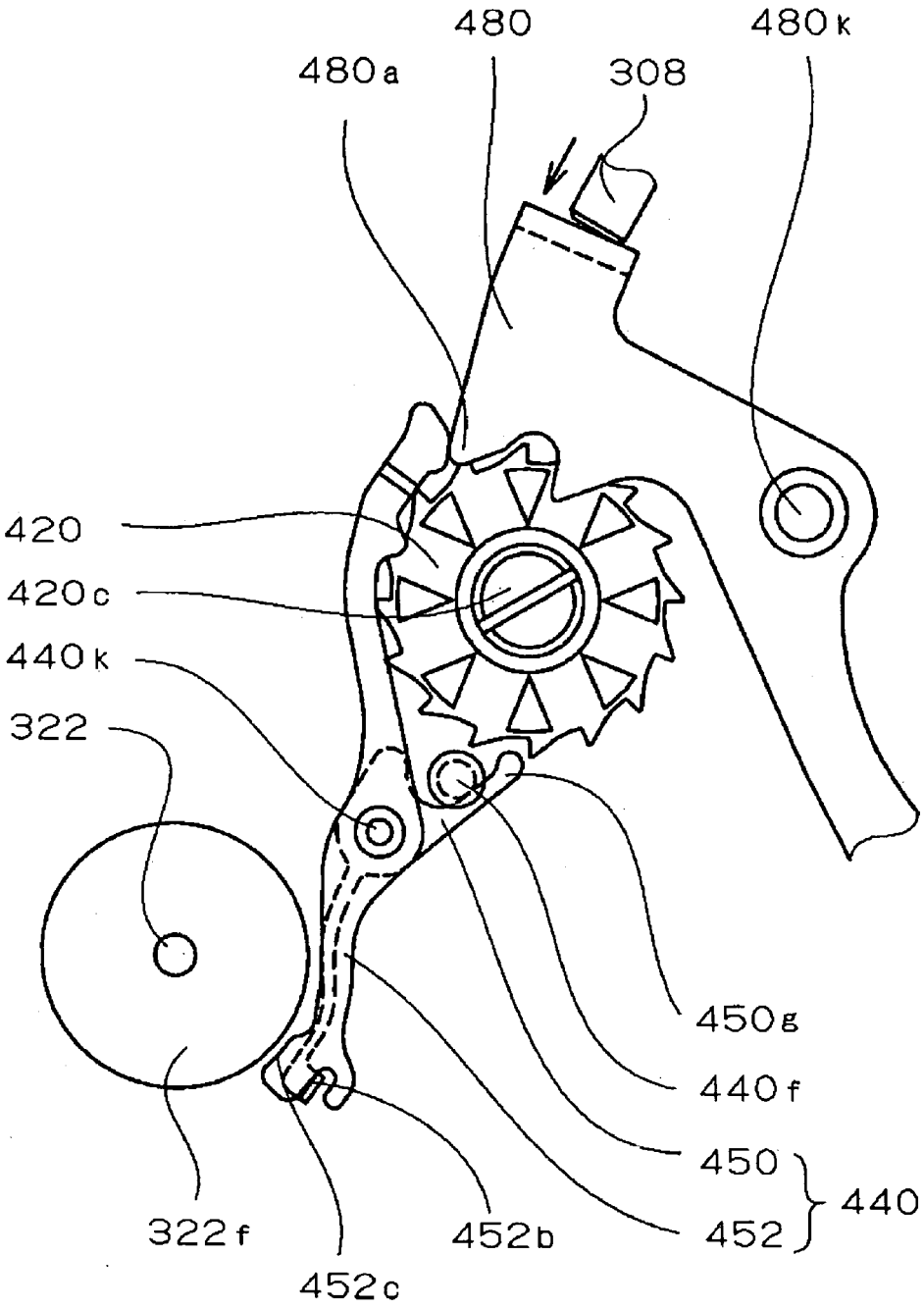
FIG. 31 is a partial plane view showing the stop lever and the operating cam in a reset state according to the embodiment of the chronograph timepiece of the invention.
Figure 32:
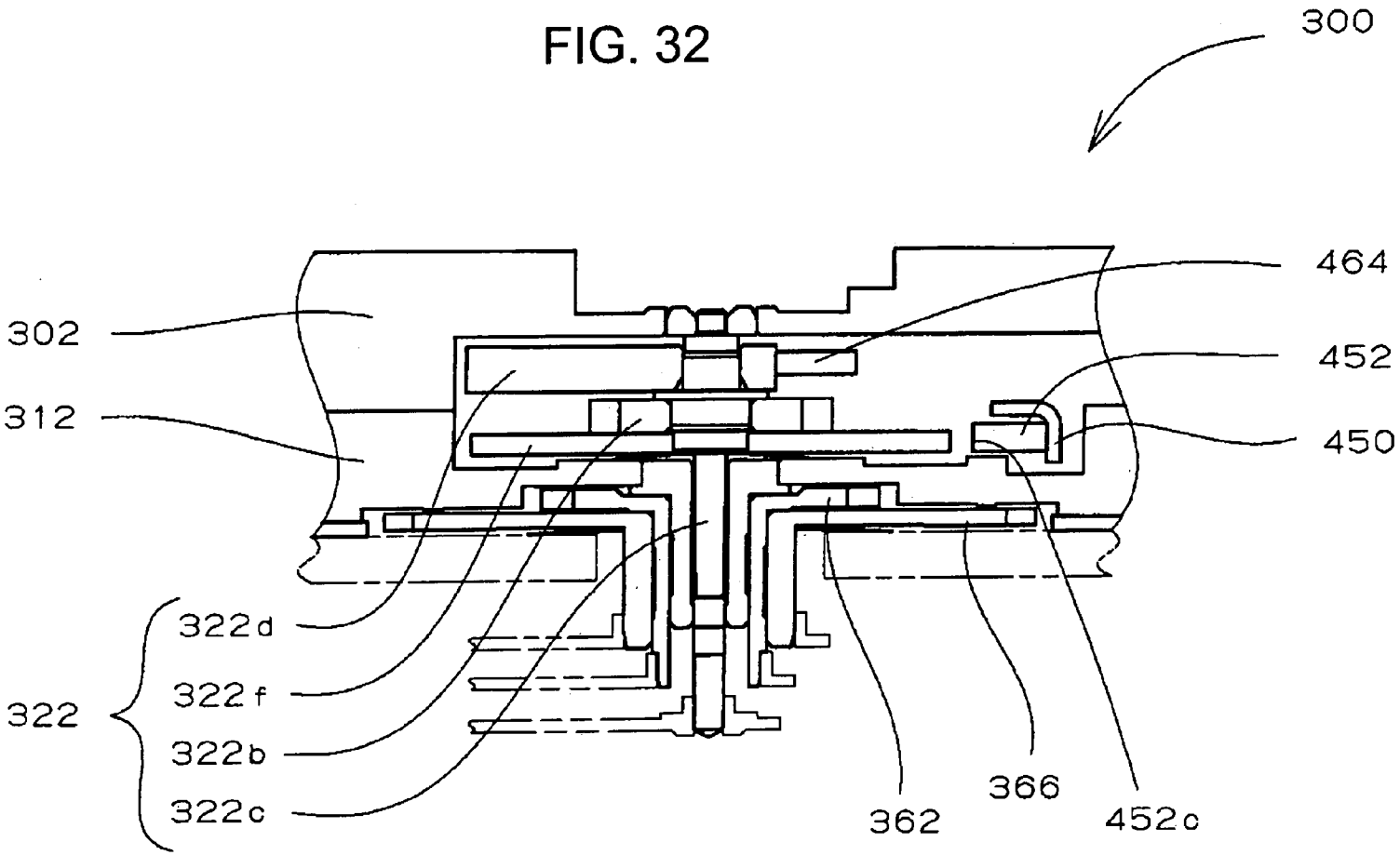
FIG. 32 is a partial sectional view showing the stop lever and the operating cam in the reset state according to the embodiment of the chronograph timepiece of the invention.

In reference to FIG. 4, FIG. 31 and FIG. 32, in a reset state in which the reset button 308 is depressed in the direction designated by the arrow mark, and the hammer transmission lever A480 is rotated in the counterclockwise direction, a stop lever contact portion 480*a* of the hammer transmission lever A480 depresses the stop lever body 452. Therefore, the stop lever body 452 is rotated in the counterclockwise direction and the restricting portion 452*c* of the stop lever body 452 is separated from the stop lever plate 322*f*. Therefore, under the state, the second chronograph shaft 322*c* is not restricted.

(9-4) A Constitution and Operation of the Hammer

In reference to FIG. 1 through FIG. 3 and FIG. 33 through FIG. 35, the hammer transmission lever A480 includes the stop lever contact portion 480*a*, an operating cam contact portion 480*b* and a hammer transmission lever operating pin 480*c*. The hammer transmission lever A480 is rotatably provided centering on a hammer transmission lever A rotating shaft 480*k*. The hammer transmission lever B482 includes a hammer transmission lever operating hole 482*a* and a hammer operating portion 482*c*. The hammer transmission lever B482 is rotatably provided centering on a hammer transmission lever B rotating shaft 482*k*. A portion of the hammer transmission lever operating pin 480*c* is arranged in the hammer transmission lever operating hole 482*a*. A hammer transmission lever guide hole 480*h* is provided at the chronograph main plate 302. A portion of the hammer transmission lever operating pin 480*c* is arranged in the hammer transmission lever guide hole 480*h*.

The hammer 464 includes a hammer operating pin 464*a*, a hammer guide hole 464*b*, a hammer guide portion 464*c*, an hour heart cam contact portion 464*d*, a second heart cam contact portion 464*e* and a minute heart cam contact portion 464*f*. A hammer guide pin A464*h* and a hammer guide pin B464*j* are provided at the chronograph main plate 302. The hammer operating pin 464*a* is arranged in the hammer operating portion 482*c*. The hammer guide pin A464*h* is arranged in the hammer guide hole 464*b*. The hammer guide pin B464*j* is arranged in the hammer guide portion 464*c*. The hammer 464 is movably provided by being guided by the hammer guide pin A464*h* and the hammer guide pin B464*j*.

Figure 33:
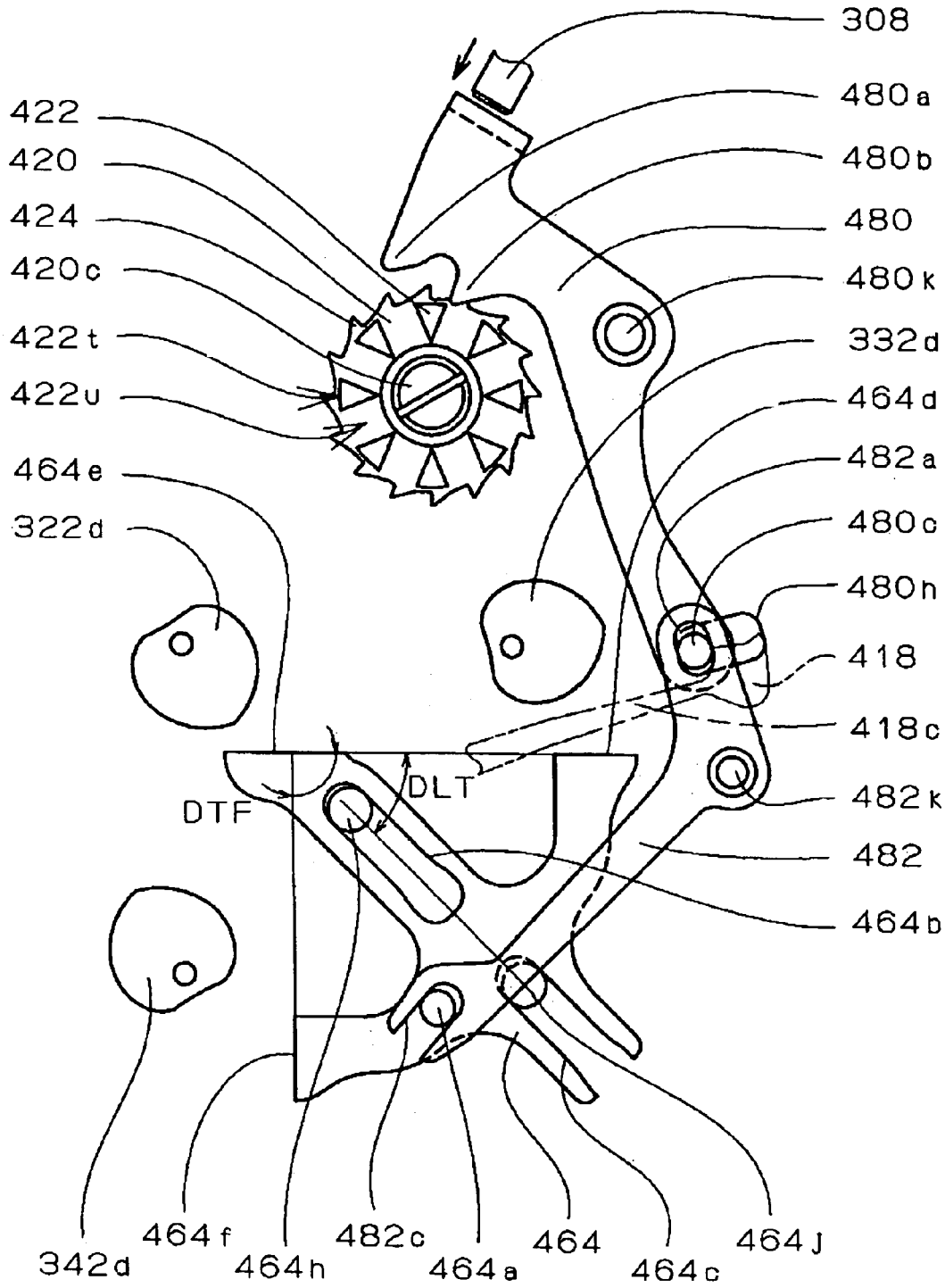
FIG. 33 is a partial plane view showing a hammer and the operating cam in the stop state according to the embodiment of the chronograph timepiece of the invention.

In reference to FIG. 33, the hammer transmission lever spring portion 418*c* of the click spring 418 presses the hammer transmission lever operating pin 480*c* of the hammer transmission lever A480 such that the hammer transmission lever A480 is rotated in the clockwise direction by constituting the rotational center by the hammer transmission lever A rotating shaft 480*k*.

In the state of operating to measure chronograph and the state of stopping to measure chronograph, the hour heart cam contact portion 464*d* is separated from the hour heart cam 332*d*, the second heart cam contact portion 464*e* is separated from the second heart cam 322*d* and the minute heart cam contact portion 464*f* is separated from the minute heart cam 342*d*.

In reference to FIG. 1, a rotational center of the operating cam 420 is disposed in the "3 o'clock 6 o'clock region". A rotational center of the operating lever A412 is disposed in the "12 o'clock 3 o'clock region". A rotational center of the coupling lever A444 is disposed in the "3 o'clock 6 o'clock region". A rotational center of the hour/minute coupling lever 442 is disposed in the "6 o'clock 9 o'clock region". A rotational center of the hammer transmission lever A480 is disposed in the "3 o'clock 6 o'clock region". A rotational center of the hammer transmission lever B482 is disposed in the "6 o'clock 9 o'clock region". The hammer 464 is disposed in the "6 o'clock 9 o'clock region".

Figure 36:
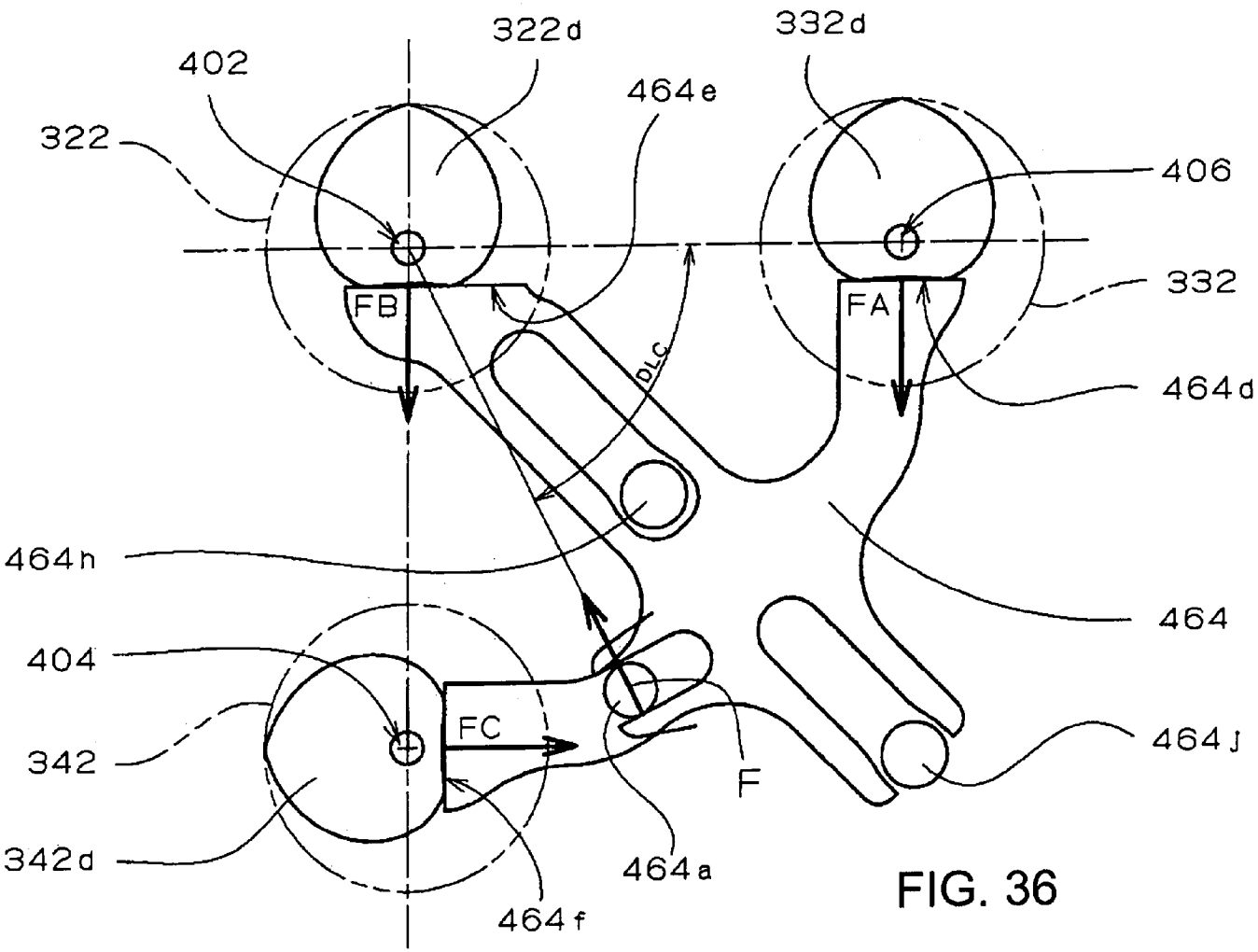
FIG. 36 is a partial plane view showing the hammer, a hammer transmission lever B, an hour heart cam, a second heart cam and a minute heart cam in a state of bringing the hammer into contact with the hour heart cam, the second heart can and the minute heart cam according to the embodiment of the chronograph timepiece of the invention.

In reference to FIG. 36, an angle made by a straight line connecting the rotational center 402 of the second chronograph wheel & pinion 322 and the rotational center 406 of the hour chronograph wheel & pinion 332 and a straight line connecting the rotational center 402 of the second chronograph wheel & pinion 322 and the rotational center 404 of the minute chronograph wheel & pinion 342 is constituted to be 90 degrees.

In reference to FIG. 4, FIG. 34, FIG. 35 and FIG. 36, in the reset state in which the reset button 308 is depressed in the direction designated by the arrow mark and the hammer transmission lever A480 is rotated in the counterclockwise direction, the operating cam contact portion 480*b* of the hammer transmission lever A480 is disposed in the valley portion 422*u* of the drive teeth 422 of the operating cam 420. By moving the hammer transmission lever operating pin 480*c* of the hammer transmission lever A480, the hammer transmission lever B482 is rotated in the clockwise direction centering on the hammer transmission lever B rotating shaft 482*k*.

By moving the hammer operating portion 482*c* of the hammer transmission lever B482, a force is exerted to the hammer operating pin 464*a*. Therefore, the hammer 464 is linearly moved to the hour heart cam 332*d*, the second heart cam 322*d* and the minute heart cam 342*d* by being guided by the hammer guide pin A464*h* and the hammer guide pin B464*j*. Further, the hour heart cam contact portion 464*d* is brought into contact with the hour heart cam 332*d*, the second heart cam contact portion 464*e* is brought into contact with the second heart cam 322*d* and the minute heart cam contact portion 464*f* is brought into contact with the minute heart cam 342*d*. Therefore, by operating the reset button 308, the hour heart cam 332*d* and the second heart cam 322*d* and the minute heart cam 342*d* can be zeroed. Under the state, all of the chronograph hour hand 338, the chronograph minute hand 348 and the chronograph second hand 324 indicate "zero positions" (refer to FIG. 15).

When the hammer 464 is brought into contact with the hour heart cam 332*d*, the second heart cam 322*d* and the minute heart cam 342*d*, the position of the hammer 464 is constituted to determine only by the hour heart cam 332*d*, the second heart cam 322*d* and the minute heart cam 342*d*. That is, the position of the hammer 464 is constituted to be subjected to "self alignment" by the three heart cams. A clearance is provided between the hammer guide hole 464*b* of the hammer 464 and the hammer guide pin A464*h*. The clearance when the hammer 464 is brought into contact with the hour heart cam 332*d*, the second heart cam 322*d* and the minute heart cam 342*d* is constituted to be larger than the clearance when the hammer 464 is guided by the hammer guide pin A464*h* and the hammer guide pin B464*j*.

A clearance is provided between the hammer guide portion 464*c* of the hammer 464 and the hammer guide pin B464*j*. The clearance when the hammer 464 is brought into contact with the hour heart cam 332*d*, the second heart cam 322*d* and the minute heart cam 342*d* is constituted to be larger than the clearance when the hammer 464 is guided by the hammer guide pin A464*h* and the hammer guide pin B464*j*. By the constitution, when the hammer 464 is brought into contact with the hour heart cam 332*d*, the second heart cam 322*d* and the minute heart cam 342*d*, the position of the hammer 464 is firmly determined by the three heart cams. That is, the position of the hammer 464 is subjected to "self alignment" by the three heart cams.

Figure 34:
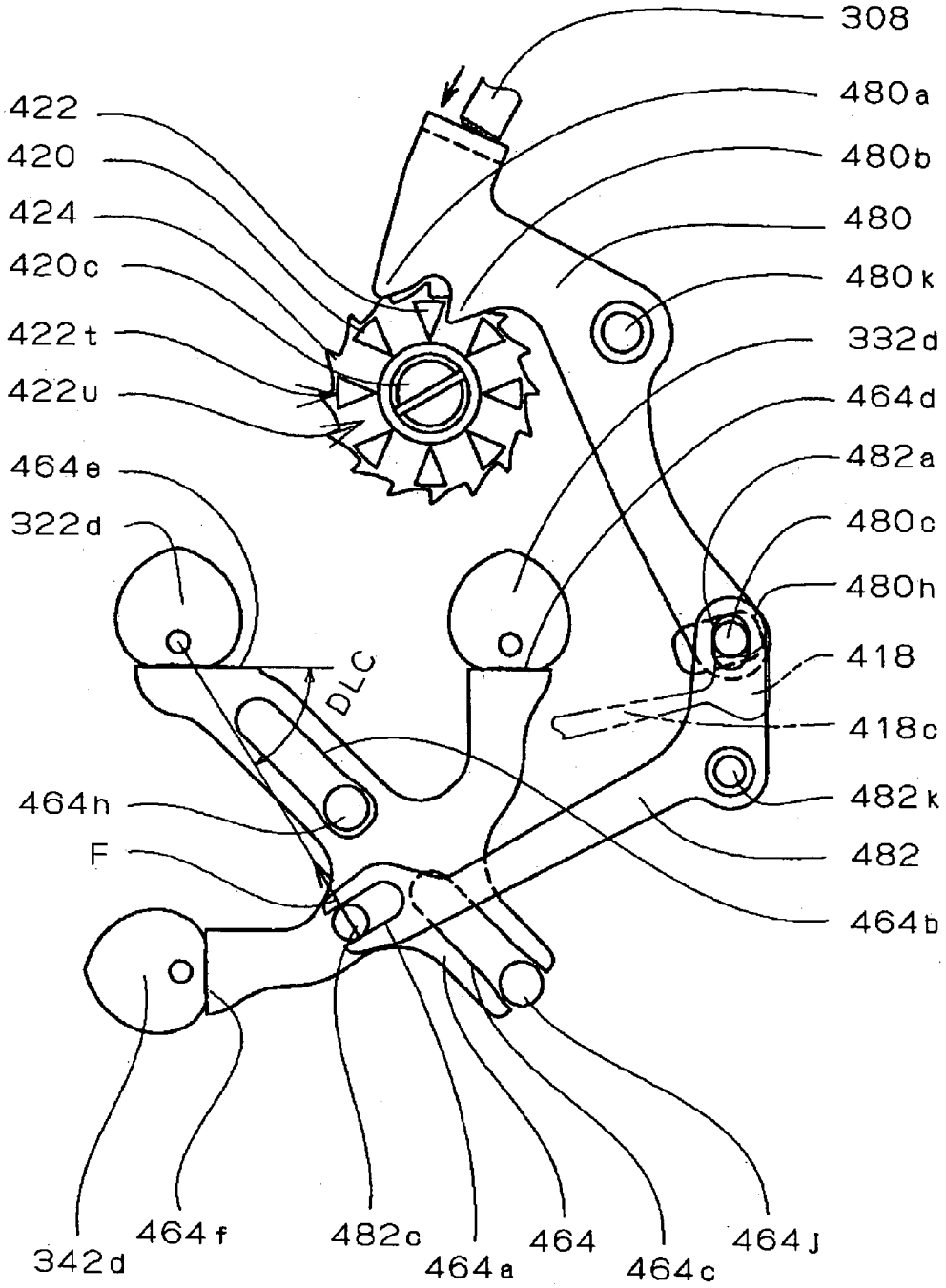
FIG. 34 is a partial plane view showing the hammer and the operating cam in the reset state according to the embodiment of the chronograph timepiece of the invention.

In reference to FIG. 33, FIG. 34 and FIG. 36, it is preferable that the hour heart cam contact portion 464*d* and the second heart cam contact portion 464*e* are constituted to be in parallel with each other. It is preferable that an angle made by the hour heart cam contact portion 464*d* and the second heart cam contact portion 464*e* is constituted to equal to or smaller than 10 degrees. An angle DTF made by the hour heart cam contact portion 464*d* and the minute heart cam contact portion 464*f* is preferably constituted to be 80 degrees through 100 degrees and further preferably, right angle (90 degrees). When the hammer 464 is brought into contact with the hour heart cam 332*d*, the second heart cam 322*d* and the minute heart cam 342*d*, a direction of a press force exerted from the hammer transmission lever B482 to the hammer operating pin 464*a* is constituted to pass the rotational center of the second chronograph wheel & pinion 322. By the constitution, the hammer 464 can firmly and simultaneously zero (return) the hour heart cam 332*d* and the minute heart cam 342*d*.

It is preferable that an angle DLT made by a direction of moving the hammer 464 to the hour heart cam 332*d*, the second heart cam 322*d* and the minute heart cam 342*d* by being guided by the hammer guide pin A464*h* and the hammer guide pin B464*j* relative to the hour heart cam contact portion 464*d* falls in a range of 30 degrees through 60 degrees. A stroke of operating the hammer 464 is minimized when DLT is 45 degrees. Therefore, it is particularly preferable that the angle DLT is 45 degrees. By the constitution, the hammer 464 can firmly zero the hour heart cam 332*d*, the second heart cam 322*d* and the minute heart cam 342*d*. It is further preferable that the angle DLT is 45 degrees. By the constitution, the hammer 464 can further firmly zero (return) the hour heart cam 332*d*, the second heart cam 322*d* and the minute heart cam 342*d*.

In reference to FIG. 36, when the reset button 308 is depressed in the direction and the hammer 464 is brought into contact with the hour heart cam 332*d*, the second heart cam 322*d* and the minute heart cam 342*d*, a force exerted to the hour heart cam 332*d* by the hour heart cam contact portion 464*d* of the hammer 464 (heart cam pressing force) is designated by notation FA, a force exerted to the second heart cam 322*d* by the second heart cam contact portion 464*e* of the hammer 464 is designated by notation FB and a force exerted to the minute heart cam 342*d* by the minute heart cam contact portion 464*f* of the hammer 464 is designated by notation FC.

Figure 37:
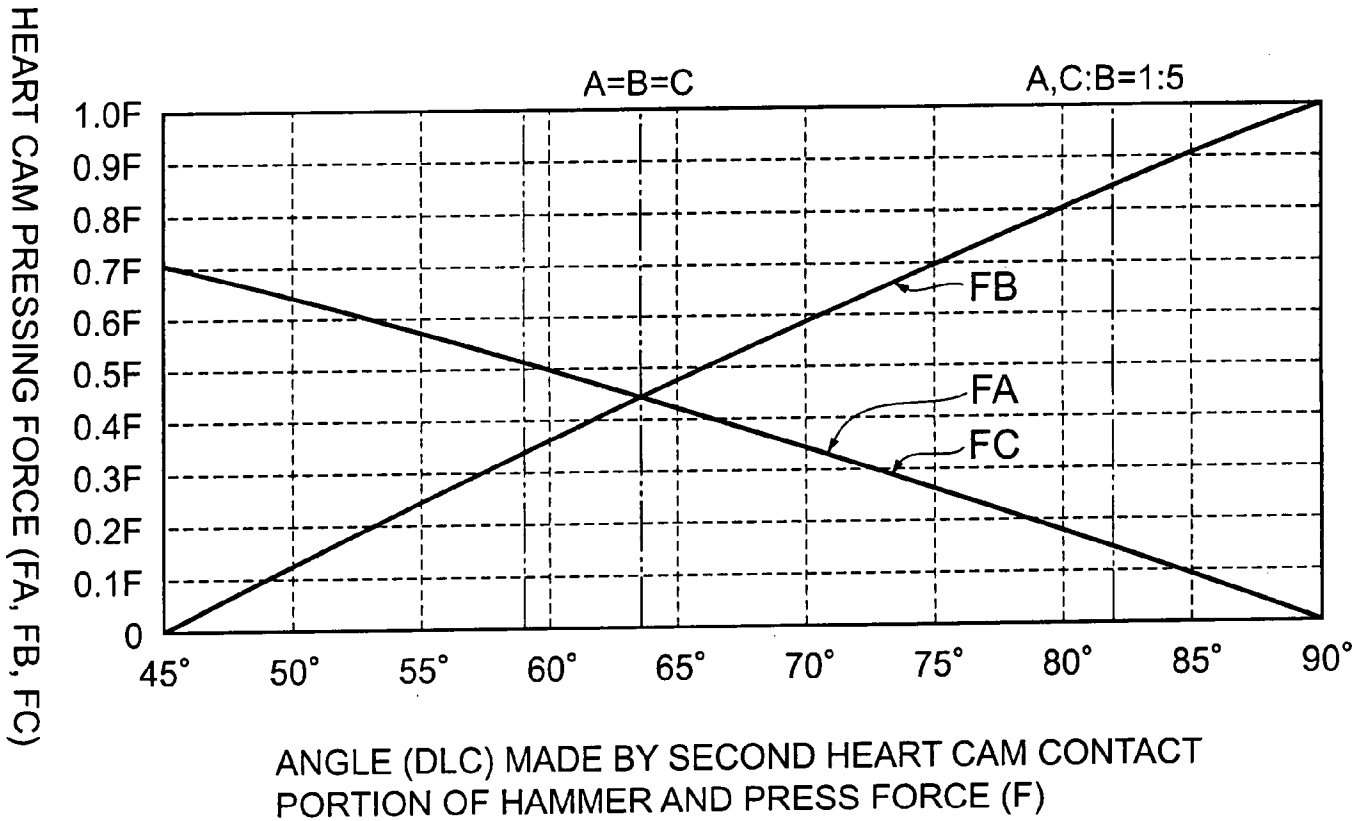
FIG. 37 is a graph showing forces of pressing the hour heart cam, the second heart cam and the minute heart cam by the hammer according to the embodiment of the chronograph timepiece of the invention.

In reference to FIG. 37, by the result of analyzing operation of the hammer 464, it has been found that when the reset button 308 is depressed and the hammer 464 is brought into contact with the hour heart cam 332*d*, the second heart cam 322*d* and the minute heart cam 342*d*, in the case in which an angle DLC made by the second heart cam contact portion 464*e* of the hammer 464 and a press force F is about 63.4 degrees, the force FA of bringing the hammer 464 into contact with the hour heart cam 332*d*, the force FB of bringing the hammer 464 into contact with the second heart cam 322*d* and the force FC of bringing the hammer 464 into contact with the minute heart cam 342*d* are substantially equal. Here, in analyzing operation of the hammer 464, it has been assumed that all of a friction coefficient between the hammer 464 and the hour heart cam 332*d*, a friction coefficient between the hammer 464 and the second heart cam 322*d* and a friction coefficient and a friction angle between the hammer 464 and the minute heart cam 342*d* are 0.

When the reset button 308 is depressed in the direction designated by the arrow mark and the hammer 464 is brought into contact with the hour heart cam 332*d*, the second heart cam 322*d* and the minute heart cam 342*d*, the angle DLC made by the direction of the force applied to the hammer operating pin 464*a* relative to the second heart cam contact portion 464*e* of the hammer 464 is preferably 57 degrees through 84 degrees and further preferably 63 degrees through 82 degrees. When operation of the hammer 464 is analyzed in details, the force FA exerted to the hour heart cam 332*d* by the hammer 464, the force FB exerted to the second heart cam 322*d* by the hammer 464 and the force FC exerted to the minute heart cam 342*d* by the hammer 464 become the same value when the angle DLC is 63.4 degrees. In consideration of weight ratios, movements of inertia and the like of the indicators, a ratio of the force FA exerted to the hour heart cam 332*d* by the hammer 464 as well as the force FC exerted to the minute heart cam 342*d* by the hammer 464 as compared with the force FB exerted to the second heart cam 322*d* by the hammer 464 becomes 1:5 when the angle DLC is 81.85 degrees. Therefore, it is particularly preferable that the angle DLC falls in a range of 63 degrees through 82 degrees.

The force exerted to the hammer operating pin 464*a* provided at the hammer 464 by the click spring 418 via the hammer transmission lever B482 is designated by notation F (refer to FIG. 34). The force exerted to the second heart cam 322*d* by the hammer 464 becomes smaller than 0.3F when the angle DLC is 57.2 degrees. Further, the force FA exerted to the hour heart cam 332*d* by the hammer 464 as well as the force FB exerted to the minute heart cam 342*d* by the hammer 464 becomes shorter than 0.1F when the angle DLC is 84.2 degrees. Therefore, it is preferable that the angle DLC falls in a range of 57 degrees through 84 degrees.

By constituting the hammer 464 in this way, the force FA exerted to the hour heart cam 332*d* by the hammer 464, the force FB exerted to the second heart cam 322*d* by the hammer 464 and the force FC exerted to the minute heart cam 342*d* by the hammer 464 can be constituted to be substantially uniform.

(10) An Explanation of Operation of a Chronograph Timepiece

In reference to FIG. 15, in a state of not operating the chronograph mechanism, the hour hand 368 indicates "hour" in current time, the minute hand 364 indicates "minute" in current time, and the second hand 354 (small second hand) indicates "second" in current time. The chronograph timepiece shown in FIG. 15 indicates time at an interval between "10 o'clock 8 minute 12 second" and "10 o'clock 8 minute 13 second". Under the state, the chronograph hour hand 338 is stopped at a position indicating "12", the chronograph minute hand 348 is stopped at a position indicating "30" and the chronograph second hand 324 is stopped at a position indicating the 12 o'clock direction of the timepiece, that is, "60".

The chronograph second hand 324 is constituted to rotate by 1 rotation per 1 minute. Chronograph second graduations in correspondence with the chronograph second hand 324 are provided as "5", "10", "15" . . . "50", "55" and "60" along the outer periphery of the timepiece, that is, along a rotational locus of a front end of the chronograph second hand 324.

As an example, an embodiment of a chronograph timepiece of the invention is constituted to be a timepiece of, so-to-speak "8 oscillation". "8 oscillation" indicates a constitution in which a balance with hairspring is oscillated by 28800 oscillations in 1 hour. Here, "oscillation" indicates a state of rotating the balance with hairspring in one direction and the balance with hairspring returns to the original position by "2" oscillations. That is, in the case of the timepiece of "8 oscillation", the balance with hairspring is oscillated by 8 oscillations in 1 second and oscillated to make 4 reciprocations in 1 second. The chronograph timepiece may be constituted to be a timepiece of so-to-speak "10 oscillation". "10 oscillation" indicates a constitution in which the balance with hairspring is oscillated by 36000 oscillations in 1 hour. According to a timepiece of "10 oscillation", the balance with hairspring is oscillated by 10 oscillations in 1 second and oscillated to make 5 reciprocations in 1 second. By constituting in this way, there can be realized a chronograph timepiece capable of measuring chronograph by a unit of "1/10 second".

According to the constitution, a graduation of chronograph second may be provided for each "1/10 second" or the graduation of chronograph second may be provided at each "1/5 second". By constituting in this way, the chronograph timepiece having high accuracy can be realized. The chronograph timepiece may be constituted to be a timepiece of so-to-speak "5.5 oscillation" or "6 oscillation". According to the constitutions, the graduation of the chronograph second is set in accordance with the number of oscillations and also a number of teeth of the train wheel is set in accordance with the number of oscillations.

The chronograph minute hand 348 is constituted to rotate by 1 rotation in 30 minutes. Graduations of chronograph minute in correspondence with the chronograph minute hand 348 are set such as "5", "10", "15", "20", "25" and "30" along a rotational locus of a front end of the chronograph minute hand 348. The chronograph minute hand 348 may be constituted to rotate by 1 rotation in 60 minutes.

The chronograph hour hand 338 is constituted to rotate by 1 rotation in 12 hours. Graduations of chronograph hour in correspondence with the chronograph hour hand 338 are set such as "1", "2", "3" . . . "11" and "12" along a rotational locus of a front end of the chronograph hour hand 338. The chronograph hour hand 338 may be constituted to rotate by 1 rotation in 24 hours.

A date character of the date indicator 376 indicates current date. The chronograph timepiece shown in FIG. 15 indicates "5". Although in FIG. 15, there is shown a structure in which the position of the date window is disposed at middle of the "4 o'clock direction" and the "5 o'clock direction" of the movement, the position of the date window can be arranged in the "12 o'clock direction" of the movement or can be arranged at other position of "1 o'clock direction", "8 o'clock direction" or the like.

According to the chronograph timepiece of the invention, the rotational center of the hour hand 368, the rotational center of the minute hand 364 and the rotational center of the chronograph second hand 324 are arranged substantially at the center of the timepiece, the rotational center of the second hand 354 (small second hand) is arranged on the 3 o'clock side of the timepiece, the rotational center of the chronograph minute hand 348 is arranged on the 9 o'clock side of the timepiece and the rotational center of the chronograph hour hand 338 is arranged on the 6 o'clock side of the timepiece. Therefore, according to the chronograph timepiece of the invention, indication of the respective indicators is very easy to understand.

Figure 26:
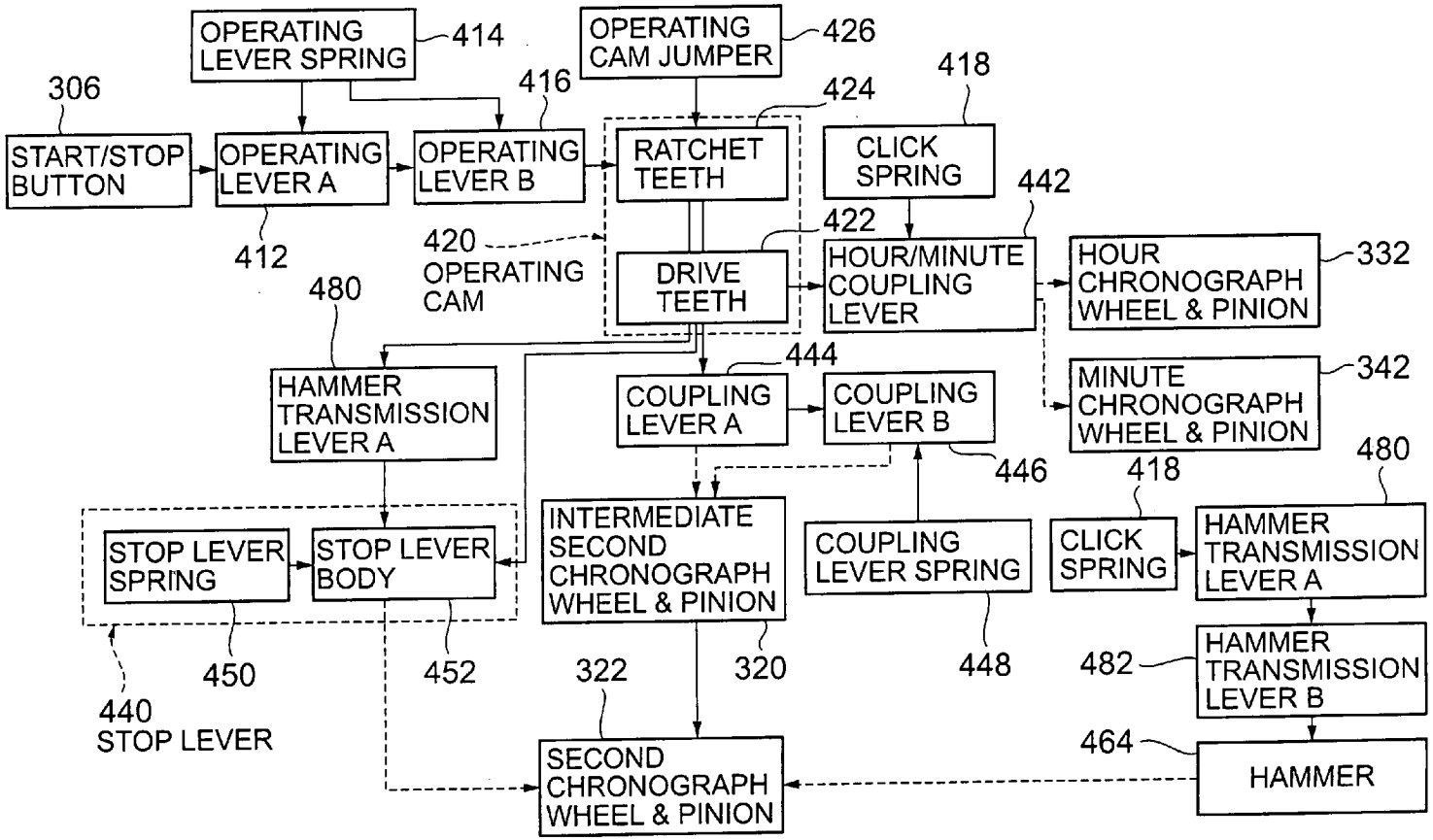
FIG. 26 is a functional block diagram showing a constitution of a coupling mechanism according to the embodiment of the chronograph timepiece of the invention.

In reference to FIG. 15 and FIG. 26, chronograph can be started to measure by depressing the start/stop button 306 disposed in the 2 o'clock direction of the chronograph timepiece. That is, when the start/stop button 306 is depressed, the operating lever A412 and the operating lever B416 are operated, the ratchet teeth 424 of the operating cam 420 are fed by 1 tooth and the operating cam 420 is rotated. When the operating cam 420 is rotated, the coupling lever A444 and the coupling lever B446 are separated from the intermediate second chronograph wheel clutch ring 320*d*, the hour/minute coupling lever 442 is separated from the intermediate hour chronograph wheel clutch ring 332*h* and the intermediate minute chronograph wheel clutch ring 342*h* to make clutch ON. As a result, the second chronograph wheel shaft 322*c* is rotated, the minute chronograph wheel shaft 342*c* is rotated and the hour chronograph wheel shaft 332*c* is rotated. As a result, the chronograph second hand 324 indicates "second" of a result of measuring chronograph, the chronograph minute hand 348 indicates "minute" of the result of measuring chronograph and the chronograph hour hand 338 indicates "hour" of the result of measuring chronograph.

Next, when the start/stop button 306 is depressed by one more time, the chronograph timepiece can be stopped to measure. That is, when the start/stop button 306 is depressed by one more time, the operating lever A412 and the operating lever B416 are operated to feed the ratchet teeth 424 of the operating cam 420 by 1 tooth to rotate the operating cam 420. When the operating cam 420 is rotated, the coupling lever A444 and the coupling lever 446 are brought into contact with the intermediate second chronograph wheel clutch ring 320*d*, the hour/minute coupling lever 442 is brought into contact with the intermediate hour chronograph wheel clutch ring 332*h* and the intermediate minute chronograph wheel clutch ring 342*h* to make clutch OFF. Further, the operating cam 420 operates the stop lever 440 and the stop lever 440 restricts the stop lever plate 322 of the second chronograph wheel 322. As a result, rotation of the second chronograph wheel shaft 322*c* is stopped, rotation of the minute chronograph wheel shaft 342*c* is stopped and rotation of the hour chronograph wheel shaft 332*c* is stopped. As a result, the chronograph second hand 324 is stopped to indicate "second" of the result of measuring chronograph, the chronograph minute hand 348 is stopped to indicate "minute" of the result of measuring chronograph and the chronograph hour hand 338 is stopped to indicate "hour" of the result of measuring chronograph.

Under the state, when the start/stop button 306 is depressed by one more time, chronograph can be restarted to measure from the state of stopping to measure chronograph.

Figure 35:
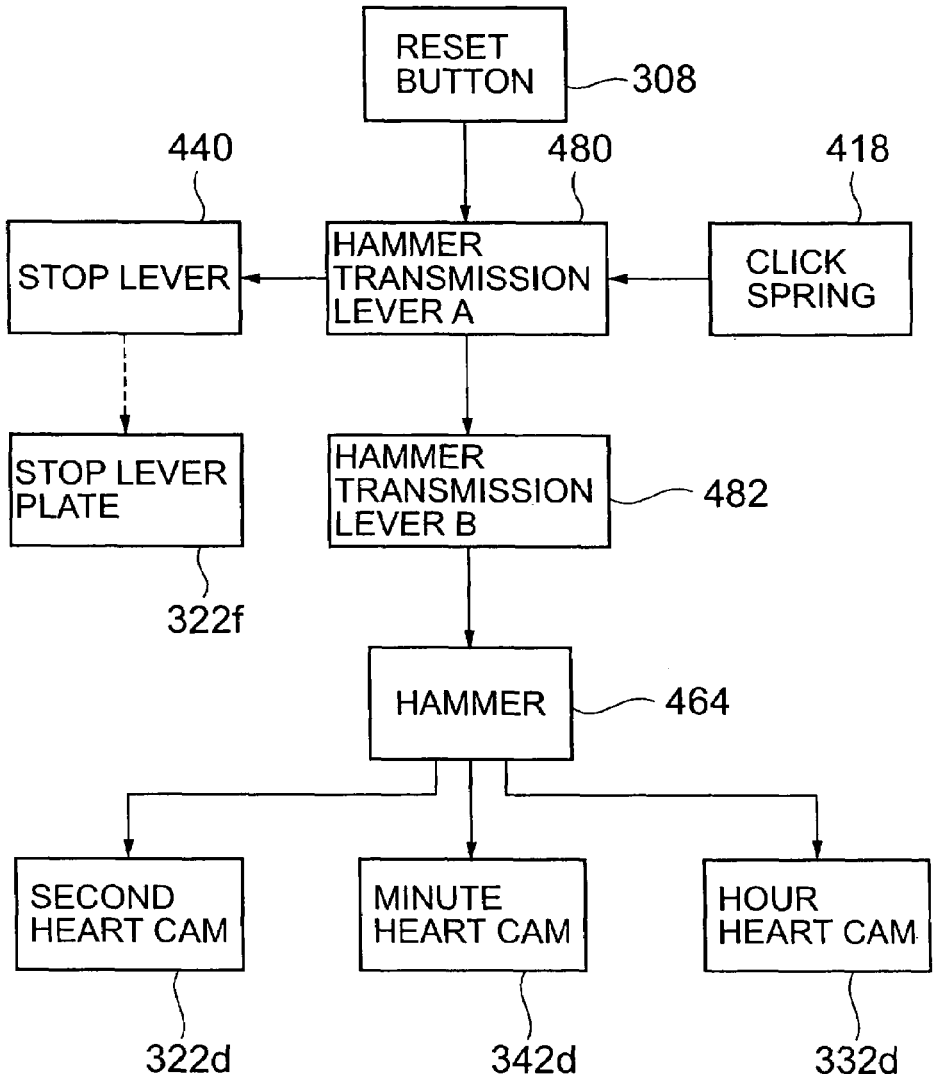
FIG. 35 is a functional block diagram showing a constitution of a reset mechanism according to the embodiment of the chronograph timepiece of the invention.

In reference to FIG. 15 and FIG. 35, in the state of stopping to measure chronograph, when the reset button 308 is depressed, the chronograph second hand 324, the chronograph minute hand 348 and the chronograph hour hand 338 are returned to stop at "zero positions" before starting to operate the chronograph mechanism. That is, when the reset button 308 is depressed, the hammer transmission lever A480, the hammer transmission lever B482 and the hammer 464 are operated. Further, the hammer transmission lever A480 rotates the stop lever 440, the restricting portion 452*c* of the stop lever body 452 is separated from the stop lever plate 322*f* to make the second chronograph wheel 322 in a free state. Further, the hammer 464 rotates the second heart cam 322*d*, rotates the minute heart cam 342*d* and rotates the hour heart cam 332*d* to zero the chronograph second hand 324, the chronograph minute hand 348 and the chronograph hour hand 338 to "zero positions".

Even in measuring chronograph, or in the state of stopping to measure chronograph, the hour hand 368 indicates "hour" in current time, the minute hand 364 indicates "minute" in current time and the second hand 354 indicates "second" in current time.

In reference to FIG. 5, FIG. 6 and FIG. 15, the winding stem 108 can be pulled out by pulling out a crown 390. Date can be corrected by pulling out the winding stem 108 to 1 stage and rotating the winding stem 108 by rotating the crown 390. Time can be corrected by pulling out the winding stem 108 to 2 stage and rotating the winding stem 108 by rotating the crown 390.

According to the chronograph timepiece of the invention, the number of parts is small and fabrication and assembly of hammer mechanism are facilitated. That is, according to the chronograph timepiece of the invention, the hammer can be subjected to self alignment by the hour heart cam, the second heart cam, and the minute heart cam in zeroing and a degree of freedom can be provided to design of the hammer.

Therefore, part tolerances of parts constituting the hammer mechanism can be absorbed by the constitution and individual adjustments of parts are dispensed with.

Further, according to the chronograph timepiece of the invention, the hour heart cam, the second heart cam and the minute heart cam firmly and simultaneously be zeroed.

Further, according to the chronograph timepiece of the invention, the force of bringing the hammer into contact with the hour heart cam, the force of bringing the hammer into contact with the second heart cam, and the force of bringing the hammer into contact with the minute heart cam can be made to be substantially uniform.

What is claimed is:

1. A chronograph timepiece having a power source comprised of a main spring provided in a barrel complete, mounted for undergoing rotation, the chronograph timepiece comprising:

a main plate forming a base plate of a movement;

a surface train wheel for undergoing rotation in accordance with rotation of the barrel complete;

an escapement/speed control apparatus for controlling rotation of the surface train wheel;

a second chronograph train wheel, comprising a second chronograph wheel & pinion having a second heart cam;

a chronograph second hand connected to the second chronograph wheel & pinion for indicating second time;

a minute chronograph train wheel comprising a minute chronograph wheel & pinion having a second heart cam;

a chronograph minute hand connected to the minute chronograph wheel & pinion for indicating minute time;

an hour chronograph train wheel comprising an hour chronograph wheel & pinion having an hour heart cam;

a chronograph hour hand connected to the hour chronograph wheel & pinion for indicating hour time;

a hammer for contacting the hour heart cam, the minute heart cam and the second heart cam to zero the hour chronograph wheel & pinion, the minute chronograph wheel & pinion and the second chronograph wheel & pinion, respectively; and a reset button for controlling operation of the hammer to zero the hour chronograph wheel & pinion, the minute chronograph wheel & pinion and the second chronograph wheel & pinion;

wherein a straight line connecting a rotational center of the second chronograph wheel & pinion and a rotational center of the hour chronograph wheel & pinion is disposed at an angle of 90 degrees relative to a straight line connecting the rotational center of the second chronograph wheel & pinion and a rotational center of the minute chronograph wheel & pinion; and wherein when the hammer is brought into contact with the hour heart cam; the second heart cam; the minute heart cam, a position of the hammer is determined only by the hour heart cam, the second heart cam and the minute heart cam, respectively and a direction of a pressing force exerted to the hammer passes the rotational center of the second chronograph wheel & pinion.

2. A chronograph timepiece according to claim 1;

wherein the hammer is has a guide portion and is mounted for undergoing movement; and further comprising guide pin for contacting the guide portion of the hammer to guide movement of the hammer guide pin.

3. A chronograph timepiece according to claim 2;

wherein a first clearance is formed between the guide portion of the hammer and the guide pin when movement of the hammer is guided by the guide portion and the guide pin; and wherein a second clearance formed between the guide portion of the hammer and the guide pin when the hammer is brought into contact with the hour heart cam, the second heart cam and the minute heart cam is larger than the first clearance.

4. A chronograph timepiece according to claim 1;

wherein an angle formed between a contact portion of the hour heart cam for contacting the hammer and a contact portion of the second heart cam for contacting the hammer is equal to or smaller than 10 degrees; and wherein an angle formed between a contact portion of the hour heart cam and a contact portion of the minute heart cam for contacting the hammer is in the range of 80 degrees to 100 degrees.

5. A chronograph timepiece according to claim 1;

wherein the hammer has a hammer operating pin; and wherein when the hammer is brought into contact with the hour heart cam, the minute heart cam and the second heart cam, an angle formed by a direction of a force exerted to a contact portion of the hammer operating pin relative to a contact portion of the second heart cam is in the range of 57 degrees to 84 degrees.

6. A chronograph timepiece according to claim 1; further comprising at least one of an automatic winding apparatus and a hand winding apparatus.

* * * * *